US009624632B2

(12) United States Patent
Houle

(10) Patent No.: US 9,624,632 B2
(45) Date of Patent: Apr. 18, 2017

(54) SNOWBLOWER IMPELLER

(71) Applicant: IMMEUBLES MFP 1006 INC., Wickham (CA)

(72) Inventor: Pascal Houle, Wickham (CA)

(73) Assignee: IMMEUBLES MFP 1006 INC., Wickham (CA)

( * ) Notice: Subject to any disclaimer, the term of this patent is extended or adjusted under 35 U.S.C. 154(b) by 116 days.

(21) Appl. No.: 14/639,195

(22) Filed: Mar. 5, 2015

(65) Prior Publication Data

US 2015/0252542 A1 Sep. 10, 2015

Related U.S. Application Data

(60) Provisional application No. 61/988,959, filed on May 6, 2014, provisional application No. 61/948,911, filed on Mar. 6, 2014.

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC E01H 5/045; E01H 5/076; E01H 5/09; E01H 5/098
See application file for complete search history.

(56) References Cited

U.S. PATENT DOCUMENTS 1,698,901 A * 1/1929 Zinn ..... E01H 5/096 37/248
2,219,204 A * 10/1940 Wandscheer ..... E01H 5/096 37/248
2,732,638 A * 1/1956 Leufvenius ..... E01H 5/04 37/256
3,085,832 A * 4/1963 Guillemette ..... E01H 5/076 37/256
3,131,491 A 5/1964 Durrschmidt
(Continued)

FOREIGN PATENT DOCUMENTS

CA 998919 10/1976
CA 1065904 11/1979
(Continued)

OTHER PUBLICATIONS

Souffleuse à neige Max-Twin, Mar. 5, 2014, Agrimetal, Wickham (QC), Canada.

(Continued)

*Primary Examiner* — Jamie L McGowan
(74) *Attorney, Agent, or Firm* — Mathieu Audet

(57) ABSTRACT

An impeller for a snowblowing apparatus and a snowblower being designed to rotate about a rotation axis and is including a front axial region to receive snow therein, a rear axial region and a plurality of vanes generally radially extending from the periphery toward the rotation axis, the plurality of vanes including snow-engaging portions generally located toward the front axial region, wherein the snow-engaging portions are radially extending from the periphery further toward the rotation axis over the impeller's eye, at least some of the snow engaging portions including an angle of attack toward the front axial region for engaging snow when the impeller is rotating about the rotation axis.

20 Claims, 70 Drawing Sheets

(56) References Cited

U.S. PATENT DOCUMENTS

| | | | | |
|---|---|---|---|---|
| 3,484,962 | A * | 12/1969 | Klapprodt | E01H 5/076 37/256 |
| 3,673,715 | A | 7/1972 | Lines | |
| 3,736,674 | A * | 6/1973 | Enters | E01H 5/045 37/248 |
| 3,774,321 | A | 11/1973 | David | |
| 3,780,455 | A | 12/1973 | Stevenson | |
| 4,062,135 | A | 12/1977 | Dobberpuhl | |
| 4,068,397 | A | 1/1978 | Bacon | |
| 4,123,857 | A | 11/1978 | Enters | |
| 4,184,274 | A | 1/1980 | Vohl | |
| 4,203,237 | A | 5/1980 | Enters | |
| 4,261,116 | A * | 4/1981 | Kahlbacher | E01H 5/096 37/248 |
| 4,288,933 | A | 9/1981 | Fair | |
| D262,797 | S | 1/1982 | Arthur | |
| D269,092 | S | 5/1983 | Davies, III | |
| 4,409,748 | A | 10/1983 | Westimayer | |
| 4,418,485 | A | 12/1983 | Herren | |
| 4,457,086 | A | 7/1984 | Bacon | |
| 4,477,989 | A | 10/1984 | Vachon | |
| 4,480,397 | A | 11/1984 | Vachon | |
| 4,541,187 | A | 9/1985 | Phelps | |
| 4,592,156 | A | 6/1986 | Schmidt | |
| 4,597,203 | A | 7/1986 | Middleton | |
| 4,619,061 | A | 10/1986 | Swanson | |
| 4,869,003 | A | 9/1989 | O'Loughlin | |
| D307,912 | S | 5/1990 | Yoshida | |
| 5,018,592 | A | 5/1991 | Buchdrucker | |
| 5,090,142 | A | 2/1992 | Peters | |
| 5,123,186 | A | 6/1992 | Matushita | |
| 5,127,174 | A * | 7/1992 | Takeshita | E01H 5/045 37/250 |
| 5,438,770 | A | 8/1995 | Miller | |
| 5,479,730 | A | 1/1996 | Gogan | |
| 5,603,173 | A | 2/1997 | Brazell | |
| 5,813,152 | A | 9/1998 | Weight | |
| D408,950 | S | 4/1999 | Basham | |
| 5,915,835 | A | 6/1999 | Fair | |
| 6,058,629 | A | 5/2000 | Peterson | |
| 6,154,985 | A | 12/2000 | Champagne | |
| 6,318,003 | B1 | 11/2001 | Heismann | |
| D457,171 | S | 5/2002 | Fowler | |
| 6,578,292 | B2 | 6/2003 | Dowe | |
| 6,624,477 | B1 | 9/2003 | Takemura | |
| 6,662,477 | B2 | 12/2003 | Dowe | |
| 6,865,826 | B1 | 3/2005 | Lakin | |
| 6,938,364 | B2 * | 9/2005 | White, III | E01H 5/098 37/248 |
| 7,121,021 | B2 * | 10/2006 | Sakai | E01H 5/045 37/233 |
| 7,703,223 | B2 | 4/2010 | Walker | |
| 7,735,246 | B2 | 6/2010 | Kaskawitz | |
| 7,866,068 | B2 | 1/2011 | Van Buren | |
| 7,971,695 | B2 | 7/2011 | Vaughn | |
| 8,065,823 | B2 | 11/2011 | Morrell | |
| 8,544,856 | B2 | 10/2013 | Sayre | |
| 8,584,383 | B1 | 11/2013 | Morse | |
| D705,271 | S | 5/2014 | Cmich | |
| D705,272 | S | 5/2014 | Cmich | |
| D737,335 | S | 8/2015 | Cmich | |
| 9,096,980 | B2 | 8/2015 | Ricketts | |
| 9,096,981 | B2 | 8/2015 | Wians | |
| 9,279,222 | B2 * | 3/2016 | Gerrits | E01H 5/045 |
| 2002/0108274 | A1 | 8/2002 | Dowe | |
| 2003/0033736 | A1 | 2/2003 | Fortin | |
| 2003/0154632 | A1 | 8/2003 | Dowe | |
| 2003/0159317 | A1 | 8/2003 | Dowe | |
| 2004/0255492 | A1 * | 12/2004 | White, III | E01H 5/098 37/244 |
| 2005/0241190 | A1 | 11/2005 | Kettering | |
| 2006/0225309 | A1 | 10/2006 | Champagne | |
| 2009/0159392 | A1 | 6/2009 | Vaughn | |
| 2009/0223089 | A1 | 9/2009 | Kaskawitz | |
| 2009/0293321 | A1 | 12/2009 | Walker | |
| 2010/0236106 | A1 | 9/2010 | Muscarella | |
| 2010/0281718 | A1 | 11/2010 | Van Buren | |
| 2011/0146112 | A1 | 6/2011 | Morrell | |
| 2012/0074662 | A1 | 3/2012 | Sayre | |
| 2012/0192464 | A1 | 8/2012 | Winter | |
| 2013/0291411 | A1 | 11/2013 | Cmich | |
| 2013/0291412 | A1 | 11/2013 | Cmich | |
| 2014/0090278 | A1 | 4/2014 | Ricketts | |
| 2014/0096418 | A1 | 4/2014 | Kaskawitz | |
| 2014/0215863 | A1 | 8/2014 | Wians | |
| 2014/0237863 | A1 | 8/2014 | Winter | |
| 2015/0252542 | A1 * | 9/2015 | Houle | E01H 5/098 37/259 |

FOREIGN PATENT DOCUMENTS

| | | |
|---|---|---|
| CA | 1187909 | 5/1985 |
| CA | 1189882 | 7/1985 |
| CA | 1195704 | 10/1985 |
| CA | 2215457 | 3/1999 |
| CA | 2225196 | 6/1999 |
| CA | 2239744 | 12/1999 |
| CA | 2240436 | 5/2000 |
| CA | 2371704 | 7/2003 |
| CA | 2541044 | 9/2006 |
| CA | 2690821 | 7/2011 |
| EP | 0198155 | 10/1986 |
| EP | 2712963 | 4/2014 |
| WO | WO2013154676 | 10/2013 |

OTHER PUBLICATIONS

Souffleuse à neige Max-Snow, Mar. 5, 2014, Agrimetal, Wickham (QC), Canada.

Econor souffleuses à neige, Mar. 5, 2014, La Compagnie Normand Ltée, Saint-Pascal (QC), Canada.

Souffleuse à neige Pronovost, Mar. 5, 2014, Pronovost, Canada.

Supplementary European search report, Mar. 15, 2011, European Patent Office, The Hague.

* cited by examiner

SNOWBLOWER IMPELLER

CROSS-REFERENCES

The present application is a nonprovisional of, and claims priority under 35 U.S.C. 119(e) to, U.S. provisional patent application No. 61/948,911, filed Mar. 6, 2014, entitled SNOWBLOWER, and to U.S. provisional patent application No. 61/988,959, filed May 6, 2014, entitled SNOWBLOWER, which are both incorporated herein by reference in their entireties. Any publication of and any patent issuing from the foregoing U.S. patent applications is hereby incorporated herein by reference.

BACKGROUND OF THE INVENTION

1. Field of the Invention

This invention generally relates to an apparatus for blowing snow. The present invention more specifically relates to a member of a snowblower impeller that is adapted to propel the snow. The present invention also relates to other features adapted to improve the efficiency of a snowblower.

2. Description of the Related Art

Apparatuses for removing snow come in various configurations. They come in small size for personal snowblowers and they reach significant sizes in industrial applications. Generally, snowblowers are designed to remove snow, ice, and sometimes other debris, from the ground and propel the snow and ice at a distance to clear the ground.

Snowblowers can use different mechanical configurations to perform the required task. Some snowblowers are using an endless screw in front of the apparatus to break the snow and the ice in smaller portions, in a first stage, and then use a rotatable impeller to propel the snow and the ice at a distance from the snowblower, in a second stage. The distance and the direction are managed with a directional nozzle. The snowblower can be powered in different ways, generally with an engine via a drive member. The engine can be part of the snowblower in some configurations. A vehicle carrying the snowblower can alternatively provide power to the snowblower in other configurations.

The rotatable impeller generally includes a series of vanes or blades sized and designed to receive thereon snow and ice. Rotation of the blades is propelling the snow and the ice. The blades are generally equipped with a knife portion to cut through snow and ice. The blades are generally disposed on the snow contacting edge of the impeller to propel the snow. The snow is generally pushed toward the exterior diameter of the impeller when propelled by the rotating impeller, subjected to centrifugal forces.

To some extent, the impeller can be compared to a turbine that is pumping air and snow. The blades of the impeller are thus designed to ingest snow, a solid material, and are also pumping air, a fluid with lesser density. The vanes that are generally flat to prevent solid material to squeeze between the vanes and the impeller housing. The design of the impeller could be improved to increase the efficiency of the snowblower and reduce the required amount of power to perform the same work.

It is therefore desirable to provide an improved snowblower over the existing art that is requiring less power to propel a same amount of snow and ice.

It is also desirable to provide an improved impeller over the existing art that is adapted to ingest and propel more snow.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention is generally described as an improved impeller for a snowblower having improved snow-blowing capability and other improvements thereof as described below.

The invention is generally described as a self-powered snowblower having improved snow-blowing capability and other improvements thereof caused, at least in part, by an improved design of the impeller as described below.

The invention is generally described as a vehicle including a snowblower having improved snow-blowing capability and other improvements thereof caused, at least in part, by an improved design of the impeller as described below.

The invention is generally described as a method of propelling snow and other materials by a snow blower having improved snow blowing capability and other improvements thereof caused, at least in part, by an improved design of the impeller as described below.

The invention is generally described as a method of propelling snow and other materials carried on by a vehicle including a snowblower having improved snow blowing capability and other improvements thereof caused, at least in part, by an improved design of the impeller as described therein.

The invention is generally described as a replacement impeller for existing snowblowers, the replacement impeller having improved snow-blowing capability and other improvements thereof caused, at least in part, by an improved design of the impeller as described below.

Aspects of our work, in accordance with at least one embodiment of the invention, provide an improved snowblower impeller performance over the existing art.

Aspects of our work, in accordance with at least one embodiment of the invention, provide an impeller including a plurality of radially elongated vanes adapted to propel snow and ice.

Aspects of our work, in accordance with at least one embodiment of the invention, provide an impeller including at least some elongated vanes including a portion thereof that are substantially extending toward the rotation axis of the impeller in a fashion adapted to generate augmented vacuum via the area in proximity of the rotation axis of the impeller to move additional air and snow with the impeller.

Aspects of our work, in accordance with at least one embodiment of the invention, provide an impeller including a plurality of radially elongated vanes adapted to propel snow and ice. At least some of the elongated vanes including a snow-engaging portion that is substantially extending toward the rotation axis of the impeller in a fashion adapted to ingest more material with the center portion of the impeller in proximity of the rotation axis of the impeller.

Aspects of our work, in accordance with at least one embodiment of the invention, provide an impeller including a plurality of radially elongated vanes adapted to propel snow and ice. At least some of the elongated vanes including portion substantially extending to the center of the impeller in a fashion adapted to move air inside the snow blower.

Aspects of our work, in accordance with at least one embodiment of the invention, provide an impeller including a plurality of radially elongated vanes adapted to propel snow and ice. At least some of the elongated vanes including portion substantially extending over the rotation axis of the impeller.

Aspects of our work, in accordance with at least one embodiment of the invention, provide an impeller including a plurality of radially elongated vanes sized and designed to prevent a loss of pressure via an area at the center of the impeller, on the front side of the vanes.

Aspects of our work, in accordance with at least one embodiment of the invention, provide an impeller including improved attack edges on the vanes.

Aspects of our work, in accordance with at least one embodiment of the invention, provide an impeller including toothed attack edges on the vanes.

Aspects of our work, in accordance with at least one embodiment of the invention, provide an impeller including vanes with at least one attack edge substantially extending to the center of the impeller to increase the amount of snow collected by the impeller.

Aspects of our work, in accordance with at least one embodiment of the invention, provide an impeller including vanes with at least one attack edge substantially extending to the center of the impeller to increase the vacuum created by the rotating impeller.

Aspects of our work, in accordance with at least one embodiment of the invention, provide an impeller including vanes on the distal portion of the impeller, and not extending in the center of the impeller, with at least one attack edge substantially extending to the center of the impeller to increase the amount of snow propelled by the impeller.

Aspects of our work, in accordance with at least one embodiment of the invention, provide an impeller including vanes on the distal portion of the impeller, and not extending in the center of the impeller, with at least one attack edge substantially extending toward the center of the impeller to increase the vacuum created by the rotating impeller.

Aspects of our work, in accordance with at least one embodiment of the invention, provide an impeller including improved blades on the vanes.

Aspects of our work, in accordance with at least one embodiment of the invention, provide an impeller including vanes with at least one blade substantially extending toward the center of the impeller to increase the amount of snow collected by the impeller.

Aspects of our work, in accordance with at least one embodiment of the invention, provide an impeller including vanes with at least one blade substantially extending toward the center of the impeller to increase the vacuum created by the rotating impeller.

Aspects of our work, in accordance with at least one embodiment of the invention, provide an impeller including vanes on the distal portion of the impeller, and not extending in the center of the impeller, with at least one blade substantially extending toward the center of the impeller to increase the amount of injected snow in the impeller.

Aspects of our work, in accordance with at least one embodiment of the invention, provide an impeller including vanes on the distal portion of the impeller, and not extending in the center of the impeller, with at least one blade substantially extending to the center of the impeller to increase the vacuum created by the rotating impeller.

Aspects of our work, in accordance with at least one embodiment of the invention, provide an impeller having vanes with at least one angled blade to increase the amount of snow propelled by the impeller.

Aspects of our work, in accordance with at least one embodiment of the invention, provide an impeller having vanes with at least one angled attack edge substantially extending toward the center of the impeller to increase the amount of snow propelled by the impeller.

Aspects of our work, in accordance with at least one embodiment of the invention, provide an impeller having vanes with at least one multi-angled blade substantially extending toward the center of the impeller to increase the amount of snow propelled by the impeller.

Aspects of our work, in accordance with at least one embodiment of the invention, provide an impeller having vanes with at least one multi-angled snow attack edge substantially extending to the center of the impeller to increase the amount of snow propelled by the impeller.

Aspects of our work, in accordance with at least one embodiment of the invention, provide an impeller having vanes with at least one tooted snow engaging blade substantially extending across the entire diameter of the impeller to increase the amount of snow propelled by the impeller.

Aspects of our work, in accordance with at least one embodiment of the invention, provide an impeller having removable snow-engaging portions that are securable to respective vanes.

Aspects of our work, in accordance with at least one embodiment of the invention, provide assembled an impeller having removable snow-engaging portions.

Aspects of our work, in accordance with at least one embodiment of the invention, provide an impeller having a first set of tooted snow-engaging portions secured on respective vanes and also optionally removable tooted snow-engaging portions secured to the first set of tooted snow-engaging portions. The first set of tooted snow-engaging portions and the removable tooted snow-engaging portions can be of similar of dissimilar shape and sizes. The teeth of the first set of tooted snow-engaging portions and the removable tooted snow-engaging portions can have aligned teeth or offset teeth.

Aspects of our work, in accordance with at least one embodiment of the invention, provide an impeller having vanes with at least one tooted attack edge substantially extending over the diameter of the impeller to increase the amount of injected snow propelled by the impeller. Aspects of our work, in accordance with at least one embodiment of the invention, provide a kit comprising an impeller having the advantages described therein and a snowblower housing adapted to operatively receive therein the impeller.

Aspects of our work, in accordance with at least one embodiment of the invention, provide an impeller for a snowblowing apparatus, the impeller being designed to rotate about a rotation axis, the impeller comprising a front axial region thereof, the front axial region being configured to receive snow therein; a rear axial region thereof; a periphery thereof; a hub, generally located between the front axial region and the rear axial region, adapted to rotate about the rotation axis; a plurality of vanes generally radially extending from the periphery toward the rotation axis, the plurality of vanes including a portion configured to propel snow between the front axial region and the rear axial region, a snow-engaging portion generally located toward the front axial region, wherein the snow engaging portion of at least one of the plurality of vanes radially is extending from the periphery further toward the rotation axis to reduce the radial area not covered by the snow-engaging portions of the other vanes when the impeller is rotating about the rotation axis.

Aspects of our work, in accordance with at least one embodiment of the invention, provide a snowblower comprising an impeller configured to rotate about a rotation axis, the impeller comprising a front axial region thereof, the front axial region being configured to receive snow therein; a rear axial region thereof; a periphery thereof; a hub, generally located between the front axial region and the rear axial region, adapted to rotate about the rotation axis; a plurality of vanes generally radially extending from the periphery toward the rotation axis, the plurality of vanes including a portion configured to propel snow between the front axial region and the rear axial region, a snow-engaging portion generally located toward the front axial region, wherein the snow engaging portion of at least one of the plurality of vanes radially is extending from the periphery further toward the rotation axis to reduce the radial area not covered by the snow-engaging portions of the other vanes when the impeller is rotating about the rotation axis.

Aspects of our work, in accordance with at least one embodiment of the invention, provide an impeller for a snowblowing apparatus, the impeller being designed to rotate about a rotation axis thereof, the impeller comprising a front axial region thereof, the front axial region being configured to receive snow therein; a rear axial region thereof; a periphery thereof; a hub, generally located between the front axial region and the rear axial region, adapted to rotate about the rotation axis; a plurality of vanes generally radially extending from the periphery toward the rotation axis, the plurality of vanes including a portion configured to propel snow between the front axial region and the rear axial region, a snow-engaging portion generally located toward the front axial region, wherein the snow engaging portion of at least one of the plurality of vanes radially is extending from the periphery further toward the rotation axis to reduce the radial area not covered by the snow-engaging portions of the other vanes when the impeller is rotating about the rotation axis.

Aspects of our work, in accordance with at least one embodiment of the invention, provide A snowblowing apparatus comprising an impeller adapted to rotate about a rotation axis thereof, the impeller comprising a front axial region thereof, the front axial region being configured to receive snow therein; a rear axial region thereof; a periphery thereof; a hub, generally located between the front axial region and the rear axial region, adapted to rotate about the rotation axis; a plurality of vanes generally radially extending from the periphery toward the rotation axis, the plurality of vanes including a portion configured to propel snow between the front axial region and the rear axial region, a snow-engaging portion generally located toward the front axial region, wherein the snow engaging portion of at least one of the plurality of vanes radially is extending from the periphery further toward the rotation axis to reduce the radial area not covered by the snow-engaging portions of the other vanes when the impeller is rotating about the rotation axis.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Our work is now described with reference to the figures. In the following description, for purposes of explanation, numerous specific details are set forth in order to provide a thorough understanding of the present invention by way of embodiment(s). It may be evident, however, that the present invention may be practiced without these specific details.

Figure 1:
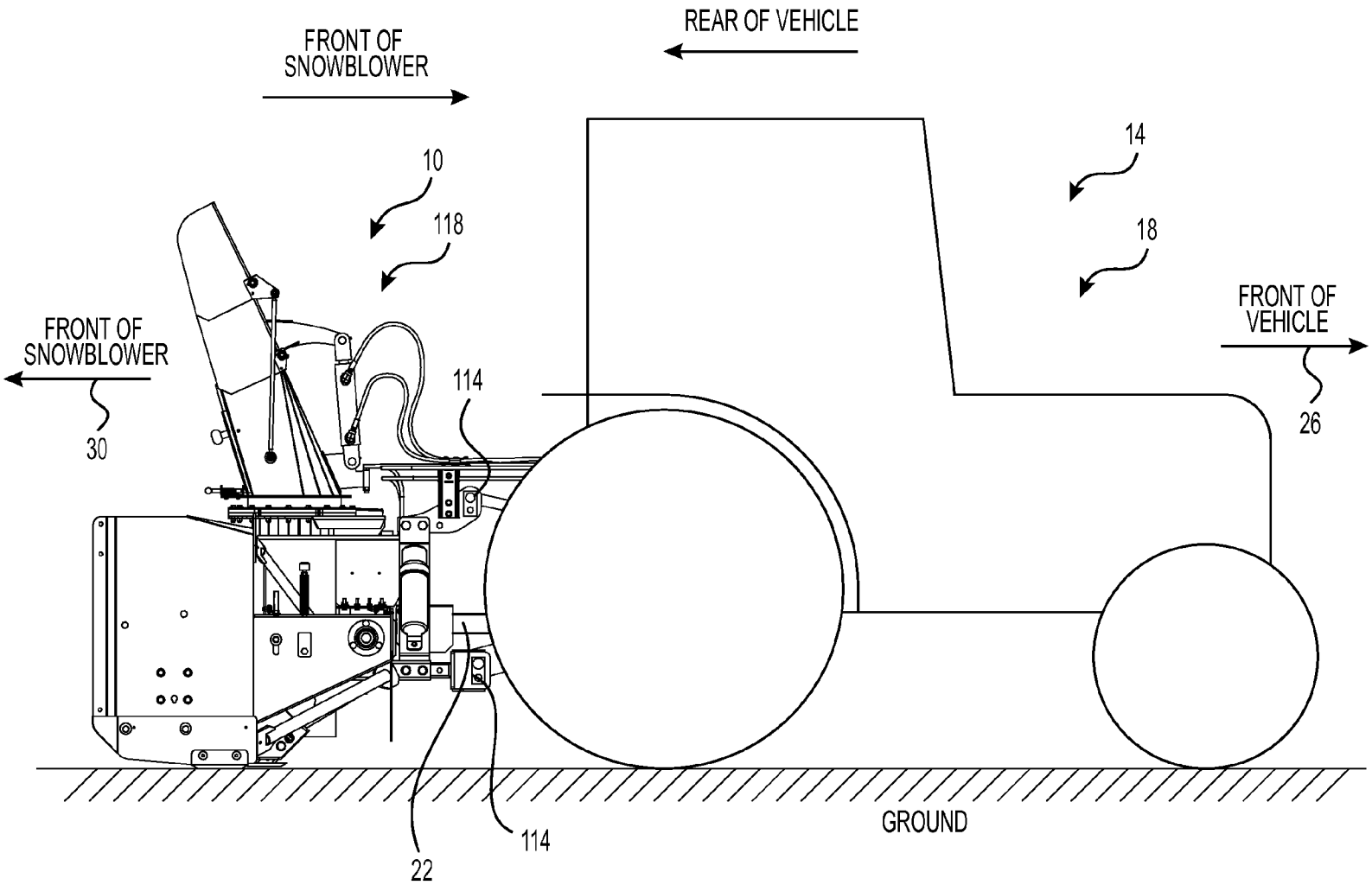
FIG. 1 is an illustration of an exemplary snowblower operatively attached at the back of a vehicle.

A snowblower 10 driven and powered by a vehicle 14 is illustrated in FIG. 1. In the present situation, the vehicle 14 is a schematically illustrated tractor 18 that is powering the snowblower 10 with its power take off (PTO) 22. The tractor 18 has a front side 26 and is driven in reverse to remove snow from the ground with the snowblower 10. The snowblower 10 thus has a front side 30 that is opposed to the tractor's front side 26 in the illustrated configuration. The snowblower 10 could alternatively be secured to the tractor 18 in the opposite direction causing the snowblower's front side 30 to be in the same direction as the tractor's front side 26 without departing from the scope of the present invention. The snowblower 10 could also alternatively be located in front of the tractor 18 without further departing from the scope of the invention. In the latter configuration, the front of the snowblower 10 would be in the same direction as the front of the tractor 18. The snowblower 10 could also be located in front of the tractor 18 with the snowblower's 10 front toward the rear of the tractor 18 (however this would be a bit unusual).

Figure 2:
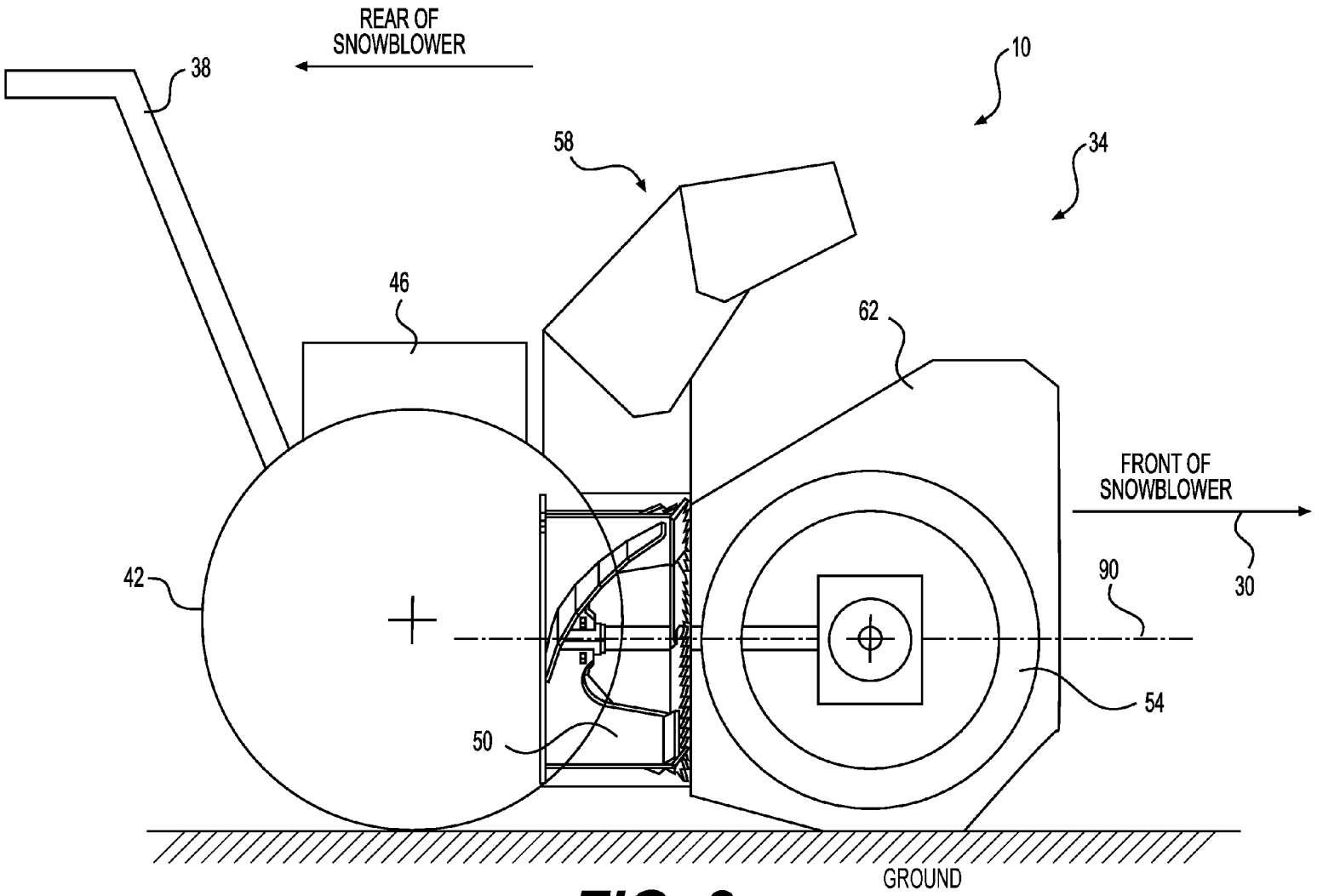
FIG. 2 is a side elevational view of a manually operated snowblower, in accordance with at least one embodiment thereof r.

A snowblower 10 of a different configuration is illustrated in FIG. 2. The self-powered snowblower 34 illustrated in FIG. 2 generally refers to personal snowblowers 10. The snowblower 34 generally includes a pair of handles 38 for a user to grasp to operate the snowblower 10, a pair of wheels 42, an engine 46 driving the wheels 42, an impeller 50 and a screw 54 located in front of the snowblower 34 to manage the snow introduced in the impeller 50. A snow-directing mechanism 58 operatively associated with the impeller 50 is located above the impeller 50.

The text that follows is going to describe a snowblower in the configuration illustrated in FIG. 1 to facilitate the reading of the text. The focus put on the snowblower in the configuration illustrated in FIG. 1 is not intended to disclaim any rights associated with snowblowers 10, 34 of different configurations even if not expressly described therein.

Figure 3:
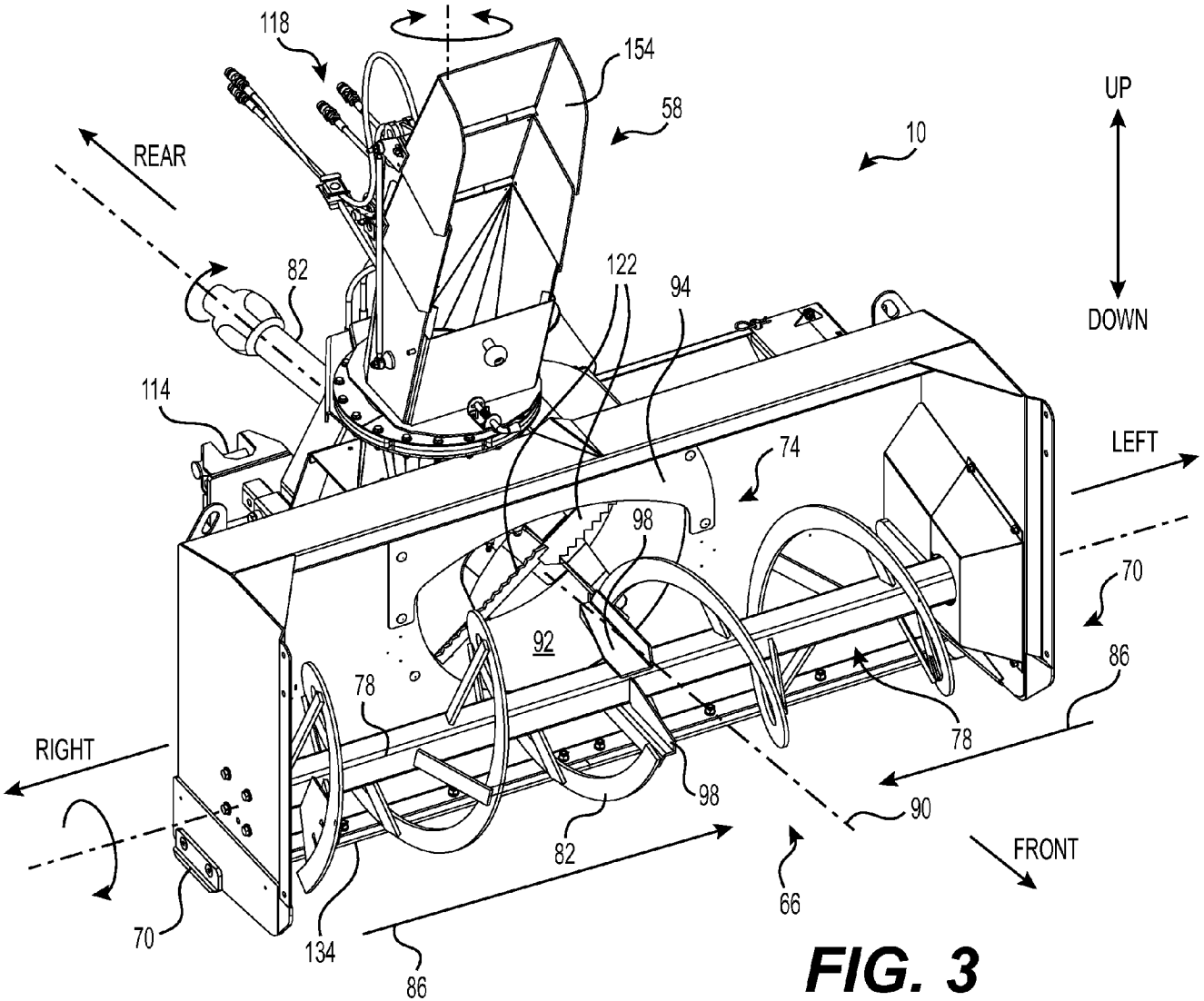
FIG. 3 is a perspective illustration of the front-right side of an exemplary snowblower, in accordance with at least one embodiment thereof.
Figure 5:
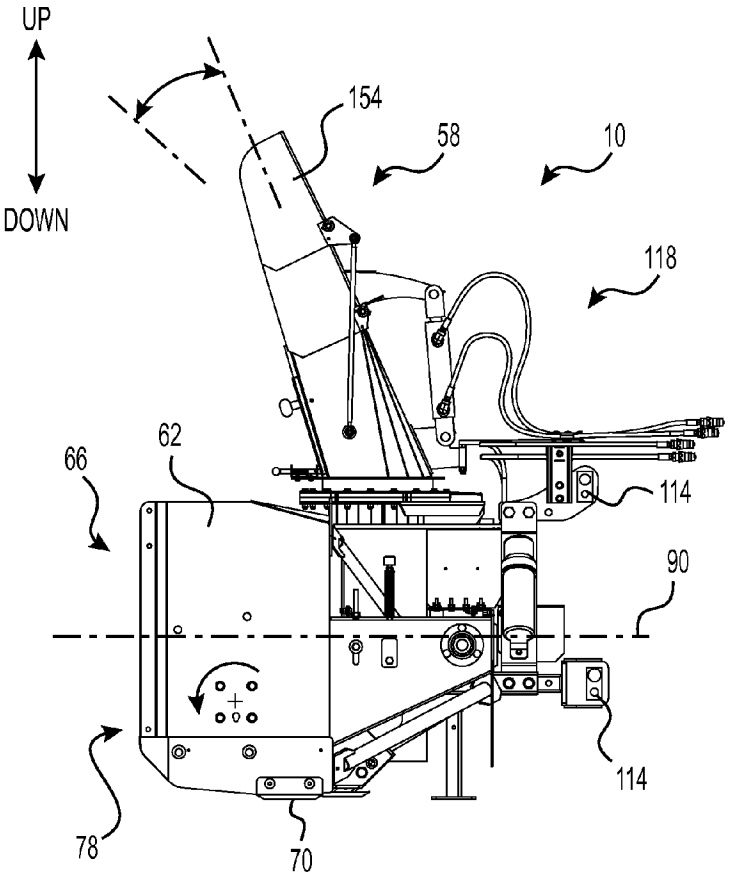
FIG. 5 is a left side elevational view of an exemplary snowblower, in accordance with at least one embodiment thereof.
Figure 4:
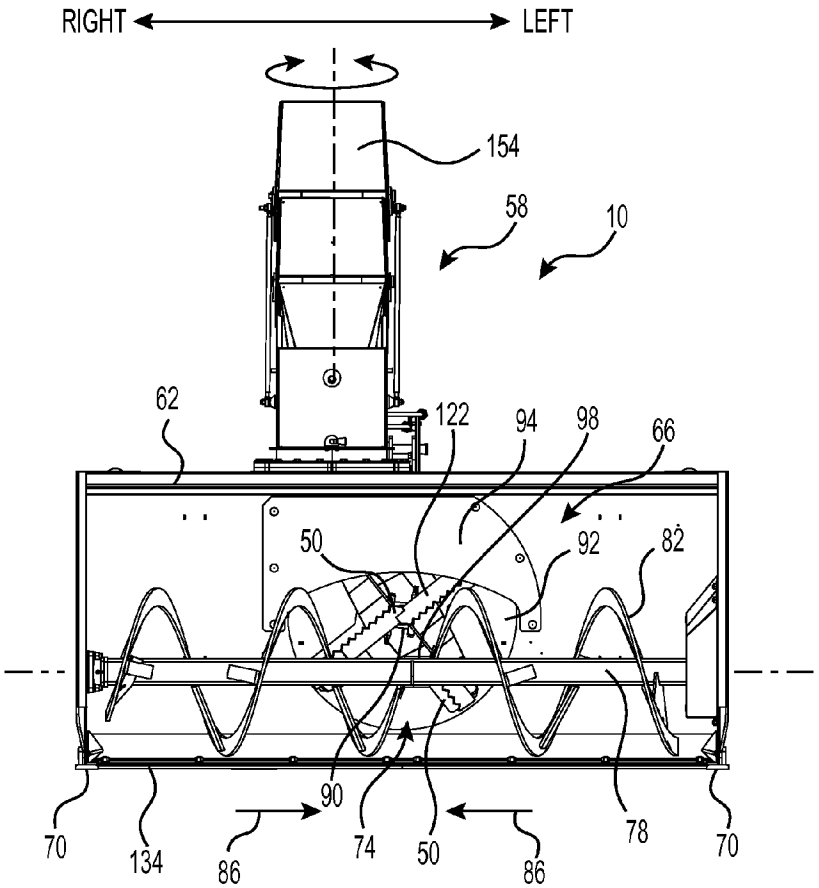
FIG. 4 is a of the an exemplary snowblower wherein the impeller is displayed.
Figure 7:
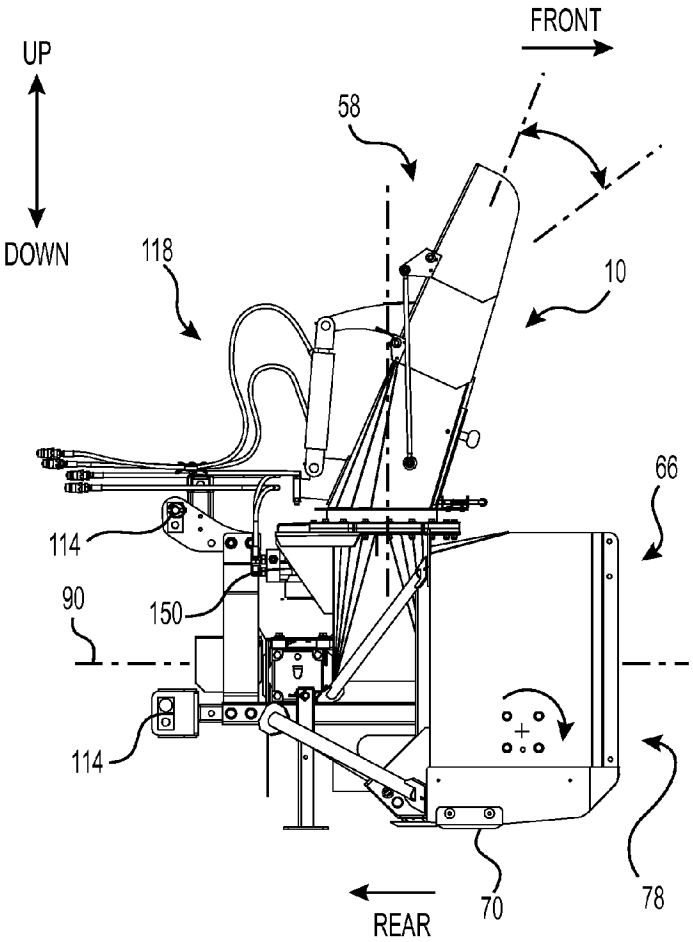
FIG. 7 is a left elevational view of an exemplary snowblower, in accordance with at least one embodiment thereof.
Figure 6:
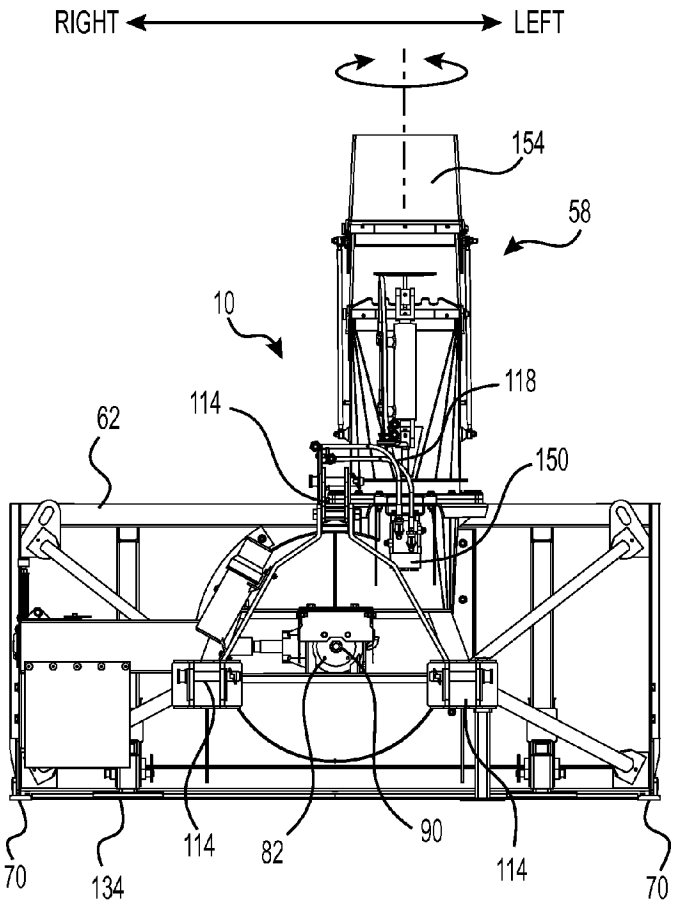
FIG. 6 is a rear elevational view of an exemplary snowblower, in accordance with at least one embodiment thereof.

Moving now to FIG. 3 throughout FIG. 7, illustrating a snowblower 10 with a snow-directing mechanism 58 capable of directing the snow propelled by the snowblower 10. The snow-directing mechanism 58 is configured to manage the direction and the height of the flow of snow when blown by the snowblower 10. The snowblower 10 includes a body 62 to which the snow-directing mechanism 58 is attached. The body 62 includes a snow-collecting portion 66 generally made of steel and generally having a rectangular section that is equipped with a pair of ground-contacting members 70 adapted to set the height of the snowblower 10 and facilitate the movement of the snowblower 10 on the ground. The body 62 also a snow-blowing mechanism 74 taking the snow from the snow collecting portion 66 to the snow-directing mechanism 68 and propel the snow at a distance from the snowblower 10.

Figure 8:
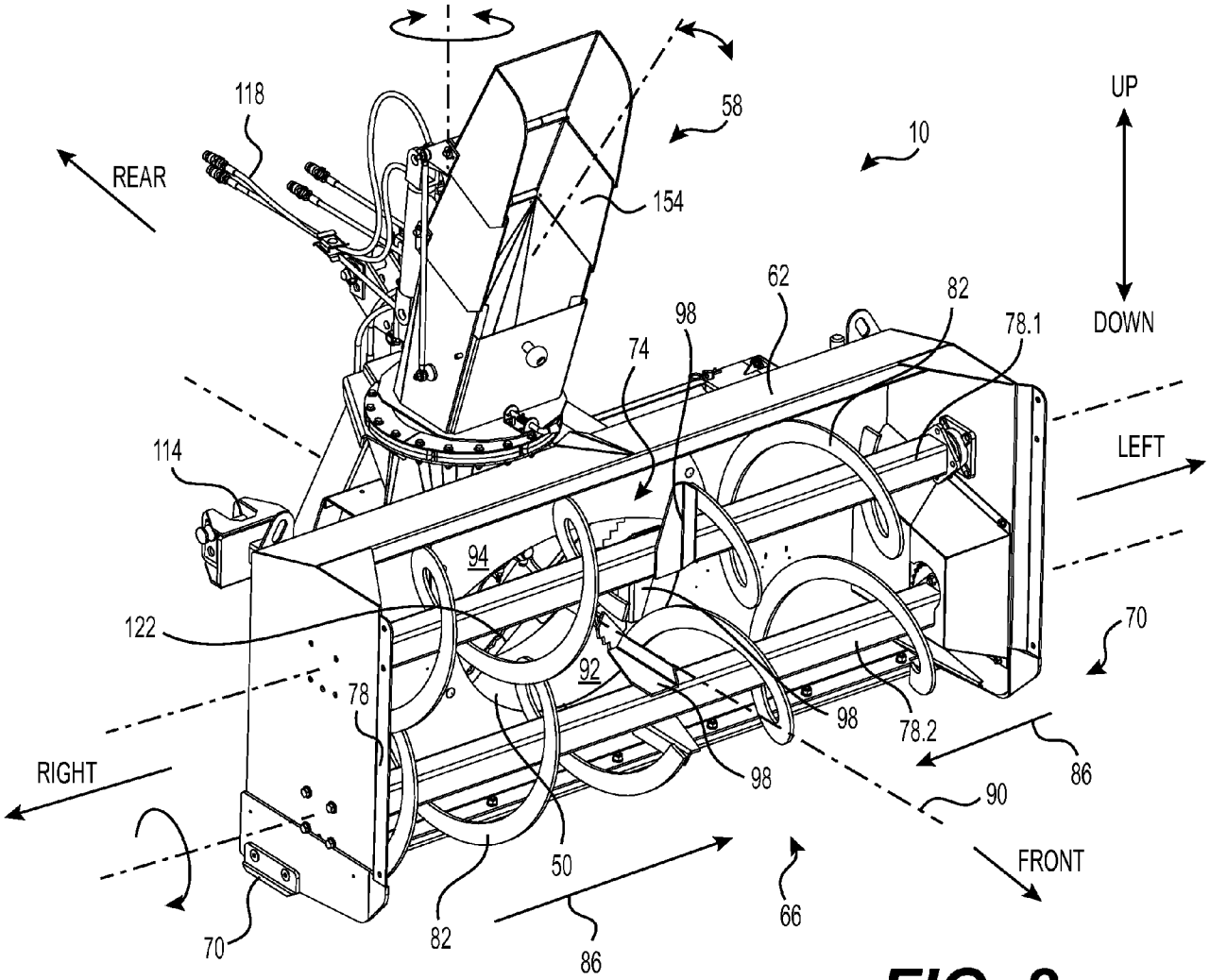
FIG. 8 is a rear-right perspective view of an exemplary snowblower with two screw-like tooth member, in accordance with at least one embodiment thereof.

The snow-collecting portion 66 is used to collect the snow on the ground and for other purposes. One of the other purposes is to make sure to limit the size of the pieces of snow to prevent blocking the snowblower 10 with blocks of snow and ice and therefore ensures proper functioning of the snow blowing mechanism 74. An exemplary embodiment of a mechanism adapted to do so is illustrated in FIG. 3 throughout FIG. 8. A front horizontal rotating axle 78 is equipped with a screw-like tooth member 82 to grind the snow in front of the snowblower 10. The axle 78 is rotated by a drive taking power from the engine's PTO (not shown) of the tractor 18. The screw-like tooth member 82 is designed in such a way that the snow is going to be moved 86 toward the center of the snowblower 10. In so doing, the direction of rotation of the screw-like tooth member 82 is opposed on each of the right side and the left side of the snowblower 10. A snowblower 10 with a pair of superposed rotating axles 78 is illustrated in FIG. 8 throughout FIG. 10.

Figure 10:
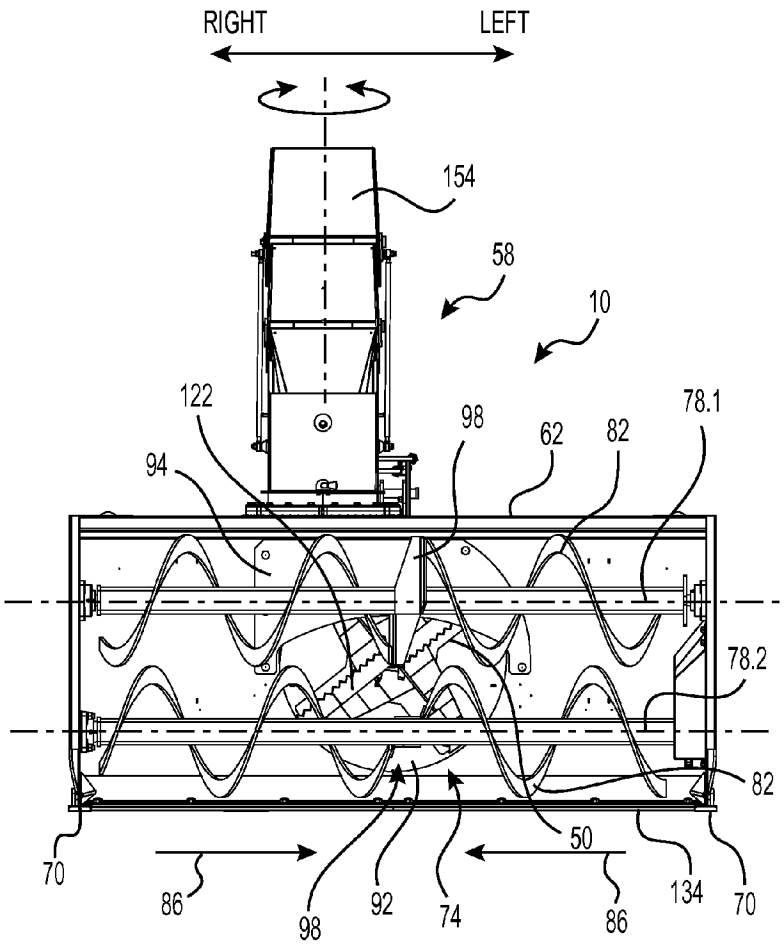
FIG. 10 is a front side elevational view of an exemplary snowblower, in accordance with at least one embodiment thereof.
Figure 9:
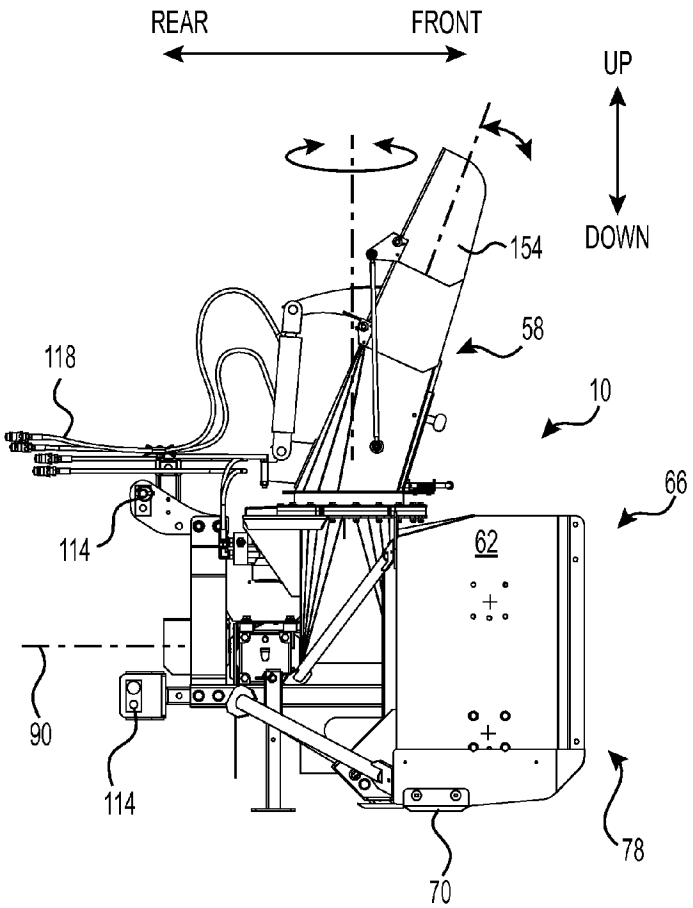
FIG. 9 is a right side elevational view of an exemplary snowblower, in accordance with at least one embodiment thereof.

The rotating axle 78 illustrated in FIG. 3 throughout FIG. 10 include a screw-like tooth member 82 with an additional snow shovel member 98 disposed in the middle of the screw-like tooth member 82. The snow shovel members 98 rotate with the rotating axle 78 and push the snow facing the middle portion of the screw-like tooth member 82 in the snowblower 10.

Still in FIG. 1 throughout FIG. 10, one can appreciate the typical three-point fastening mechanism 114 adapted to connect the snowblower 10 to the tractor 18. Other systems like the hydraulic system 118 for managing the direction of the snow can be appreciated.

The snowblower 10 has a snow-blowing mechanism 74 between the snow-collecting portion 66 and the snow-directing mechanism 58. The snow-blowing mechanism 74 is generally housed within the body 62 in a shape of an impeller 50 rotating about a rotational axis 90 as it is illustrated in FIG. 2 throughout FIG. 7. One can appreciate that the opening 92 of the snow-blowing mechanism 74 is managed with a restriction member 94. The restriction member 94 is embodied as a plate in the Figures and could be embodied differently to serve a comparable function. The restriction member 94 is covering the upper portion of the impeller's housing opening 92 in the body 62. The restriction member 94 restricts the opening 92 that is accelerating the flow of air and snow inside the snow-blowing mechanism 74 given the smaller opening 92. The restriction member 94 can be adjustable and covers a desired portion of the opening 92. The restriction member 94 is preferably applied on the upper portion of the opening 92 and can cover a small portion of the opening 92 to about half of the opening 92. The restriction member 94 also interacts with the impeller 50 to optimize the vacuum created by the rotative impeller 50. More precise interaction between the restriction member 94 and a snow-engaging portion 122 of the impeller 50 that is going to be discussed in more details below.

Figure 11:
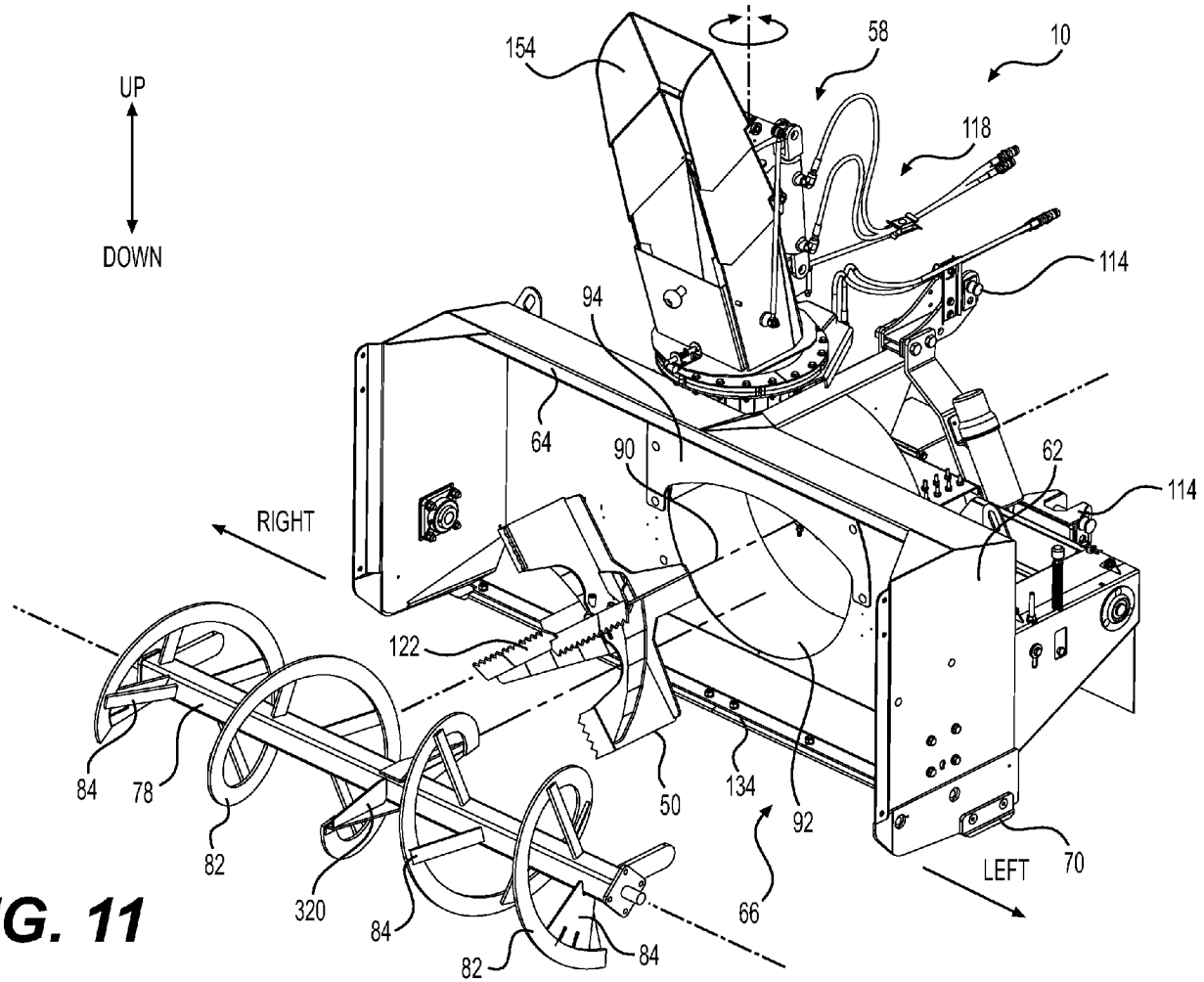
FIG. 11 is a perspective illustration of a semi-exploded view of an exemplary snowblower, in accordance with at least one embodiment thereof.
Figure 12:
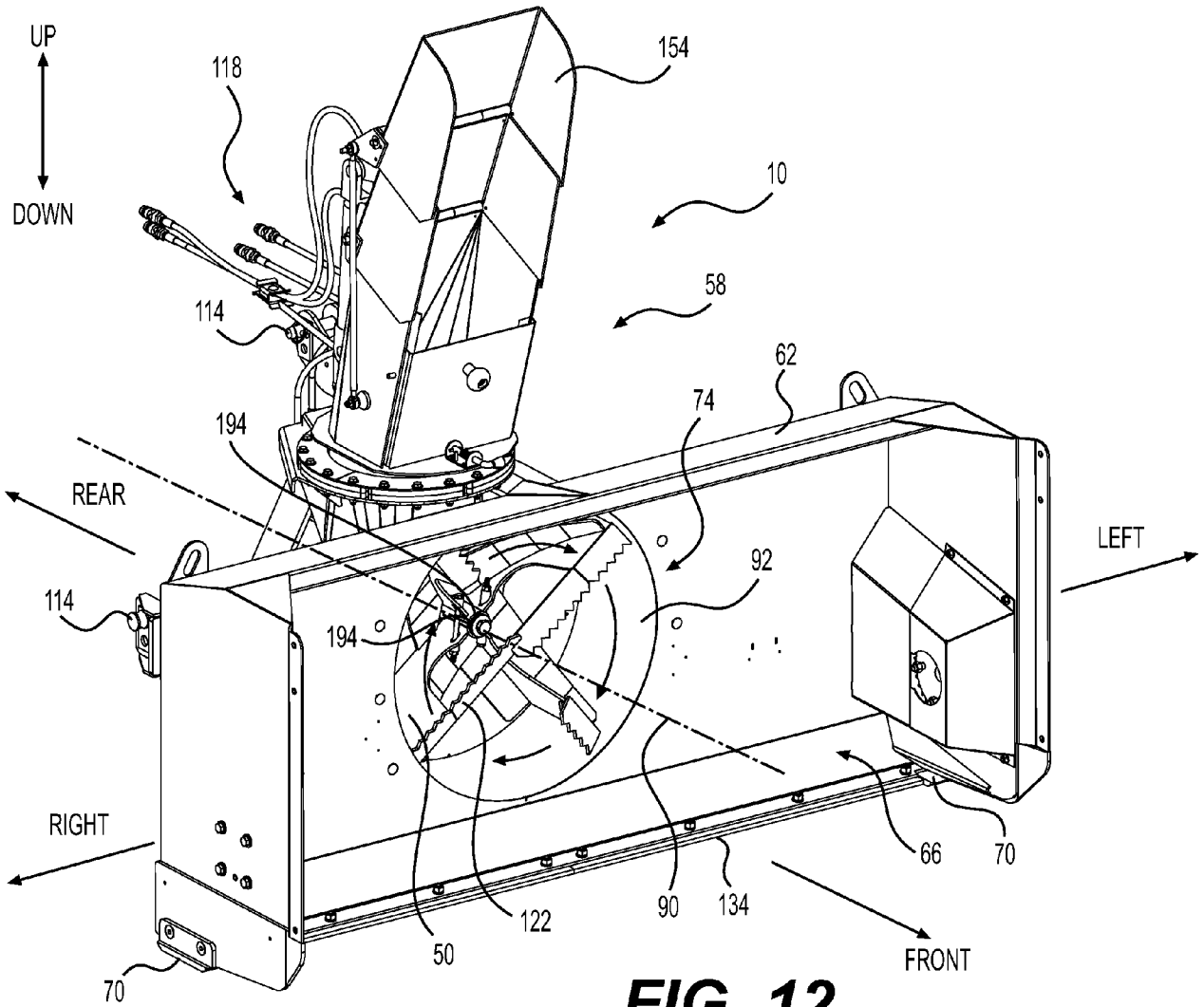
FIG. 12 is a perspective illustration of an exemplary snowblower, in accordance with at least one embodiment thereof.
Figure 13:
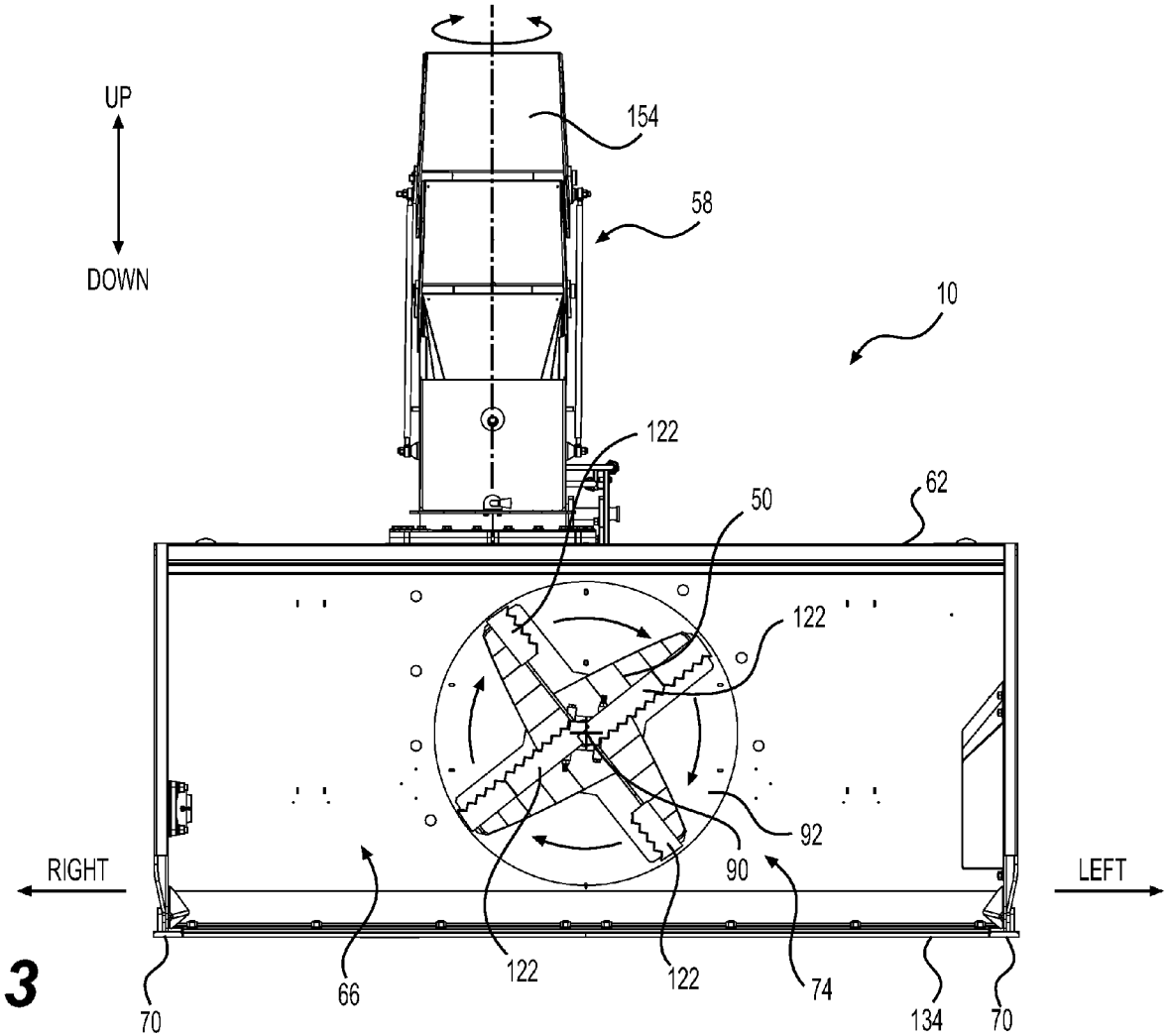
FIG. 13 is an illustration of the front elevational view of the impeller when assembled in the exemplary snowblower, in accordance with at least one embodiment thereof.

FIG. 11 illustrate a semi-exploded view of the snowblower 10 where the rotating axle 78 and the impeller 50 are disassembled from the body 62. FIG. 12 and FIG. 13 illustrate the snowblower without the rotating axis 78 and the restriction member 94 to appreciate the impeller 50 operatively assembled in the opening 92 of the body 62. FIG. 12 and FIG. 13 are depicting a snowblower without the screw-like tooth members 82 to better see the impeller 74.

Figure 14:
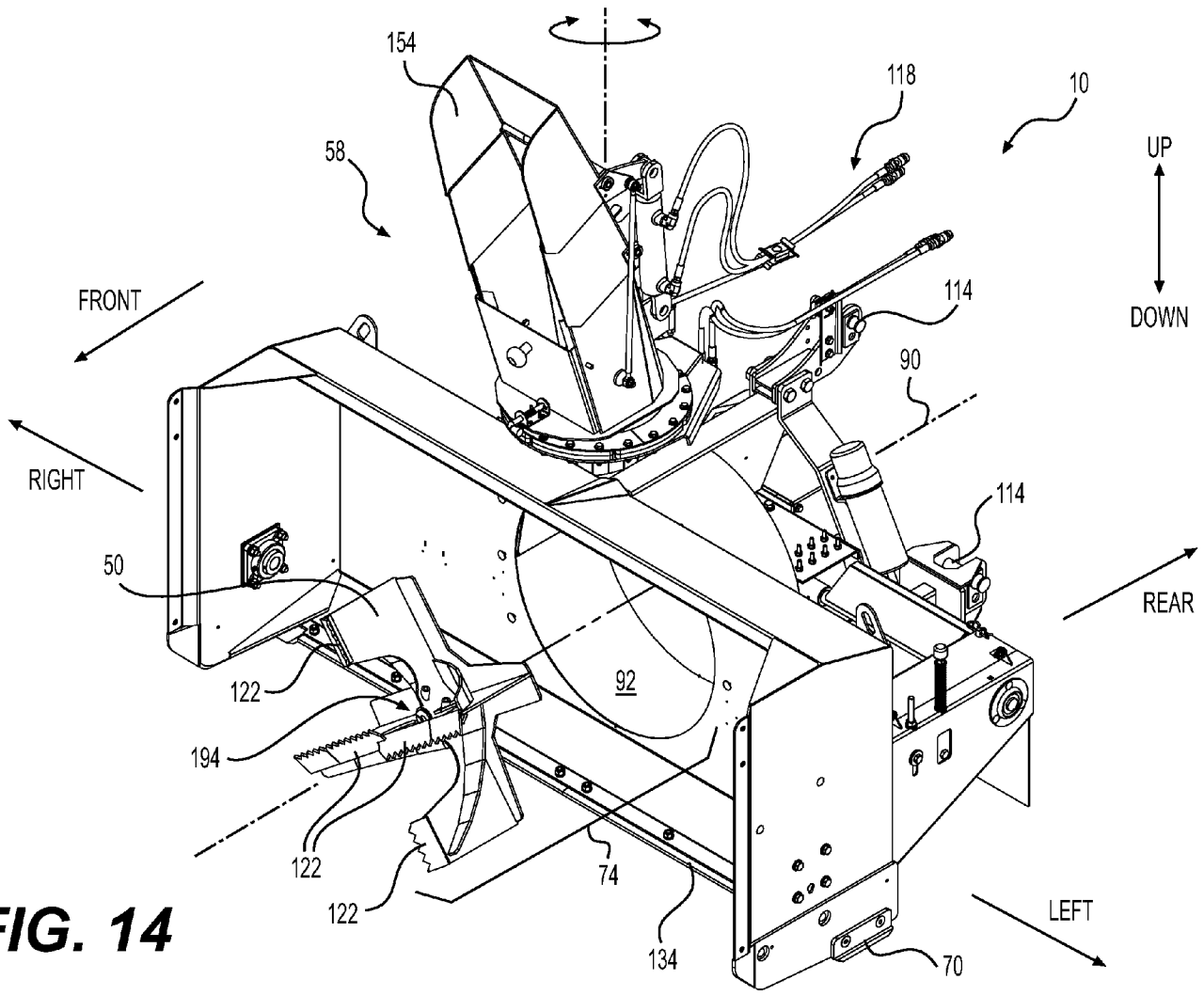
FIG. 14 is a semi-exploded perspective view of an exemplary snowblower assembly, in accordance with at least one embodiment thereof.
Figure 15:
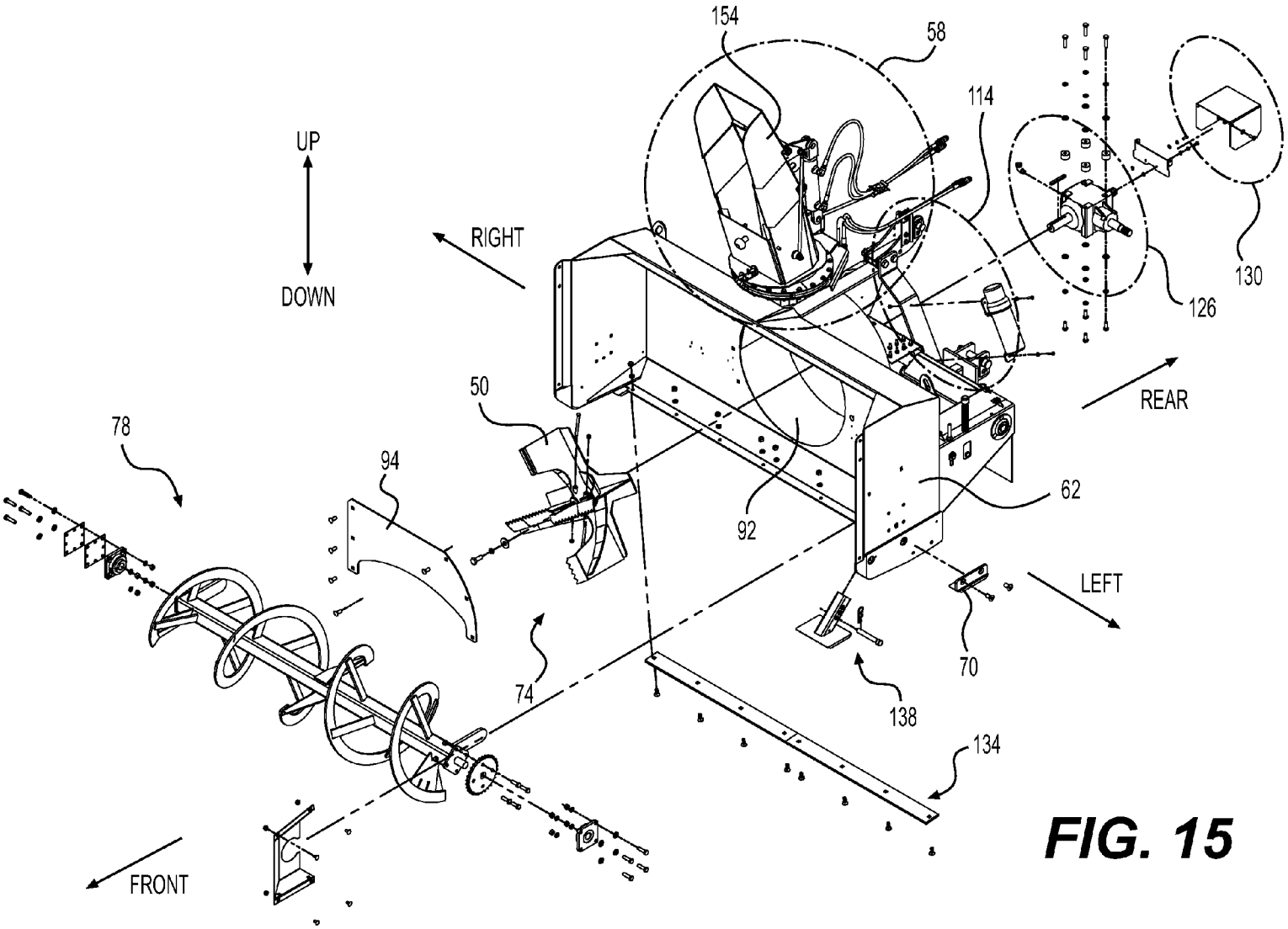
FIG. 15 is an exploded perspective view of an exemplary snowblower assembly, in accordance with at least one embodiment thereof.
Figure 16:
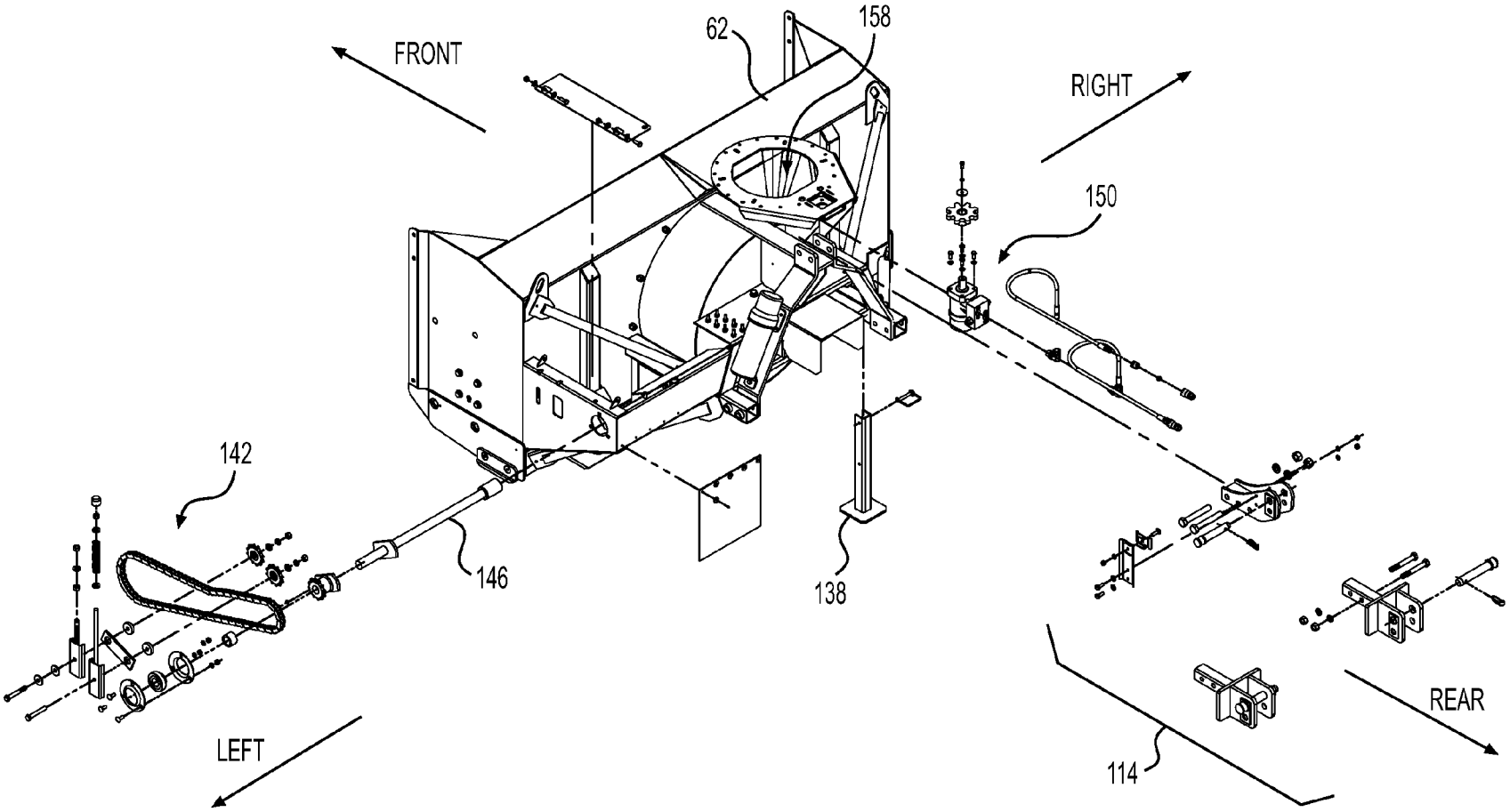
FIG. 16 is an exploded perspective view of an exemplary snowblower assembly, in accordance with at least one embodiment thereof.
Figure 17:
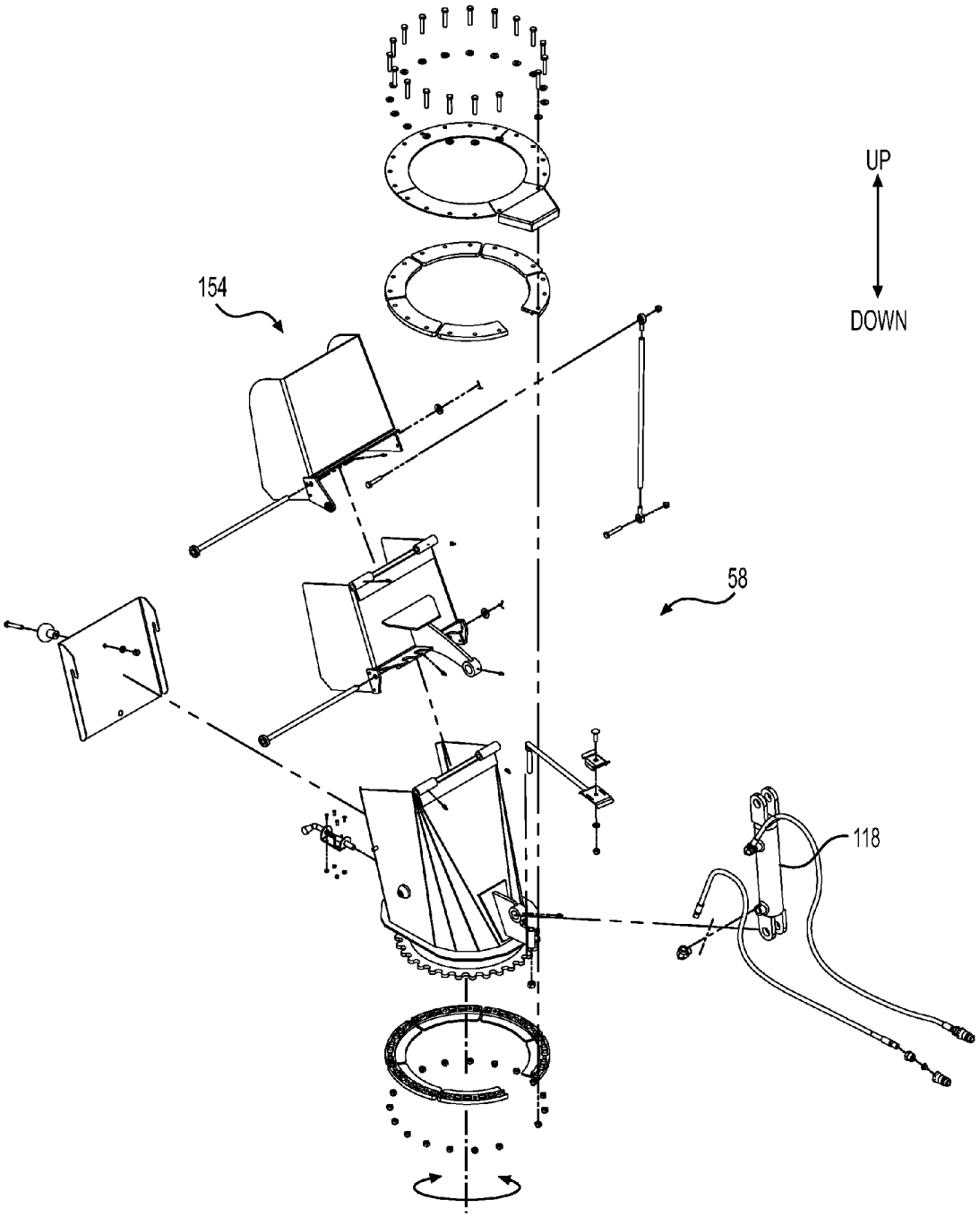
FIG. 17 is an exploded perspective view of an exemplary snowblower assembly, in accordance with at least one embodiment thereof.

FIG. 14 throughout FIG. 17 are illustrating various exploded views of the snowblower 10 for further understanding of the assembly. A gearbox 126 is secured to the body 62 to receive rotative motive power from the engine (tractor's PTO), protected with guard 130, and transmit power to the impeller 50 and the rotative axle 78 assembly. One can also appreciate the lower portion of the body 62 includes a blade 134 and optional supporting legs 138. A drive system 142 is used to transmit power to the rotating axle 78 via a drive axle 146. A hydraulic actuator 150 is also depicted in FIG. 16. The hydraulic actuator 150 is used to rotate a nozzle 154 of the snow-directing mechanism 58. An opening 158 in the body 62 is also illustrated in FIG. 16 to allow passage of the snow from the impeller 50 to the snow-directing mechanism 58.

Figure 18:
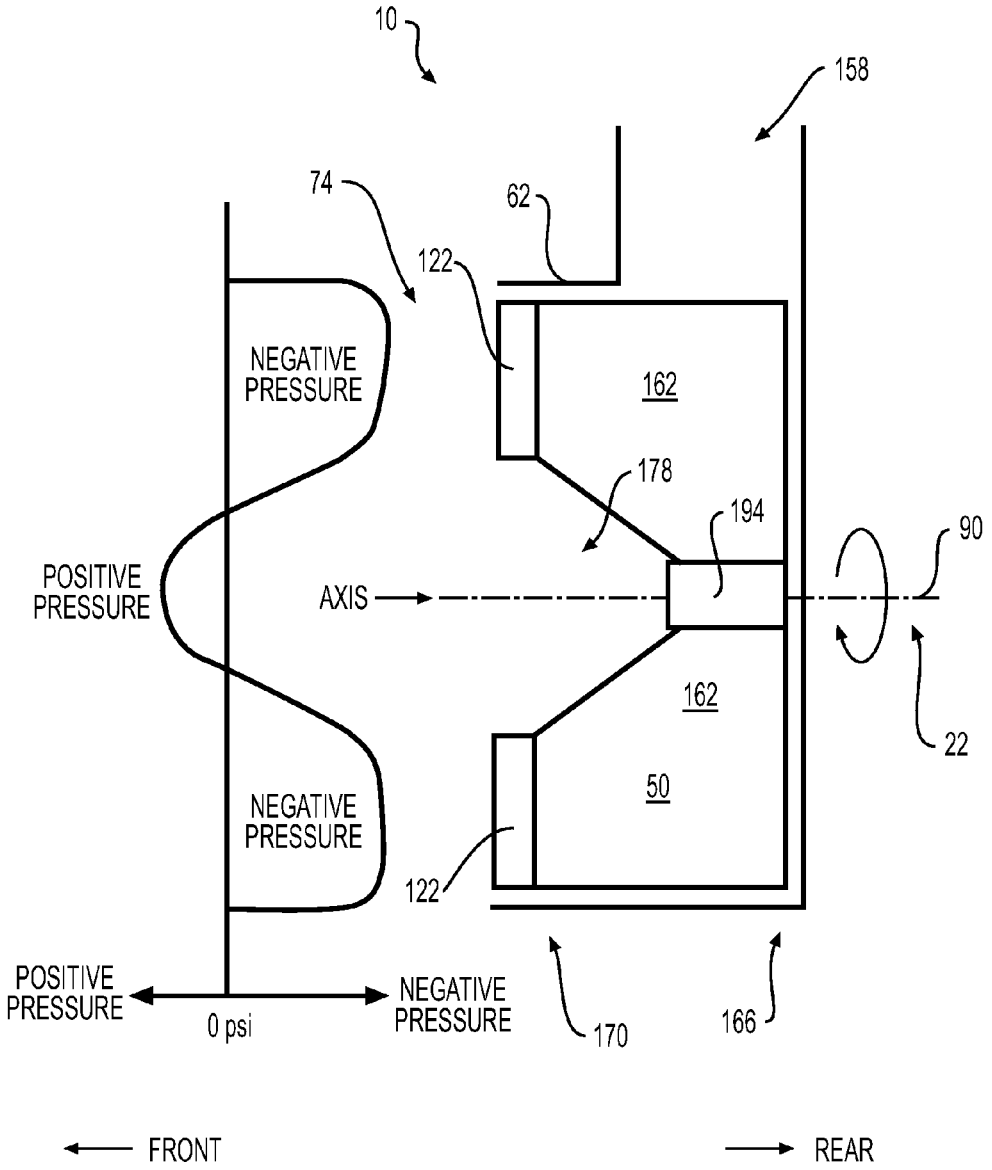
FIG. 18 PRIOR ART
FIG. 18 is a schematic profile illustration of the principles at work in the prior art to create a vacuum in a snowblower.
Figure 19:
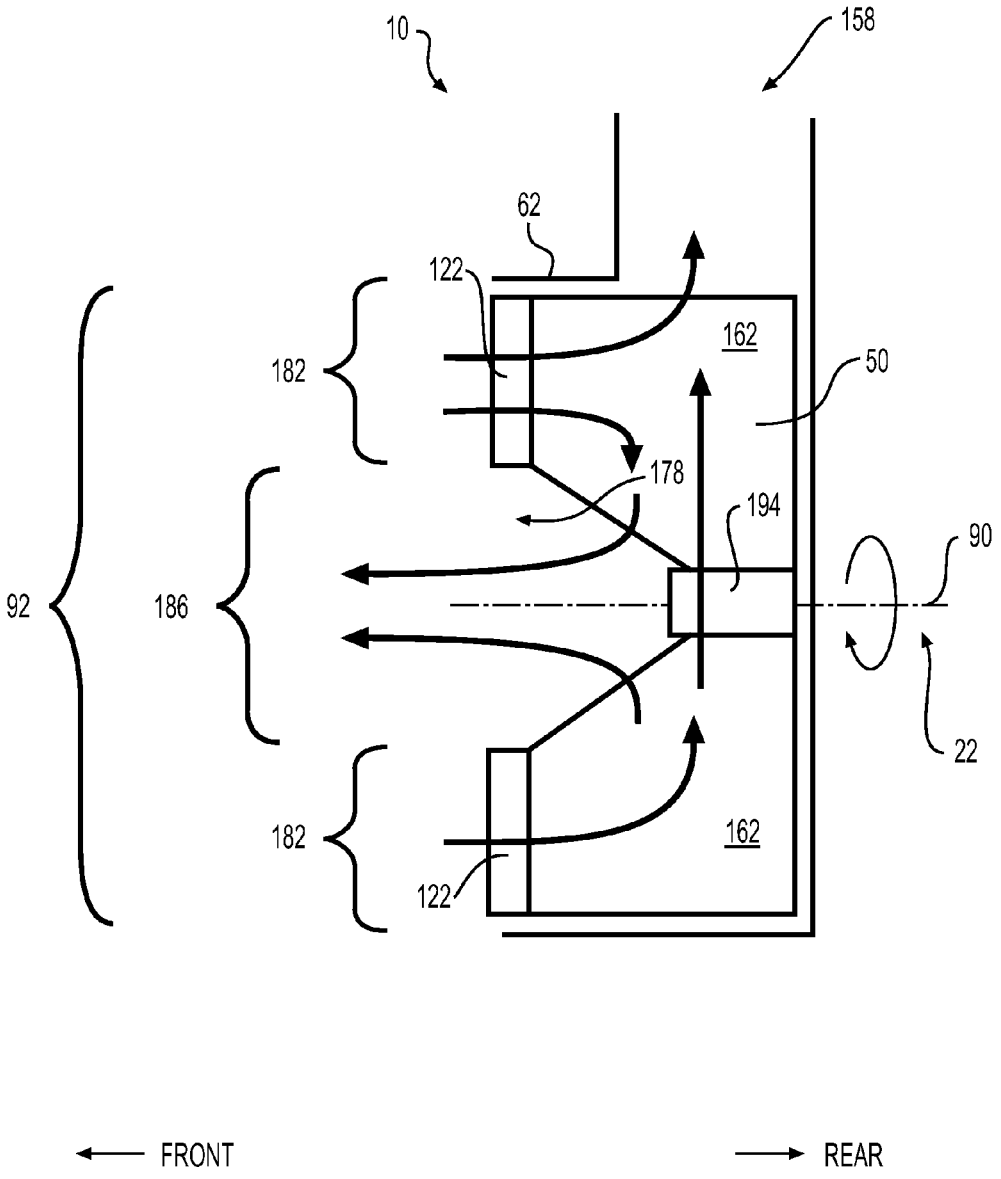
FIG. 19 PRIOR ART
FIG. 19 is a schematic profile illustration of the principles at work in the prior art to create a vacuum in a snowblower wherein the air-flow and the suction of snow within the snowblower are illustrated.

A side elevational schematic illustration of the exemplary vacuum generated by a prior art impeller 50 in a snowblower 10 is depicted in FIG. 18 and FIG. 19 for the benefit of the reader. The impeller 50 configuration includes a plurality of vanes 162 extending between a rear axial region 166 and a front axial region 170. Each vane includes a snow-engaging portion 122 toward the front axial region 170. The vanes 162 further include respective portions configured to propel snow 174 between the front axial region 166 and the rear axial region 170 that are rotating with a limited gap against the opening 92 of the body 62 to create a vacuum (negative pressure channeling air in the snowblower 10). Generally, the gap against the opening 92 of the body 62 is less than 24 mm. The portions of the impeller 50 that are configured to propel snow 174 are defining an impeller's eye 178 located in the center of the impeller 50 about the rotation axis 90 of the impeller 50. The impeller's eye 178 is void of portions of the vanes 162 that are configured to propel snow 174 and thus offer little pumping effect while having no means for preventing a loss of vacuum generated by the portions of the impeller configured to propel snow 174 and snow-engaging portions 122 thereof. The resulting effect in the flow through the snowblower 10 is exemplified with arrows, in FIG. 19, where peripheral portion 182 of the impeller 50 are creating vacuum in the snowblower 50 while the central portion 186 of the impeller's eye 178 is not producing enough restriction or vacuum to prevent a loss of pressure.

Figure 20:
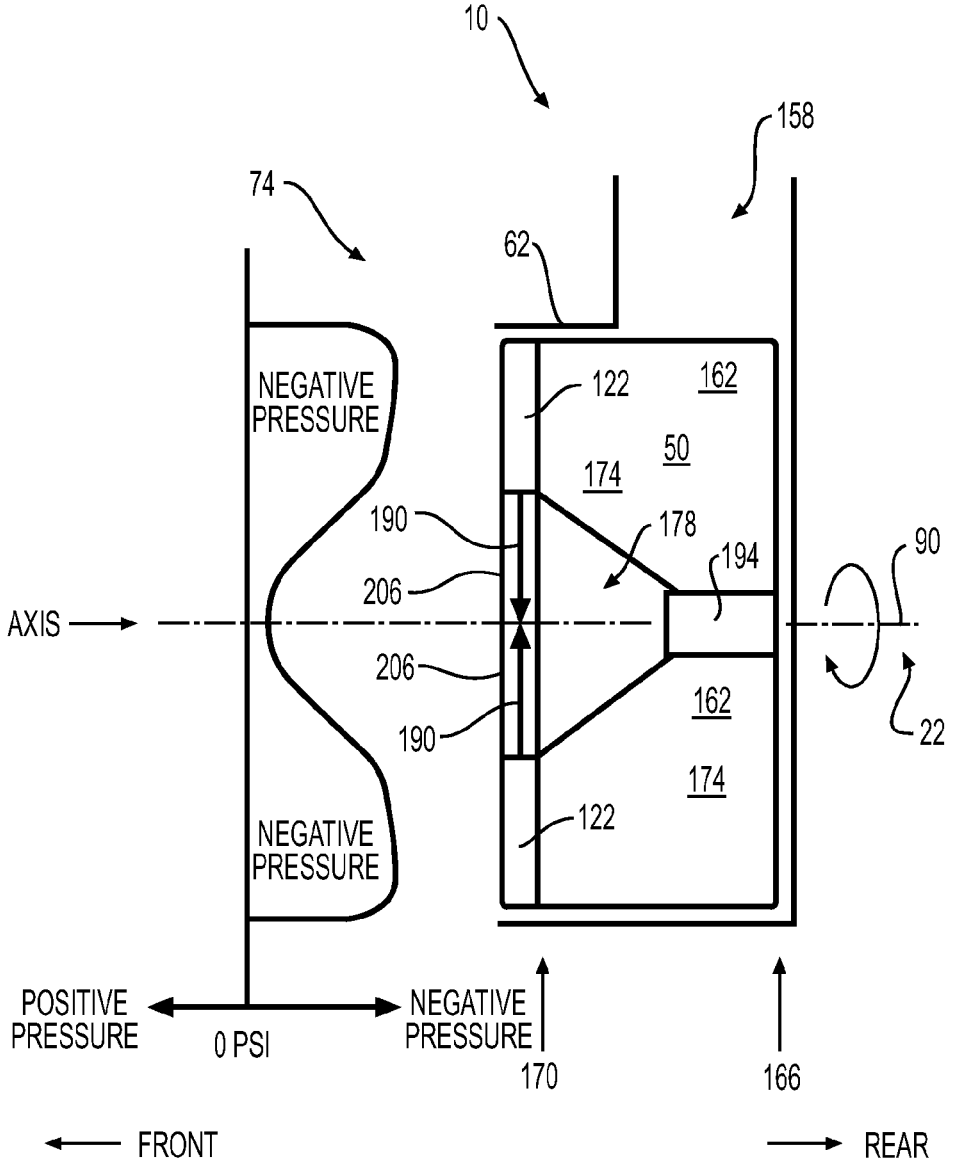
FIG. 20 is a schematic profile illustration of the principles at work to create a vacuum in a snowblower, in accordance with at least one embodiment thereof.
Figure 21:
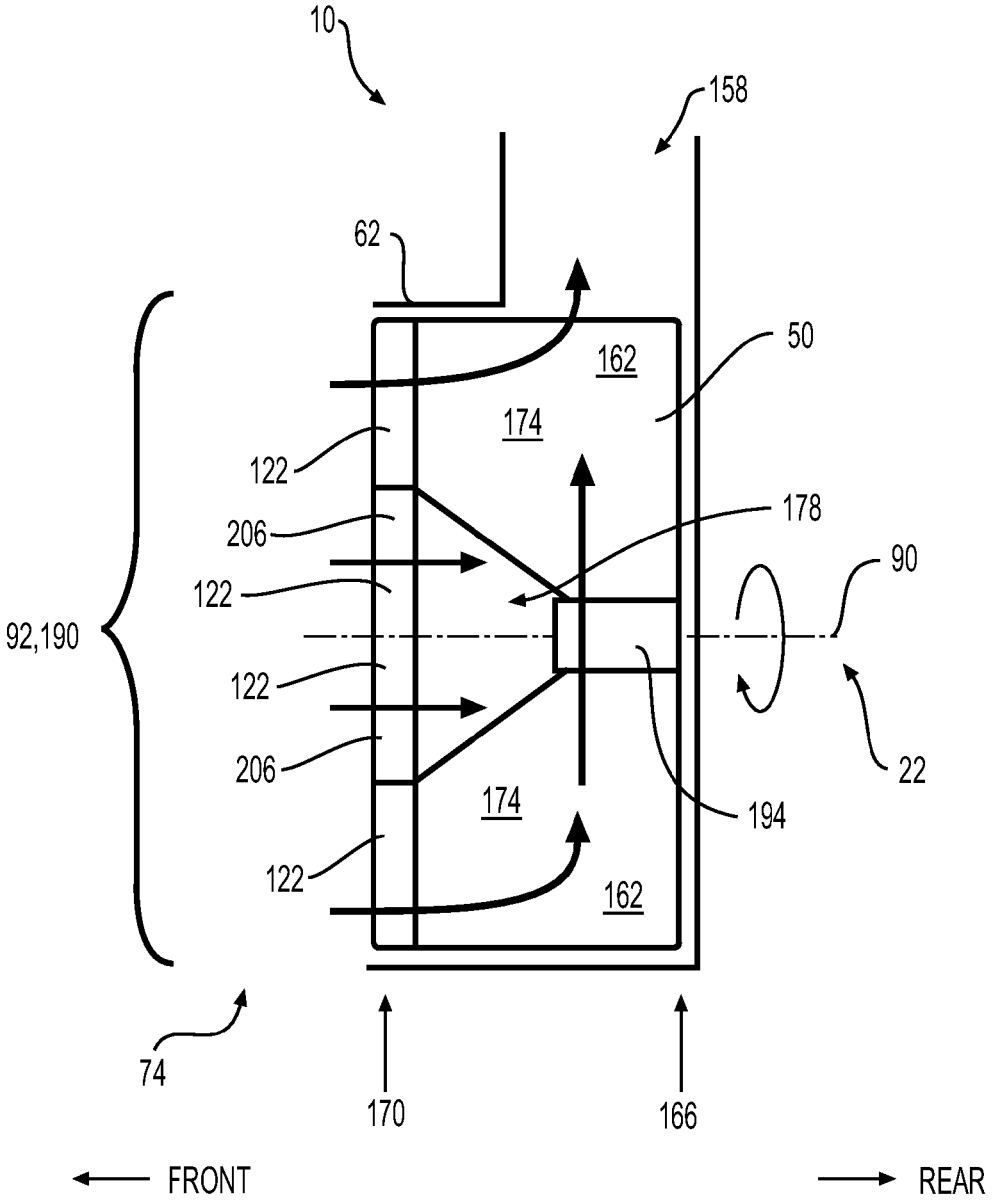
FIG. 21 is a schematic profile illustration of the principles at work to create a vacuum in a snowblower wherein the air-flow and the suction of snow within the snowblower are illustrated, in accordance with at least one of the embodiment thereof.

In contrast, the embodiments illustrated in FIG. 20 and FIG. 21 are improving the vacuum created by the rotation of the impeller 50 by restricting the impeller's eye 178 with snow-engaging portions 122 that are elongated 190 toward the axis of rotation 90. The snow-engaging portions 122 can be extended and formed in the vane 162; however, the snow-engaging portions 122 can alternatively be extended and formed of an additional and distinct part assembled to the vane 162 with fasteners, welding or other means. The snow-engaging portions 122 can be extended and the extended portion of the snow-engaging portion 122 can be made of a distinct part than the snow-engaging portion 122 abutted to the vane 162. These parts can be secured together with fasteners or welded or secured in a different fashion. The impeller 50 and its constituting parts are made of strong materials capable of withstanding significant mechanical stresses. Steel, aluminum, casting materials, powder materials and reinforced plastics are contemplated by the present invention and are not intended to limit materials applicable to the present invention that could become obvious for a skilled reader. The assembly of the snowblower 10 and the parts therein is using fasteners, rivets and welding where needed.

A single snow-engaging portion 122 can be elongated. Preferably, at least a pair of snow-engaging portions 122 is elongated for balancing the rotating impeller 50 and for added strength. When a plurality of snow-engaging portions 122 is sufficiently elongated to reach each other, they are interconnected to ensure a strong mechanical assembly. The impeller's eye 178 is a region of the impeller that is void of vanes 162 and that offers little pumping effect but, in the configuration depicted in FIG. 20 and FIG. 21, the extended snow-engaging portions 122 offer additional pumping effect and create restriction to prevent a loss of vacuum generated by the portions of the impeller with portions configured to propel snow 174 and snow-engaging portions 122. The resulting effect in the flow of air is exemplified with arrows in FIG. 21 where the entire section 190 of the impeller 50 is vacuuming in the snowblower 50. Additional embodiments are presented in FIG. 22 throughout FIG. 27 with the addition of the restriction member 94 to the assembly.

It has to be noted that the radial length of the snow-engaging portions embodied in the present application can extend a little toward the axis of rotation 22 of the impeller 50 up to a complete extension over the center of rotation 22. As it will be explained below, the complete extension across the snow-blowing mechanism 74 opening 92 might be desirable under certain circumstances. However, because the snow-blowing mechanism 74 is blowing air, water, snow of various densities, dirt and debris, an intermediate radial length of the snow-engaging portions 122, between the vanes 162 and the axis of rotation 22, is likely desirable despite longer or shorter snow-engaging portions 122 might be desirable for specific usage conditions. Completely extending the opening 94 of the snow blowing mechanism 74 appears not to be the optimal configuration for snow because it prevents chunks of snow to be introduced through the impeller's eye 178. The snow must be progressively cut by the rotating snow-engaging portions 122 instead of simply being directly introduced in the impeller's eye 178.

Figure 22:
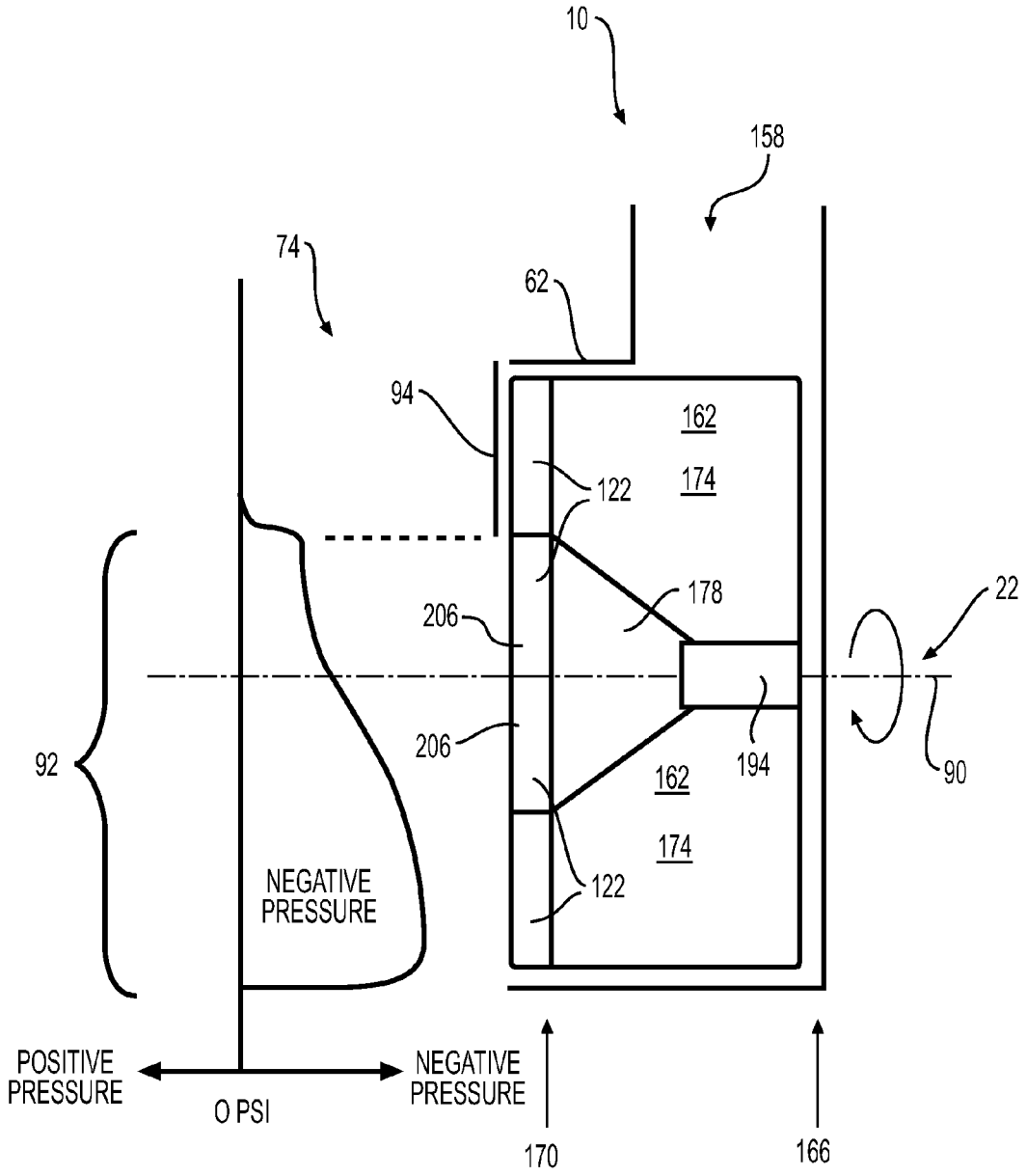
FIG. 22 is a schematic profile illustration of the principles at work to create a vacuum in a snowblower wherein a restriction member is added, in accordance with at least one of the embodiment thereof.
Figure 23:
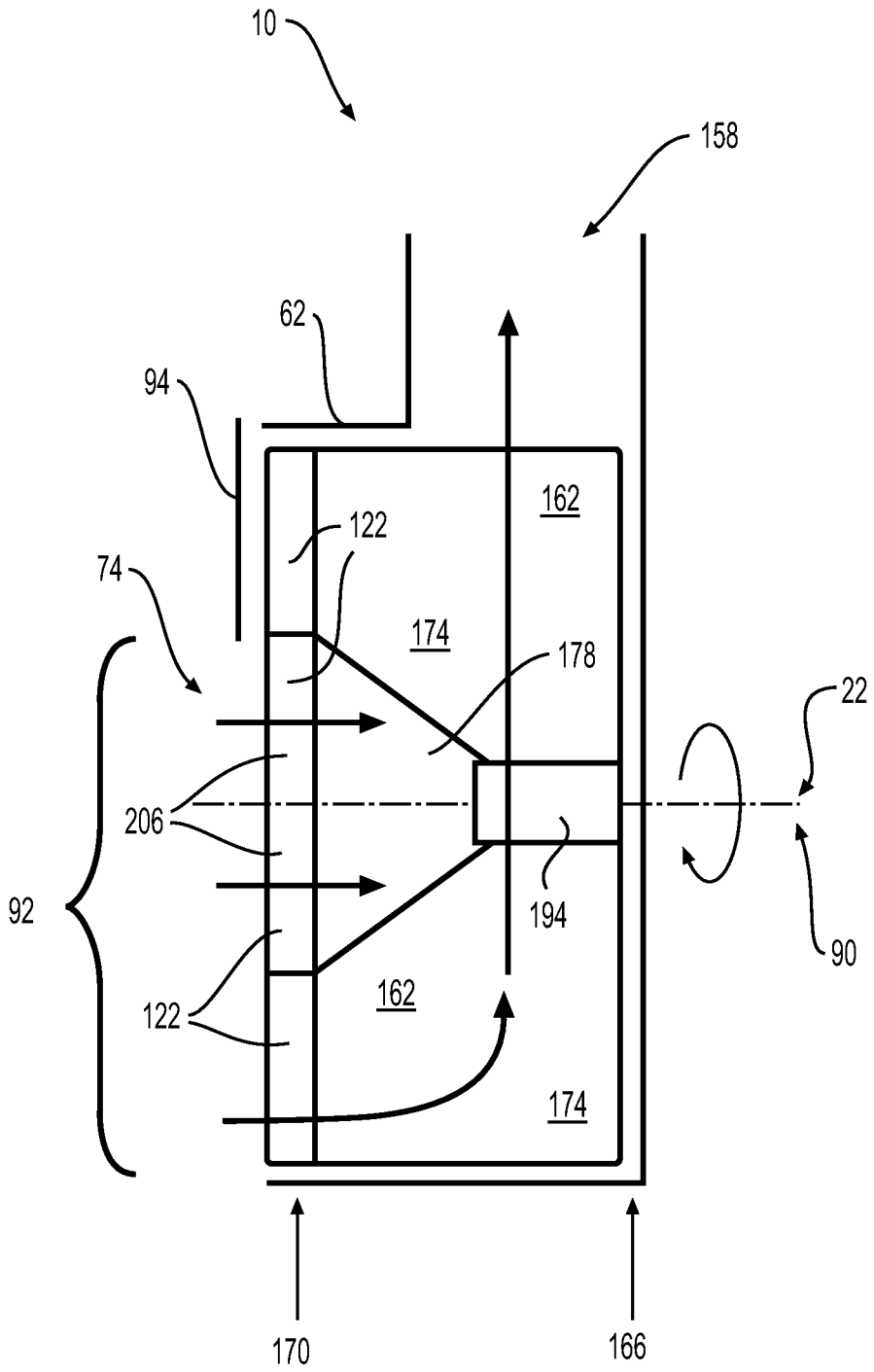
FIG. 23 is a schematic profile illustration of the principles at work to create a vacuum in a snowblower wherein a restriction member is added, in accordance with at least one of the embodiment thereof.
Figure 24:
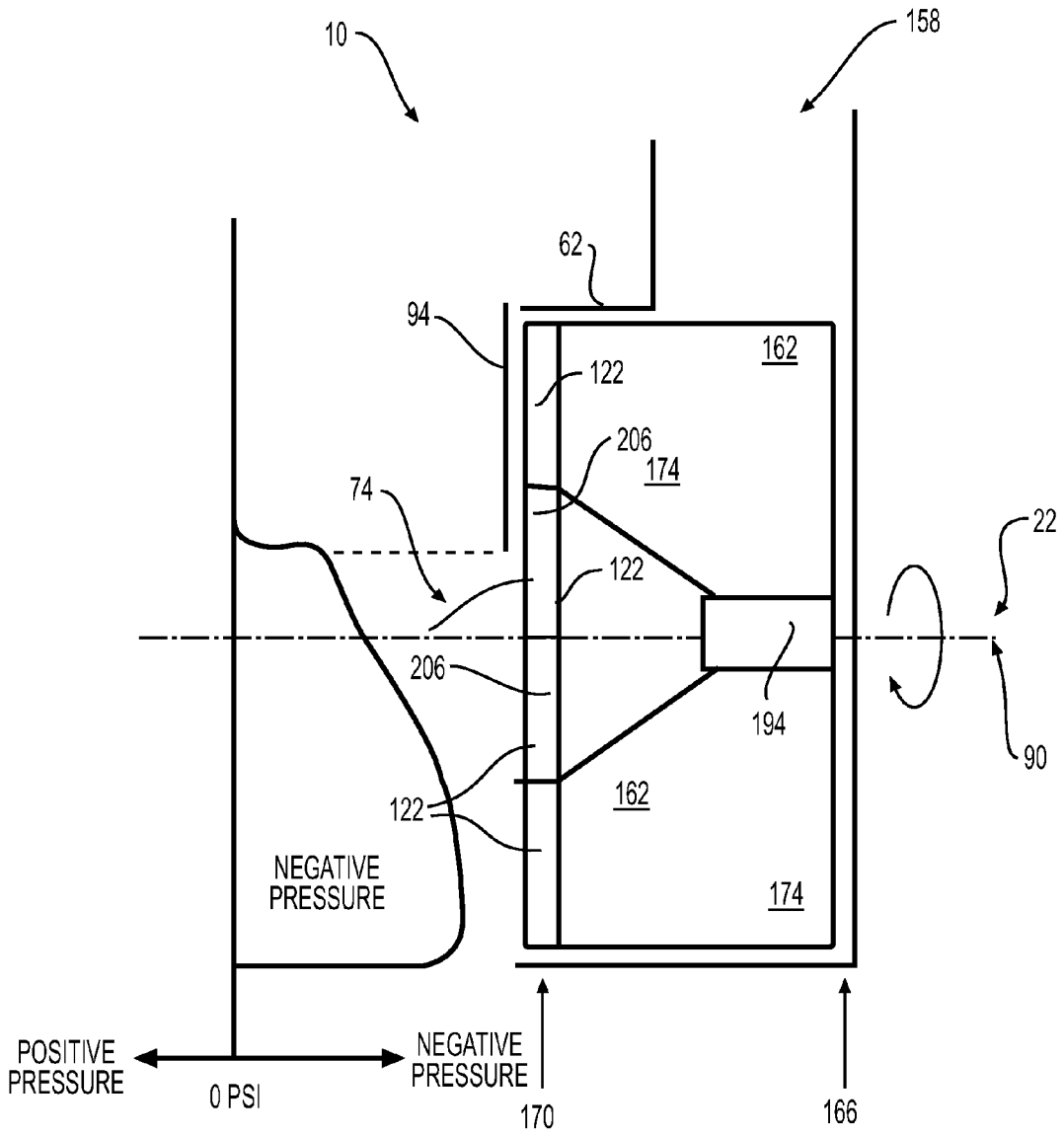
FIG. 24 is a schematic profile illustration of the principles at work to create a vacuum in a snowblower wherein a restriction member extending beyond the length of the snow-engaging portions is added, in accordance with at least one of the embodiment thereof.
Figure 25:
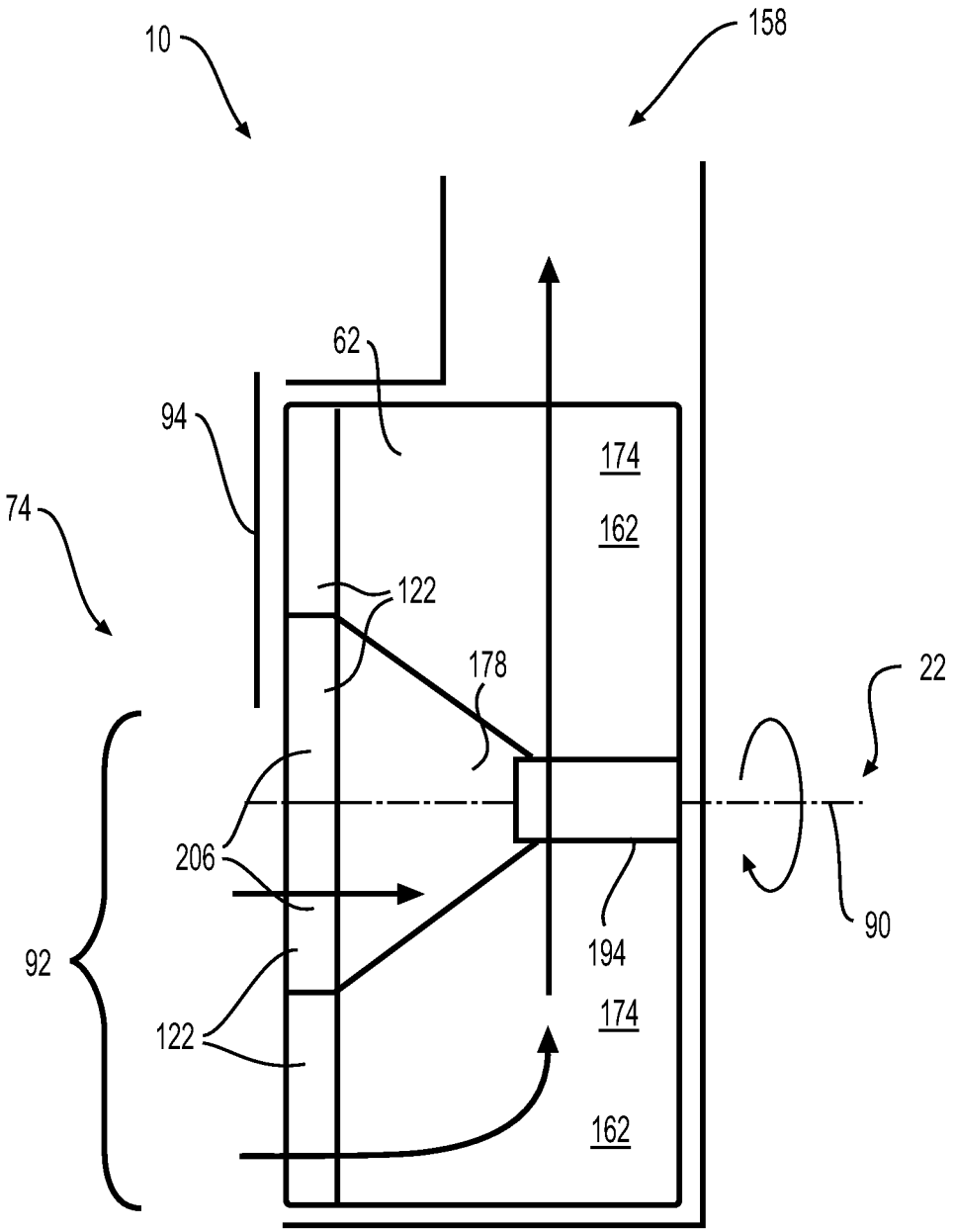
FIG. 25 is a schematic profile illustration of the principles at work to create a vacuum in a snowblower wherein a restriction member extending beyond the length of the snow-engaging portions is added and wherein the air-flow and the suction of snow within the snowblower are illustrated, in accordance with at least one of the embodiment thereof.
Figure 26:
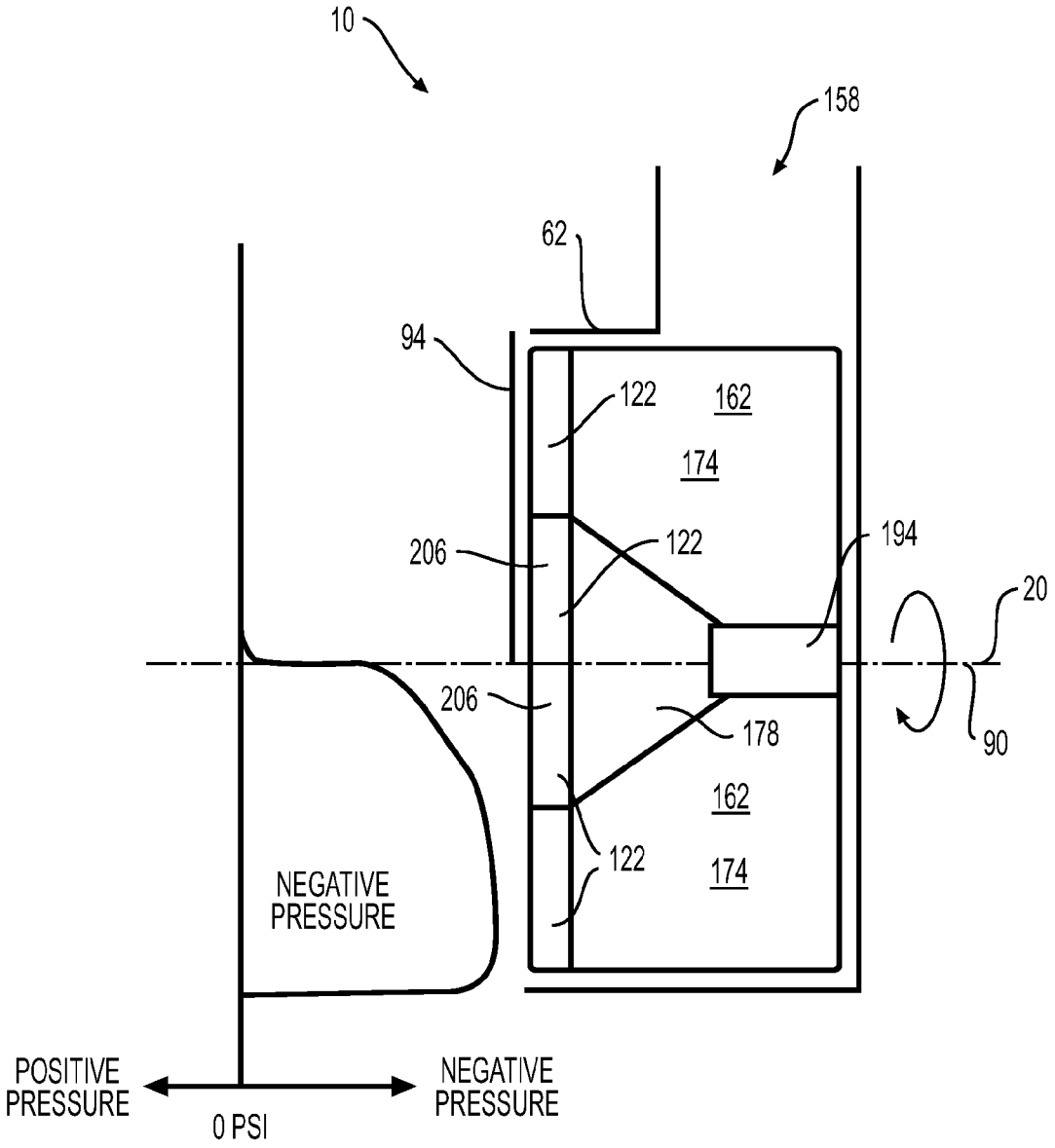
FIG. 26 is a schematic profile illustration of the principles at work to create a vacuum in a snowblower wherein a restriction member extending to the axis of rotation is added, in accordance with at least one of the embodiment thereof.
Figure 27:
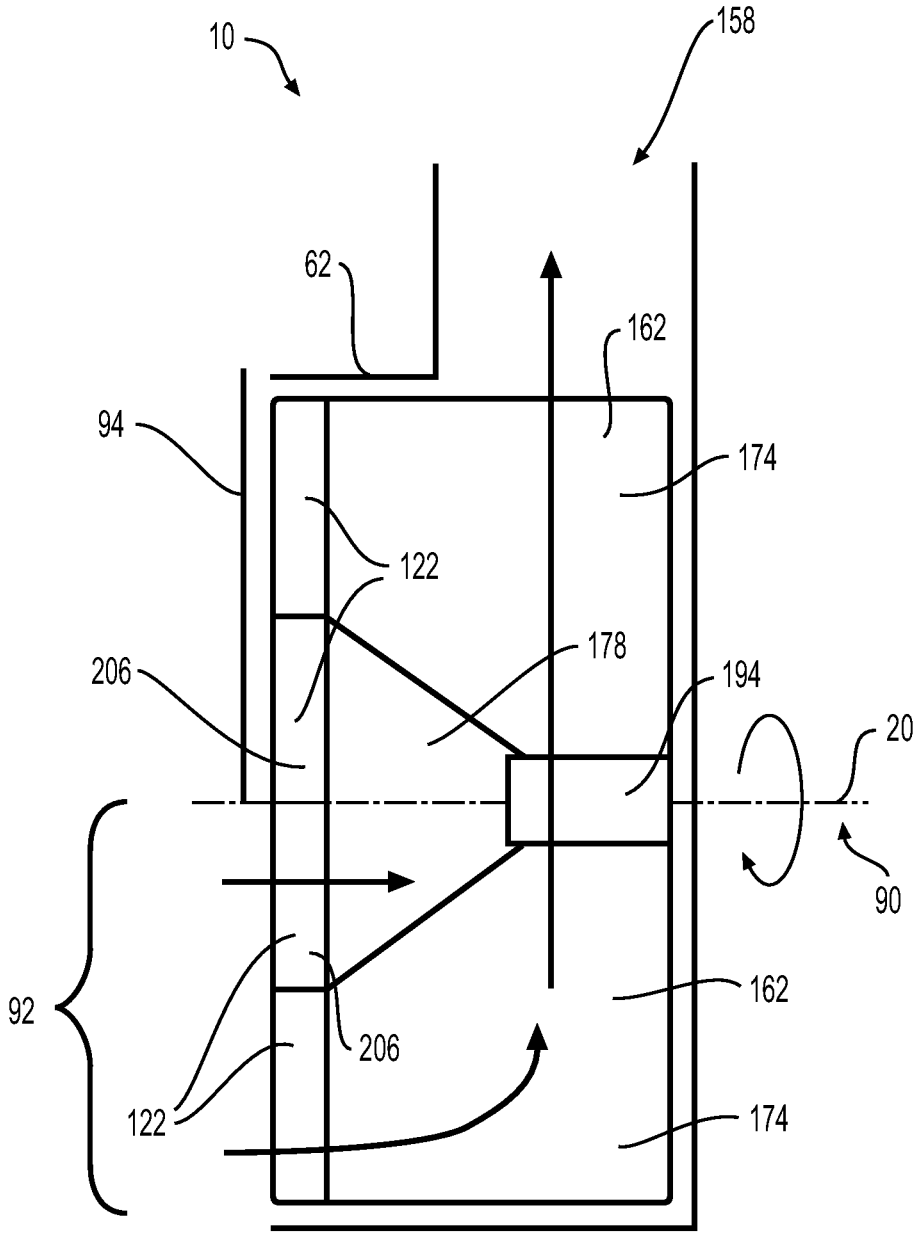
FIG. 27 is a schematic profile illustration of the principles at work to create a vacuum in a snowblower wherein a restriction member extending to the axis of rotation is added and wherein the air-flow and the suction of snow within the snowblower are illustrated, in accordance with at least one of the embodiment thereof.

In the embodiments illustrated in FIG. 22 Throughout FIG. 27, the restriction member 94 is restricting the opening 92 of the snow-blowing mechanism 74 to reduce portions of the opening 92 that are less efficient for collecting snow. FIG. 22 throughout FIG. 23 illustrate an embodiment where the restriction member 94 extends to a length substantially equal to the length of the snow-engaging portion 122 in front of the portion to propel snow 174 of the vanes 162. FIG. 24 throughout FIG. 25 illustrate an embodiment where the restriction member 94 extends further to a length extending beyond the length of snow-engaging portions 122, extending over the impeller's eye 178 in front of the hub 194. Lastly, FIG. 26 and FIG. 27 illustrate an embodiment where the restriction member 94 extends to a length extending to the axis of rotation 90, thus extending over about half of the impeller's eye 178, in front of the hub 194. One can appreciate form these Figures that the loss of vacuum is reduced with the reduction of the opening 92 and that the interaction between the snow-engaging portions 122 with the restriction member 94 are adding to the vacuum power of the snow-blowing mechanism 74.

A plurality of embodiments is used below to show different configurations and arrangements thereof. These embodiments are not intended to be limited to the elements and configurations distinctly illustrated therein. The present application is encompassing combinations of features, elements, angles and functions thereof, and are contemplating possible combinations of features, elements, angles and functions from the point of view of a skilled reader in the are of snowblower design.

Figure 28:
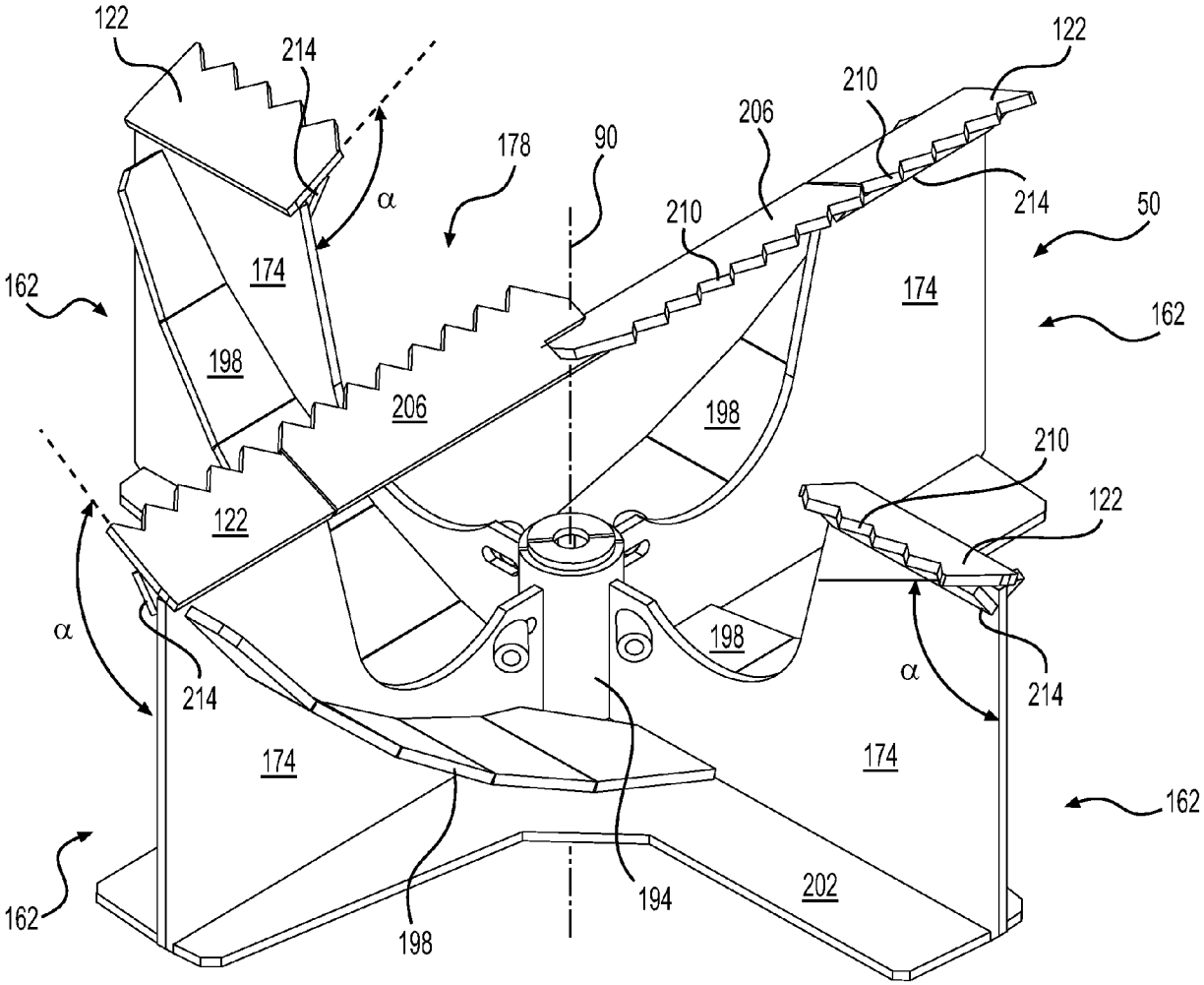
FIG. 28 is a top perspective illustration of a possible embodiment of the impeller, in accordance with at least one of the embodiment thereof; an illustration of the perspective view of a possible embodiment of the impeller in the exemplary snowblower.
Figure 29:
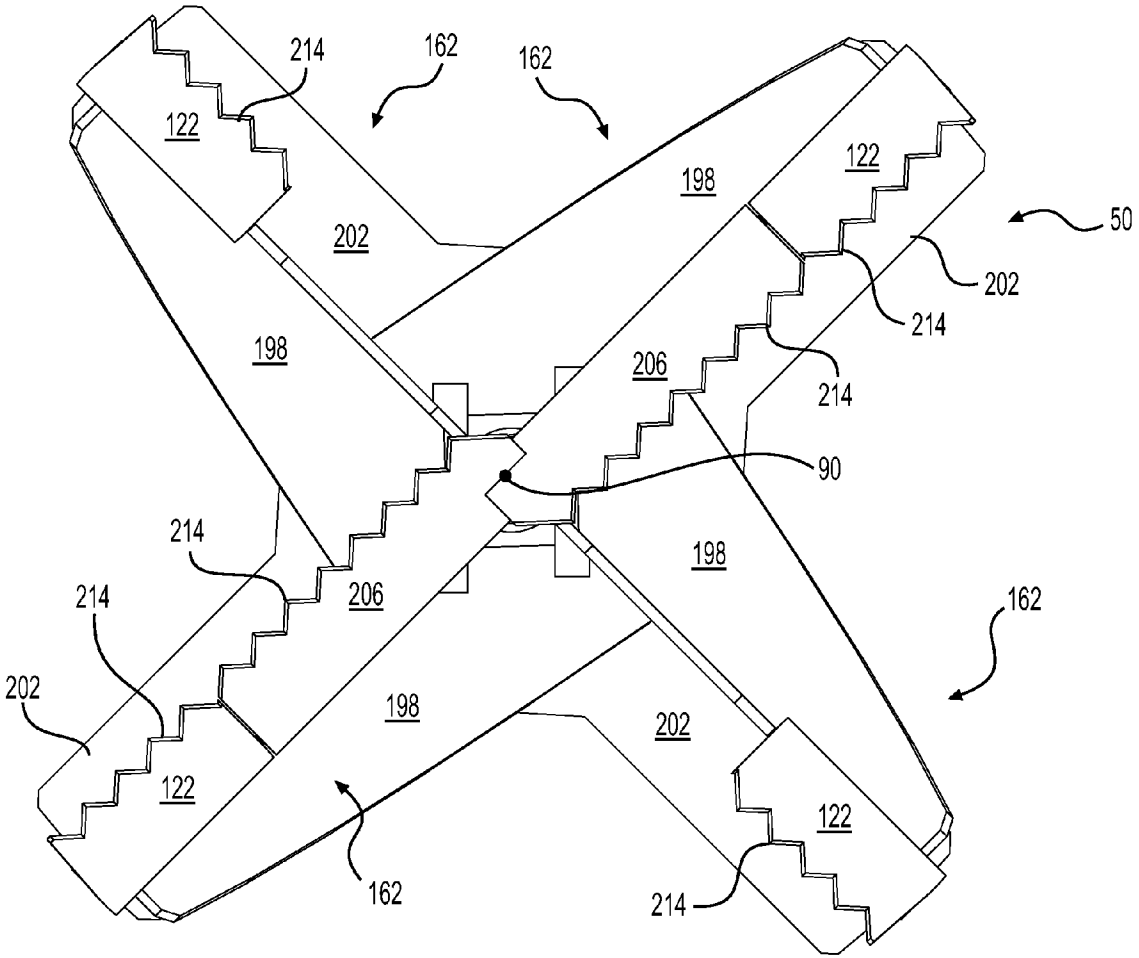
FIG. 29 is an elevational illustration of a possible embodiment of the impeller, in accordance with at least one of the embodiment thereof; is an illustration of the elevation view of a possible embodiment of the impeller in the exemplary snowblower.
Figure 30:
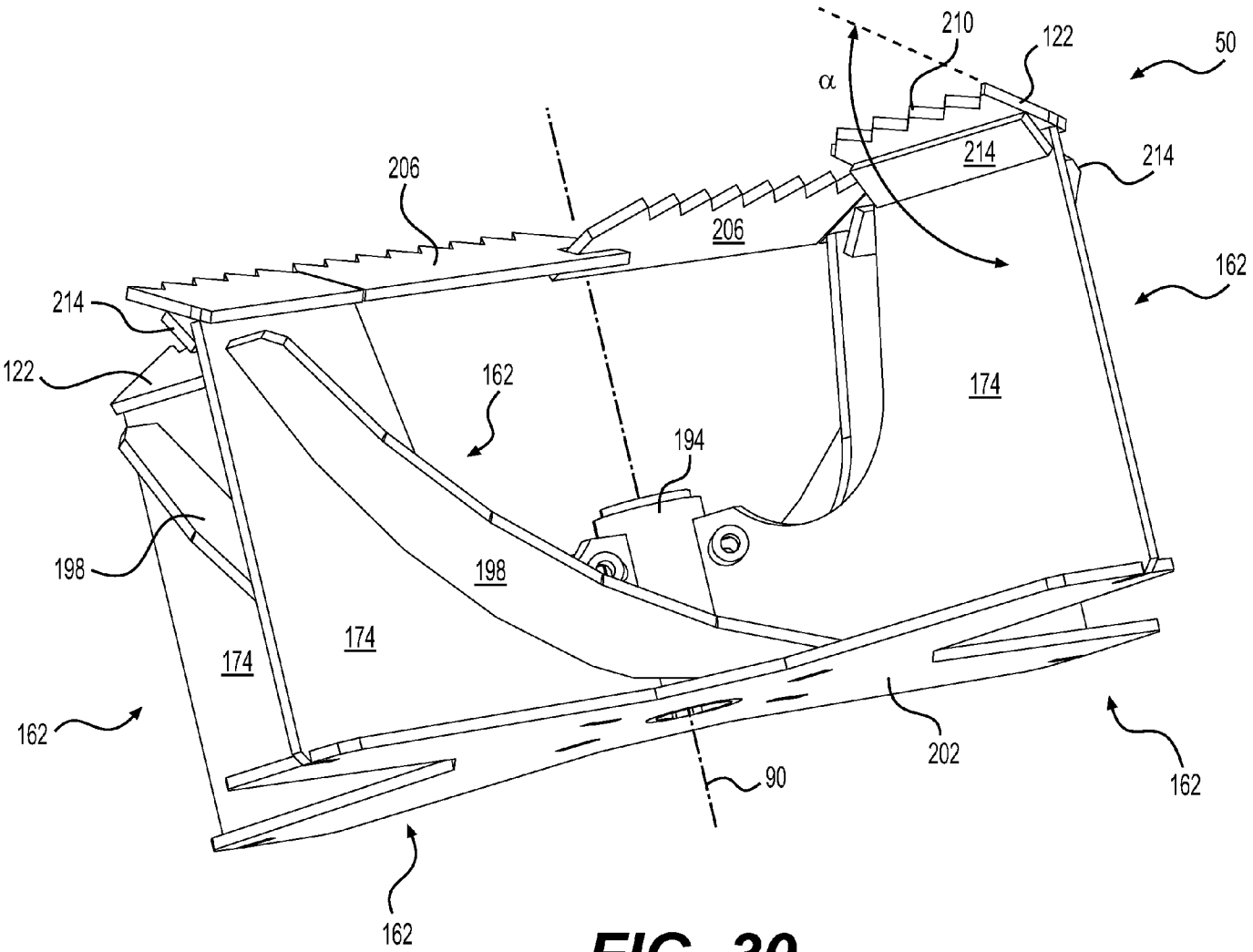
FIG. 30 is a side-bottom perspective illustration of a possible embodiment of the impeller, in accordance with at least one of the embodiment thereof; is an illustration of the perspective view of a possible embodiment of the impeller in the exemplary snowblower.

An embodiment of a possible configuration of the impeller 50, with extended snow-engaging portions 122, is exemplified in FIG. 28 throughout FIG. 30. The impeller 50 includes a hub 194 from which a plurality of vanes 162 is radially extending. Each vane 162 of this embodiment includes a portion to propel snow 174 preferably facing the direction of rotation of the impeller 50 to propel snow. The portion to propel snow is reinforced with a reinforcement member 198. The portion to propel snow is secured on the rear axial region 166 to a back plate 202 substantially normal to the axis of rotation 90. The extensions 206 of the snow-engaging portions 122 are illustrated as distinct parts assembled to the snow-engaging portions 122 secured to the vanes 162. It can be appreciated that the snow-engaging portions 122 and extensions 206 thereof are angled forward with, for instance, angle $\alpha$. The angle $\alpha$ is about between 95° and 150° to attack the snow and to increase the vacuum effect of the impeller 50. Preferably, the angle $\alpha$ is about between 95° and 120° to efficiently attack the snow and to increase the vacuum effect of the impeller 50. More preferably, the angle $\alpha$ is about between 95° and 115° to more efficiently attack the snow and to increase the vacuum effect of the impeller 50 while preventing requiring significant power to aggressively collect snow. More details about the angles $\alpha$ is going to be illustrated with more details below. Each snow-engaging portion 122 is provided with a series of teeth 210 and reinforcement 214. The extensions 206 are also provided with teeth 210 thereon and are reaching each other near the axis of rotation 90. The opposed angled extensions 206 are secured at their meeting point to increase the strength of the assembly.

Figure 31:
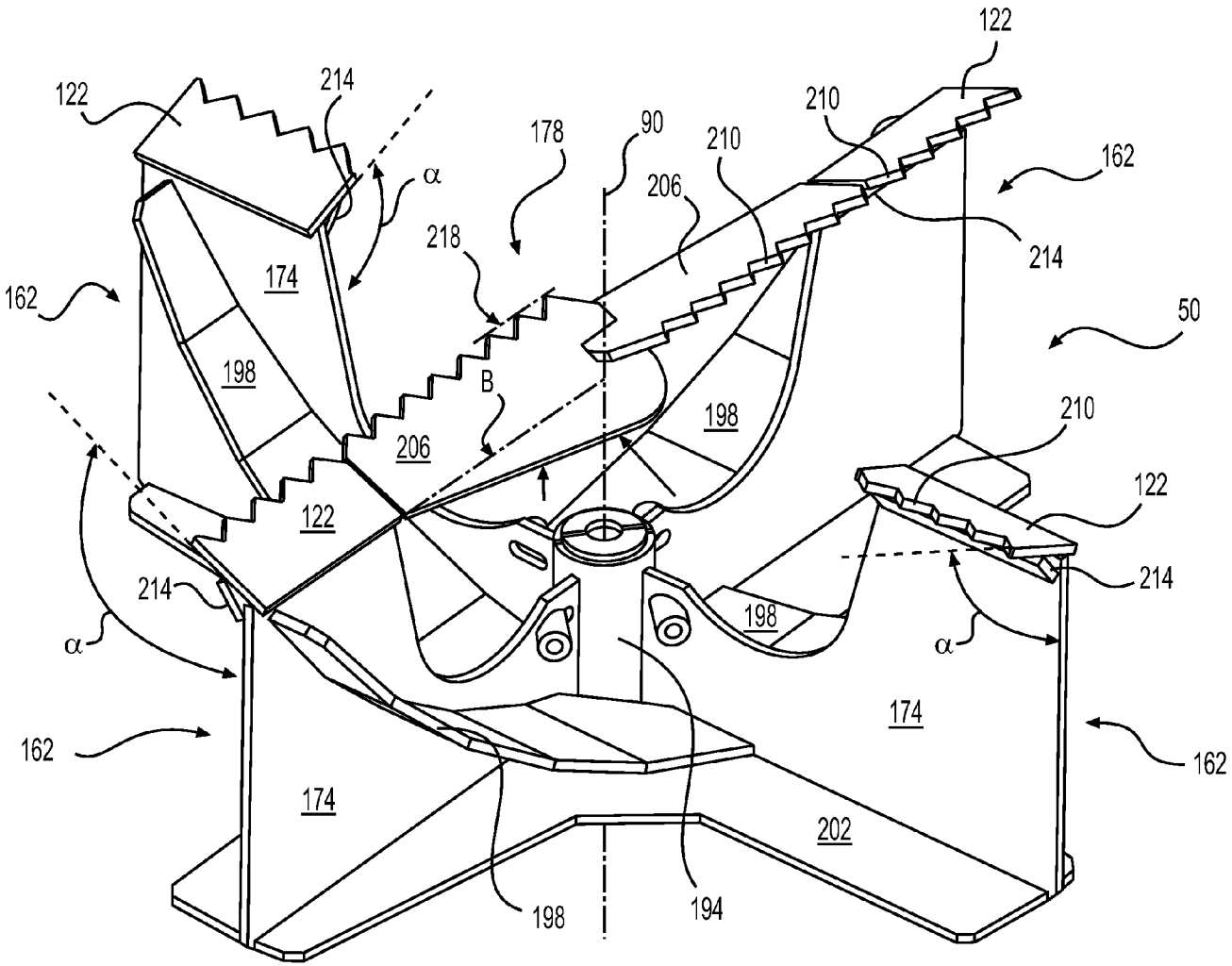
FIG. 31 is a top perspective illustration of a possible embodiment of the impeller, in accordance with at least one of the embodiment thereof.
Figure 32:
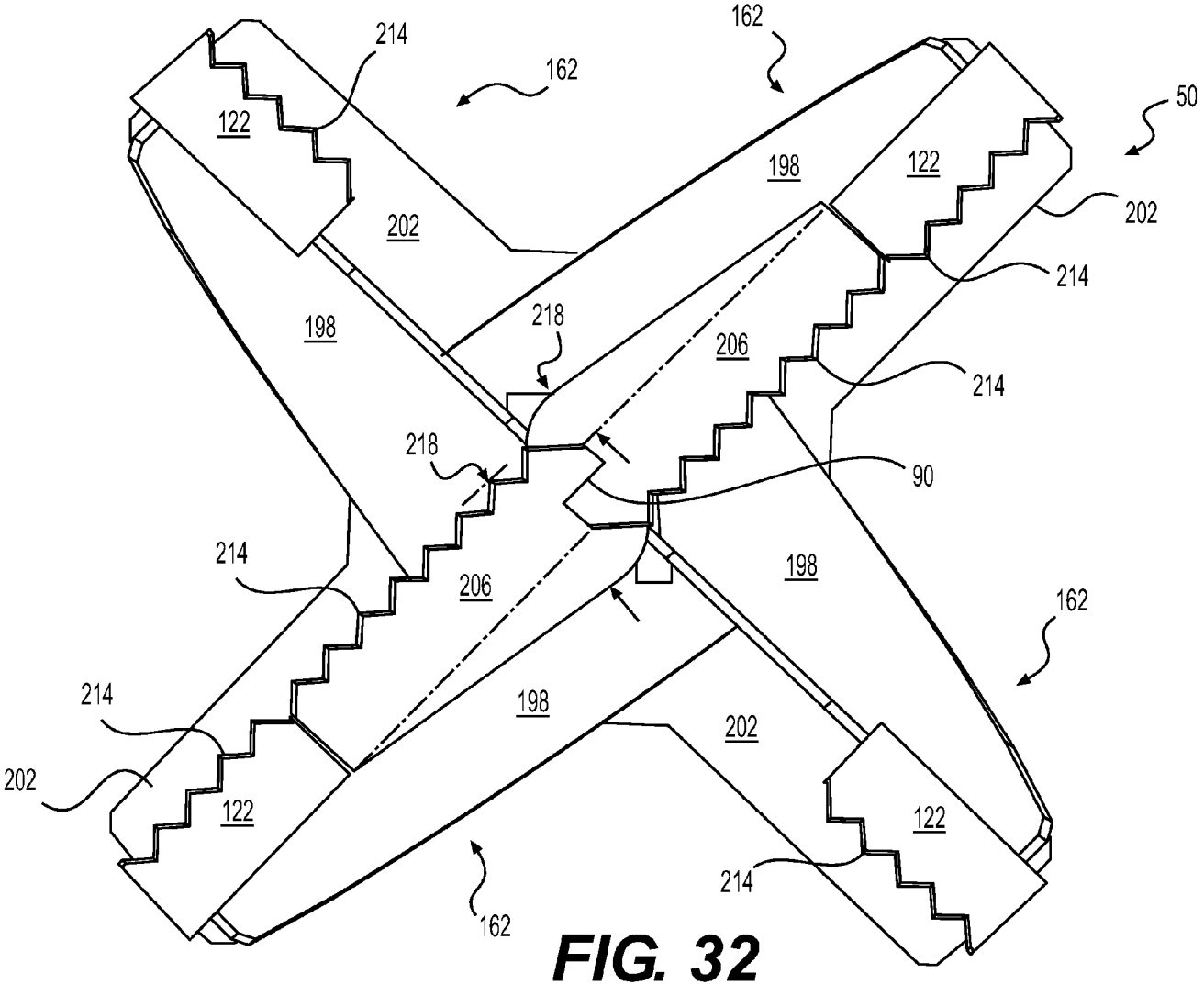
FIG. 32 is an elevational illustration of a possible embodiment of the impeller, in accordance with at least one of the embodiment thereof.
Figure 33:
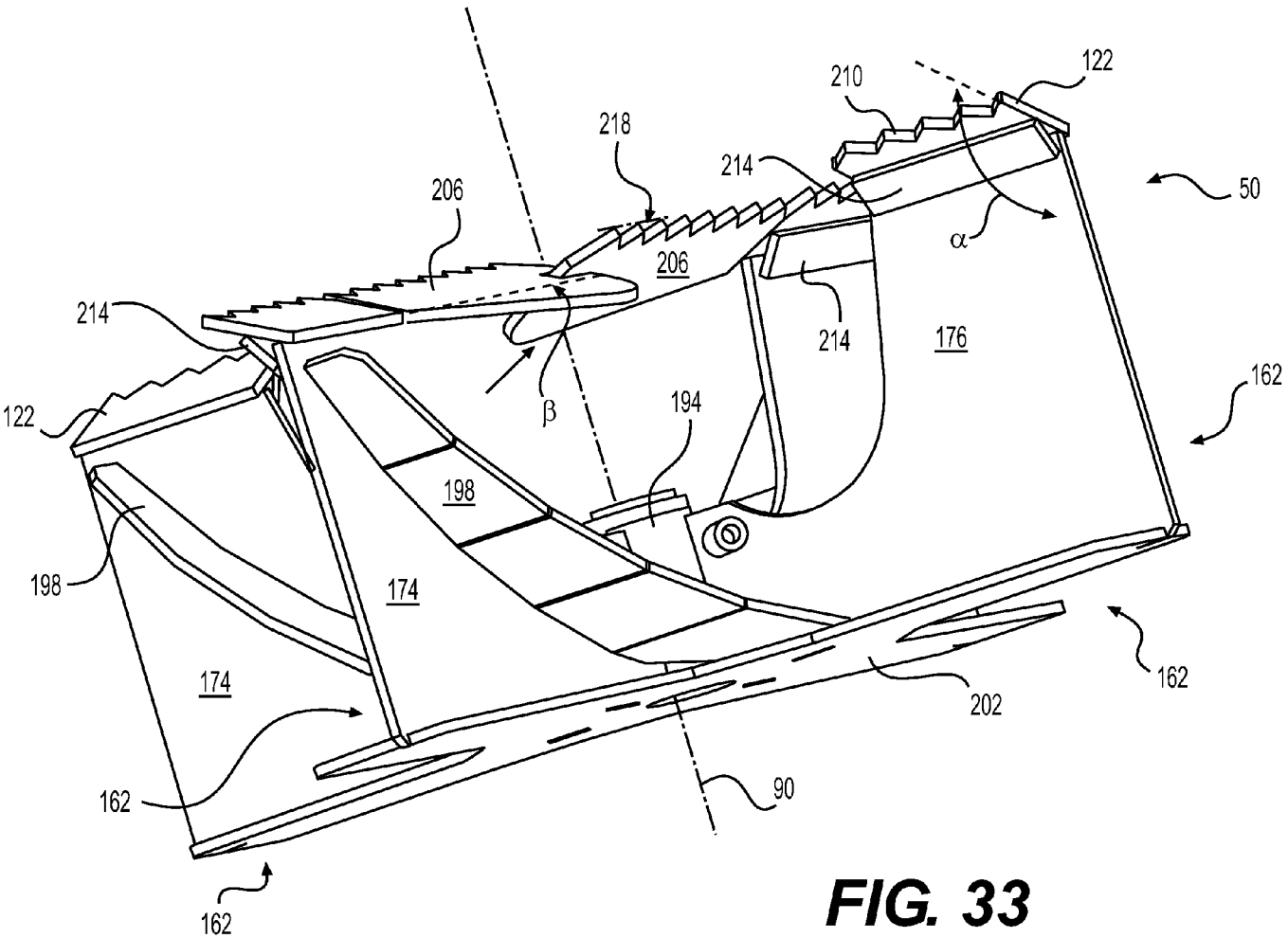
FIG. 33 is a side-bottom perspective illustration of a possible embodiment of the impeller, in accordance with at least one of the embodiment thereof.

FIG. 31 throughout FIG. 33 illustrate another embodiment where the extensions 206 have an increased width 218 constantly increasing with an angle of about $\beta$. The width 218 of the extension 206 can encompass the snow-engaging portion 122 and be linear or use a progressive shape transition. The embodiment depicts an enlarged width 218 of the snow-engaging portion 122 toward the middle of the impeller's eye 178 provides additional vacuum effect in locations of the snow-engaging portion 122 where the linear speed of the snow-engaging portion 122 is lesser than at the distal portion thereof.

Figure 34:
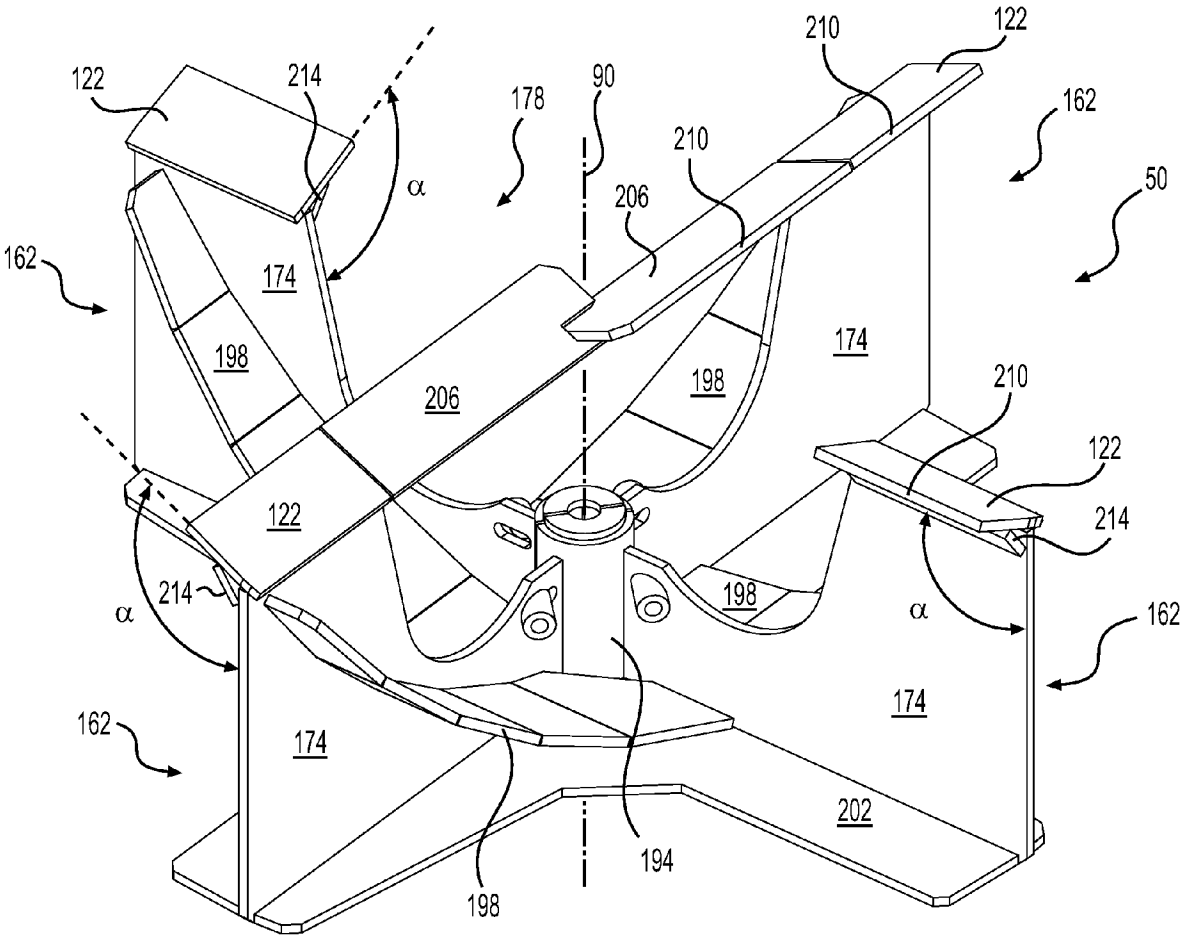
FIG. 34 is a top perspective illustration of a possible embodiment of the impeller wherein the extension and snow-engaging portions are toothless, in accordance with at least one of the embodiment thereof.
Figure 35:
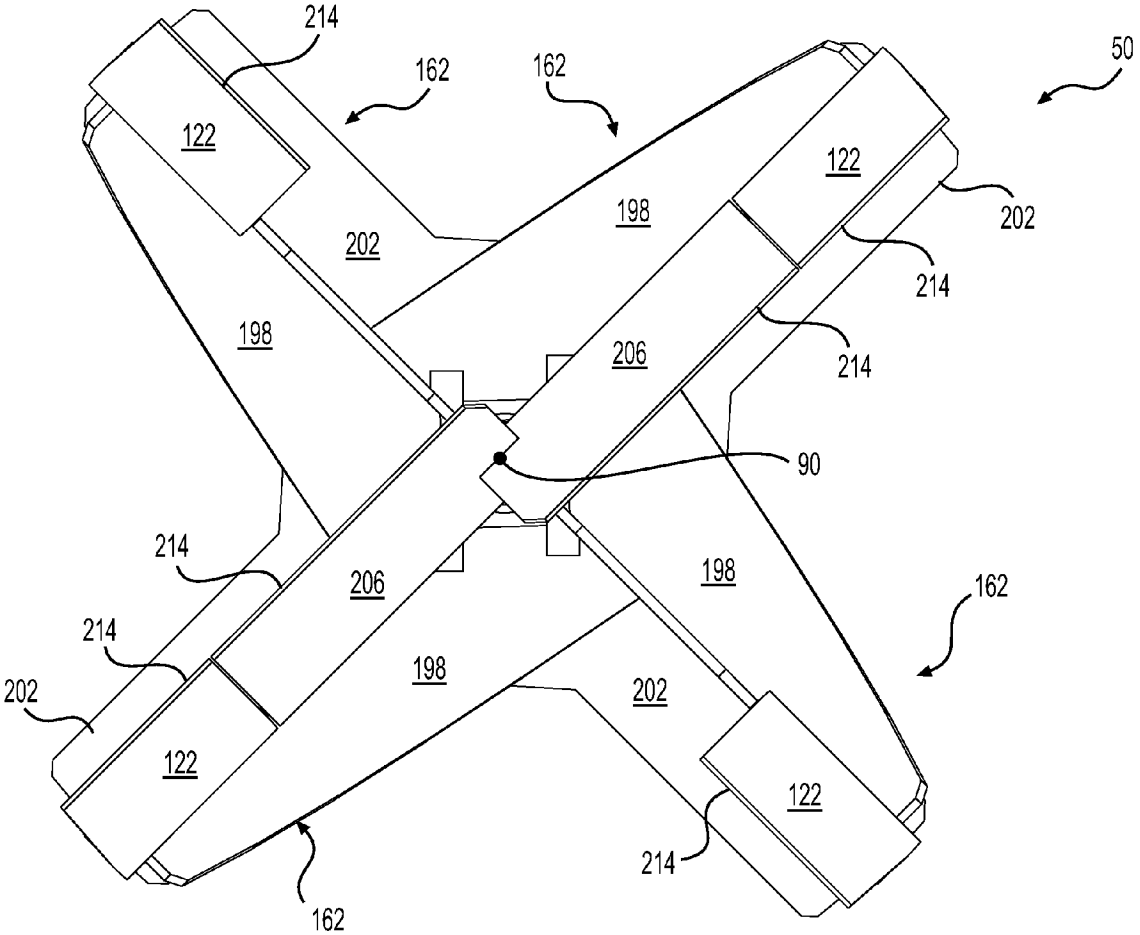
FIG. 35 is an elevational illustration of a possible embodiment of the impeller wherein the extension and snow-engaging portions are toothless, in accordance with at least one of the embodiment thereof; is an illustration of the elevation view of a possible embodiment of the impeller in the exemplary snowblower wherein the extensions snow-engaging portions have no teeth.
Figure 36:
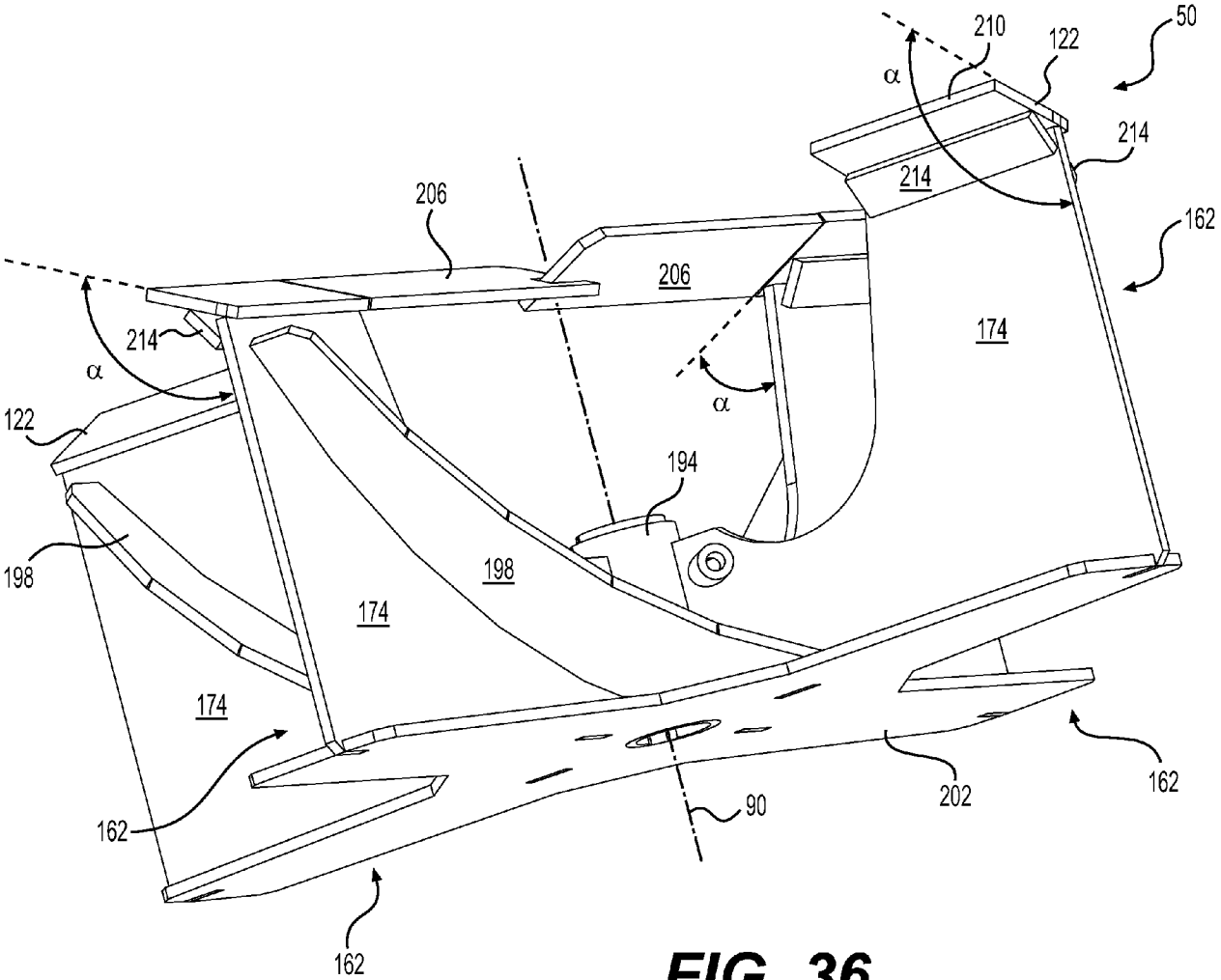
FIG. 36 is a side-bottom perspective illustration of a possible embodiment of the impeller wherein the extension and snow-engaging portions are toothless, in accordance with at least one of the embodiment thereof.

FIG. 34 throughout FIG. 36 illustrate another embodiment where the snow-engaging portions 112 and the extensions 206 have no teeth thereon.

Figure 37:
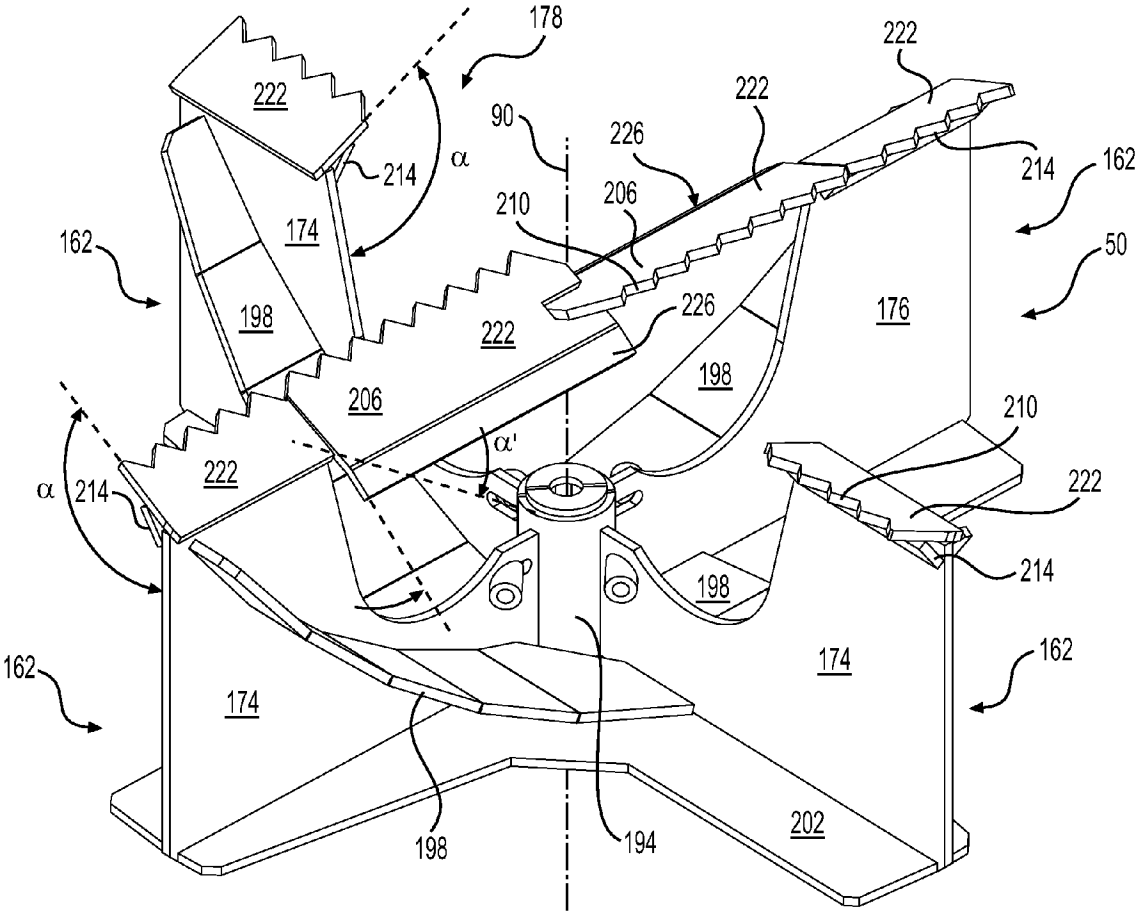
FIG. 37 is a top perspective illustration of a possible embodiment of the impeller wherein the extensions have a plurality of sequential toothed attack angles, in accordance with at least one of the embodiment thereof.
Figure 38:
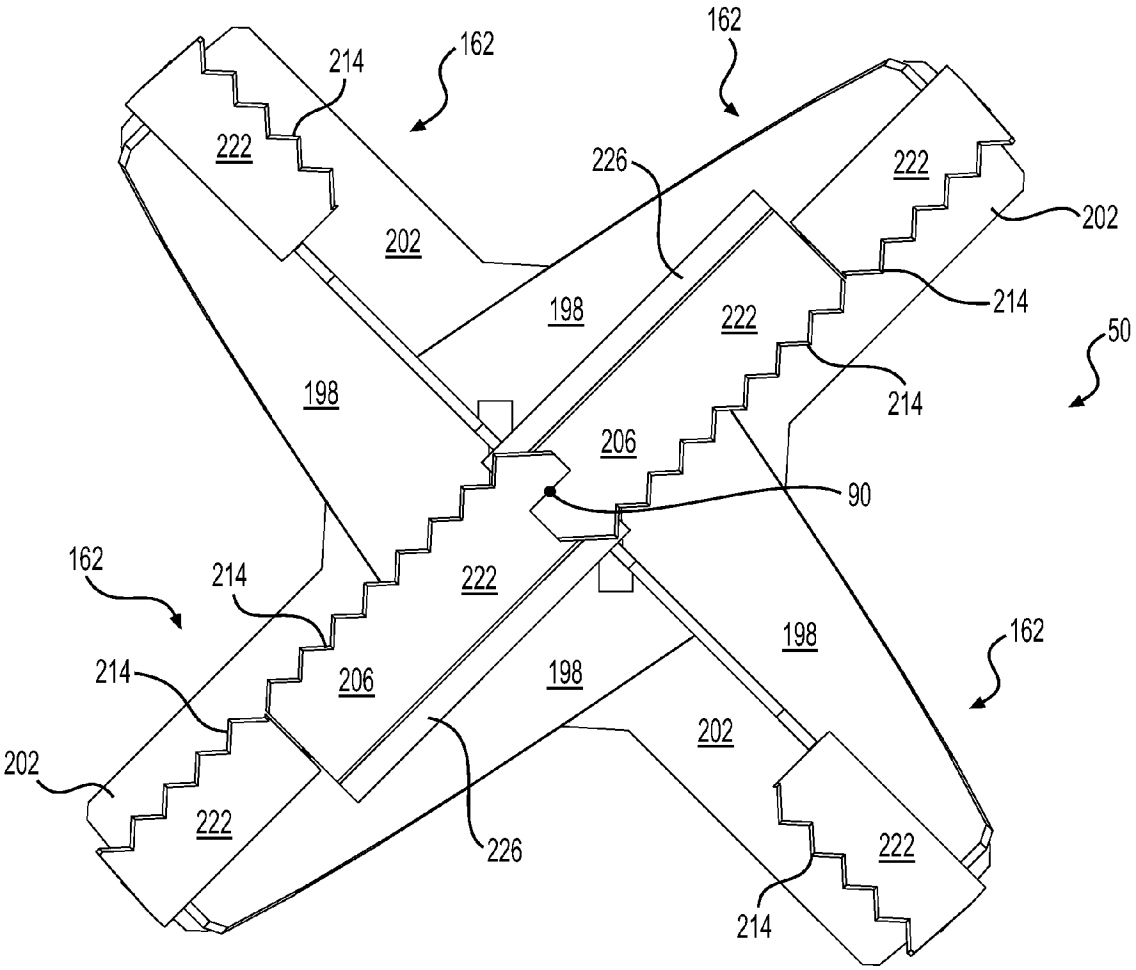
FIG. 38 is an elevational illustration of a possible embodiment of the impeller wherein the extensions have a plurality of sequential toothed attack angles, in accordance with at least one of the embodiment thereof.
Figure 39:
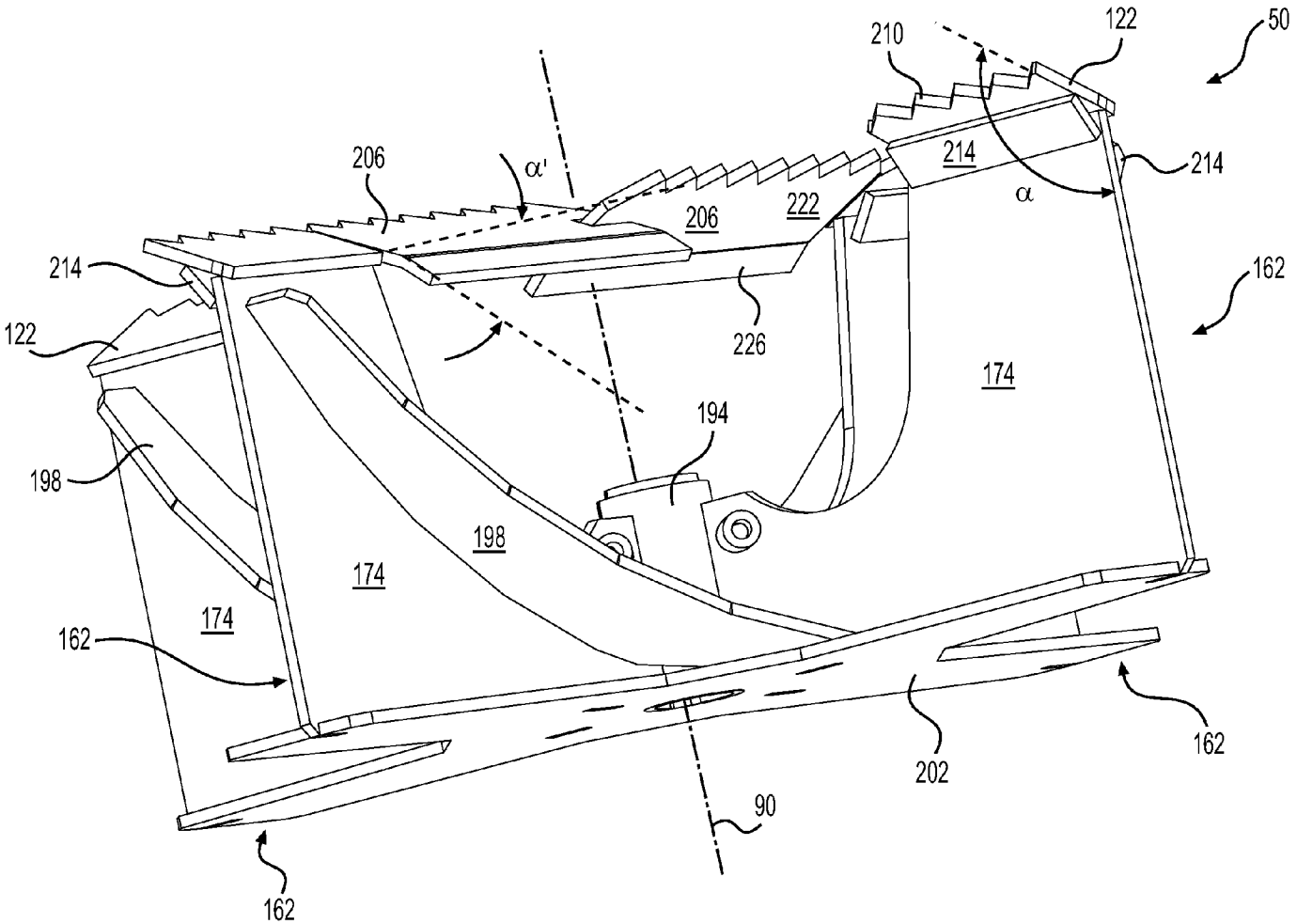
FIG. 39 is a side-bottom perspective illustration of a possible embodiment of the impeller wherein the extensions have a plurality of sequential toothed attack angles, in accordance with at least one of the embodiment thereof.

FIG. 37 throughout FIG. 39 illustrate an embodiment where the extensions 206 of the snow-engaging portions 112 are wider than the snow-engaging portions 112 and have a plurality of sequential attack angles $\alpha$. A primary angle 222, with angle $\alpha$, and a secondary angle 226, with angle $\alpha'$, are illustrated. The plurality of sequential attack angles could be replaced with a progressive attack angle (not illustrated). The plurality of attack angles $\alpha$ is offering increased vacuum and snow blowing capability to the impeller 50.

Figure 40:
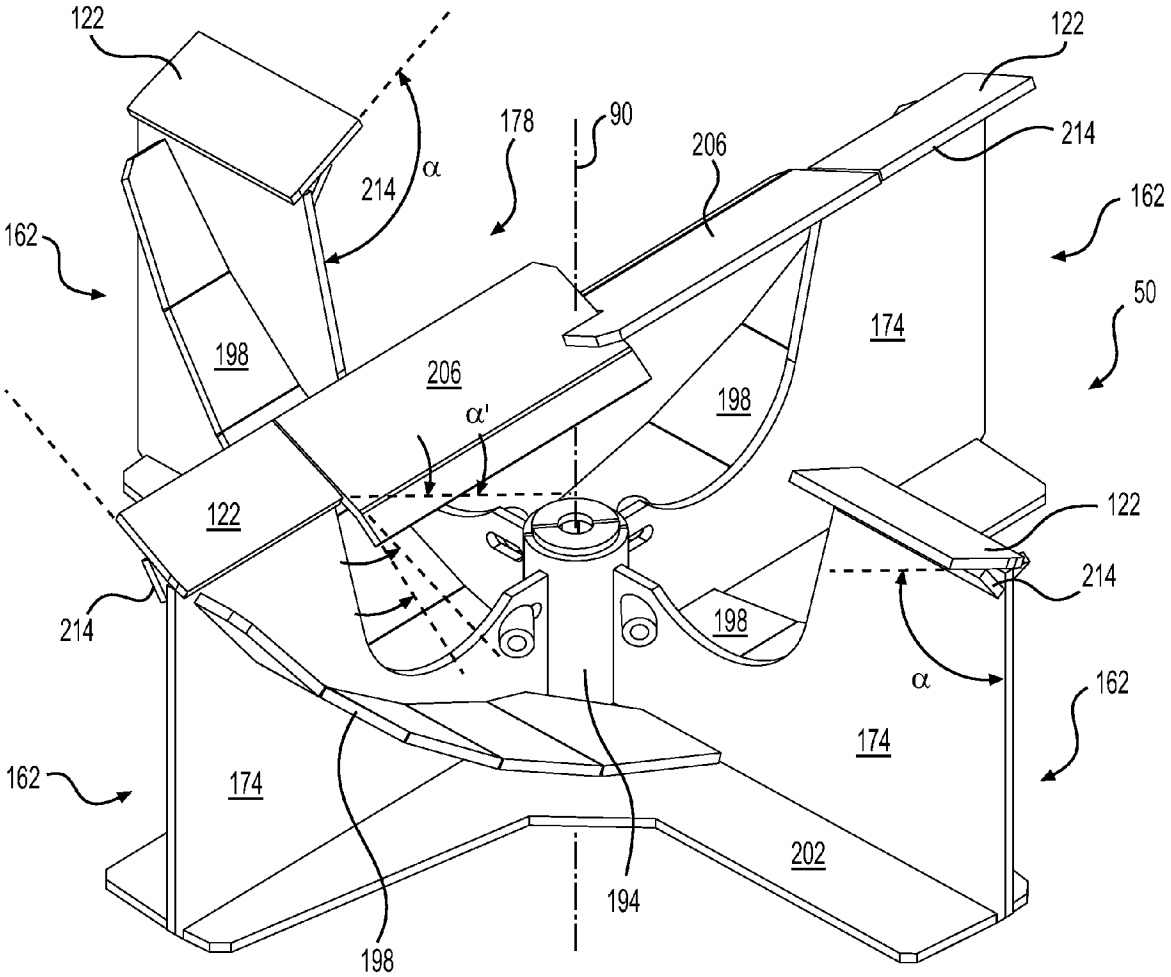
FIG. 40 is a top perspective illustration of a possible embodiment of the impeller wherein the extension and snow-engaging portions are toothless and the extensions have a plurality of sequential attack angles, in accordance with at least one of the embodiment thereof.
Figure 41:
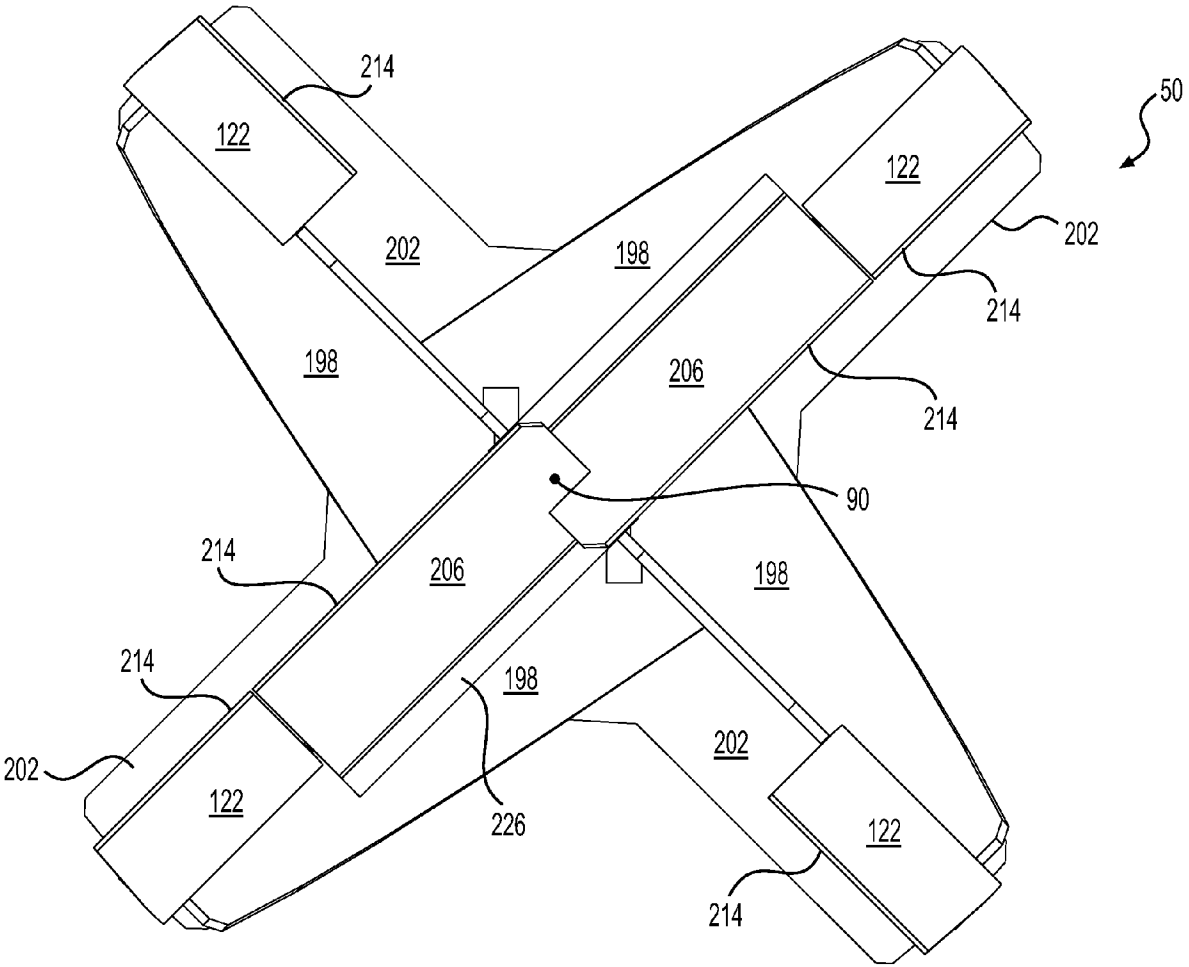
FIG. 41 is an elevational illustration of a possible embodiment of the impeller wherein the extension and snow-engaging portions are toothless and the extensions have a plurality of sequential attack angles, in accordance with at least one of the embodiment thereof.
Figure 42:
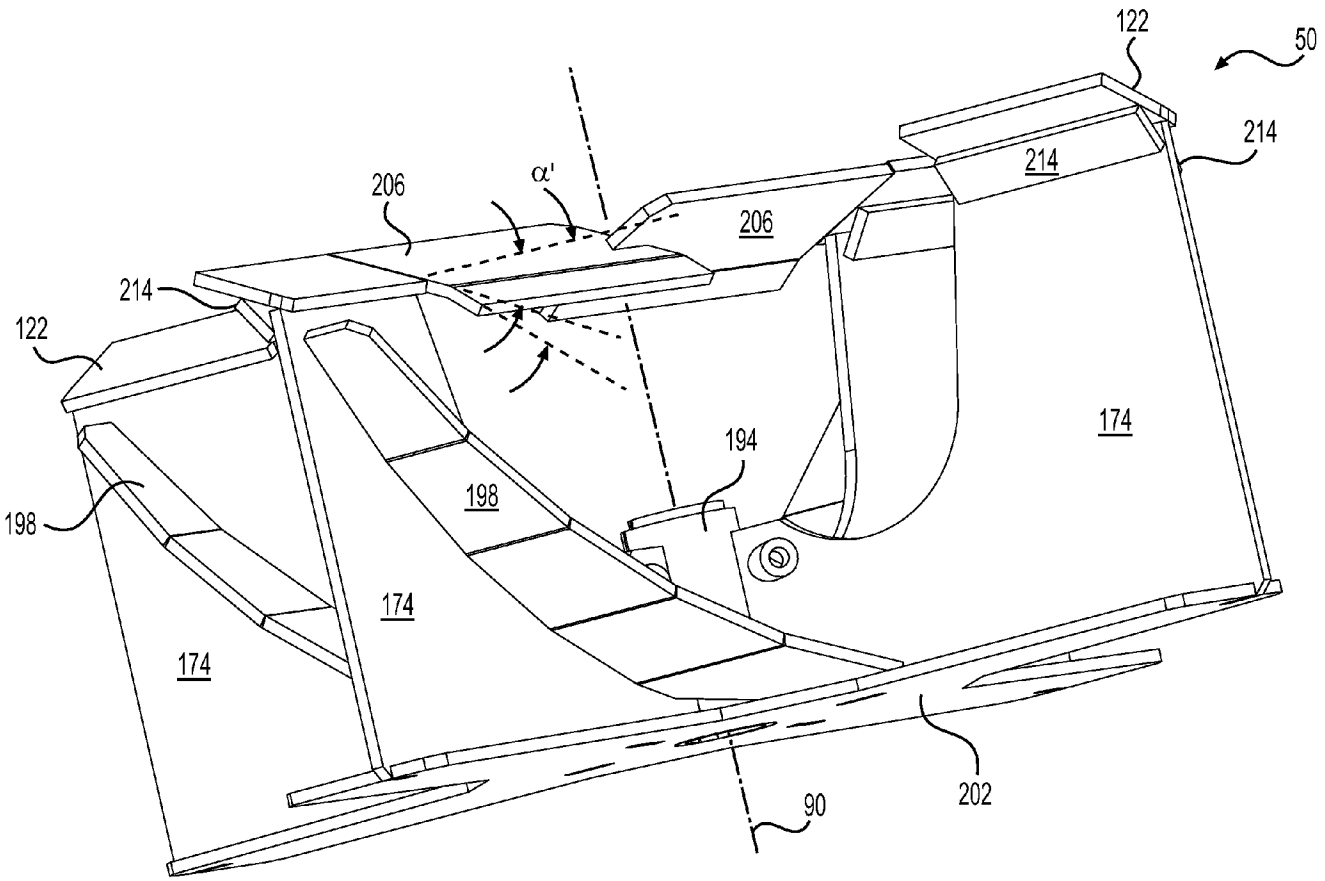
FIG. 42 is a side-bottom perspective illustration of a possible embodiment of the impeller wherein the extension and snow-engaging portions are toothless and the extensions have a plurality of sequential attack angles, in accordance with at least one of the embodiment thereof.

FIG. 40 throughout FIG. 42 illustrate another embodiment where the extensions 206 of the snow-engaging portions 112 have a plurality of sequential toothed attack angles. A primary angle 222, with angle $\alpha$, and a secondary angle 226, with angle $\alpha'$, are illustrated. The plurality of sequential attack angles could be replaced with a progressive attack angle (not illustrated). The plurality of attack angles $\alpha$ is offering increased vacuum and snow blowing capability to the impeller 50.

Figure 43:
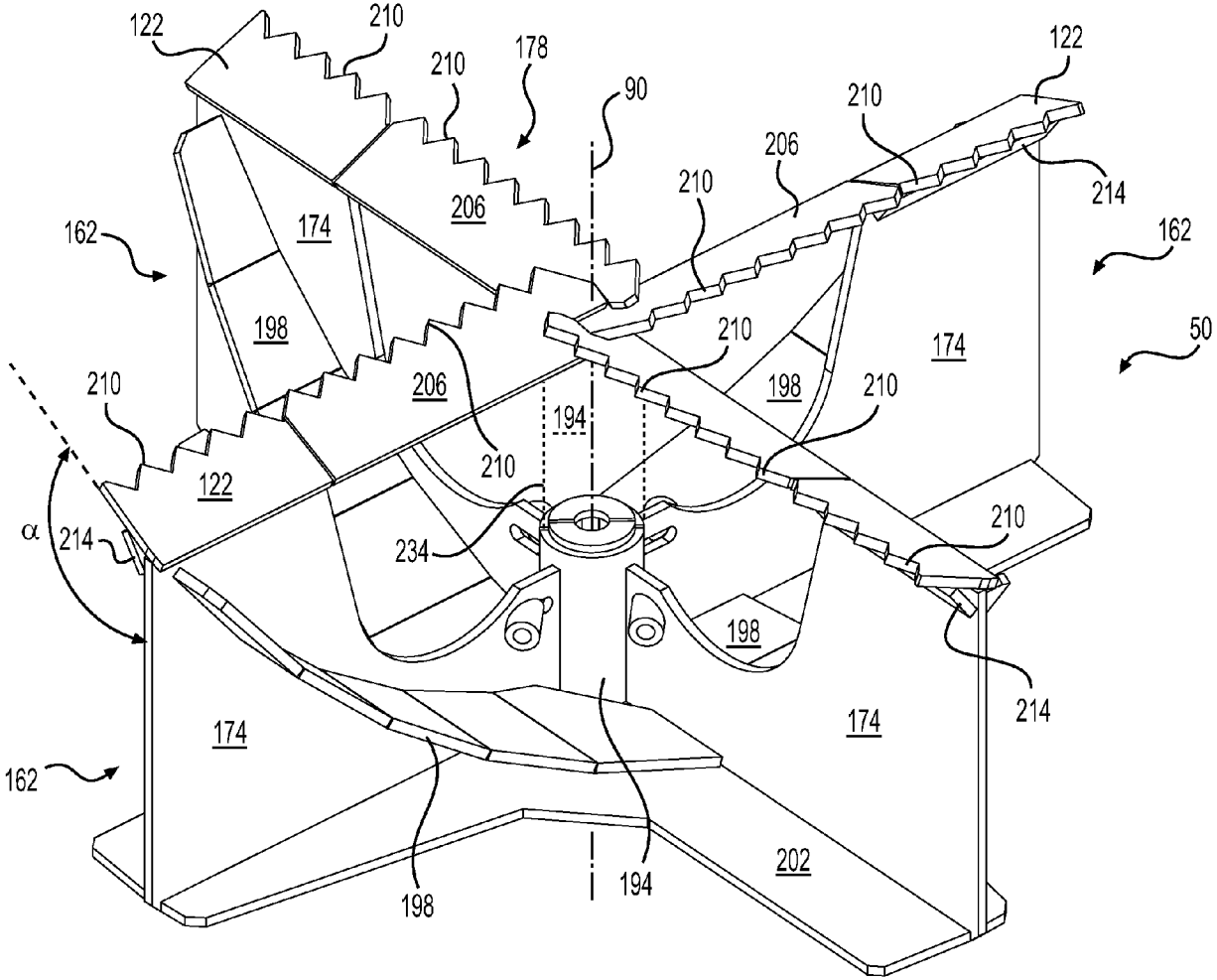
FIG. 43 is a top perspective illustration of a possible embodiment of the impeller wherein four extended snow-engaging portions are interconnected in the center of the axis of rotation, in accordance with at least one of the embodiment thereof.
Figure 44:
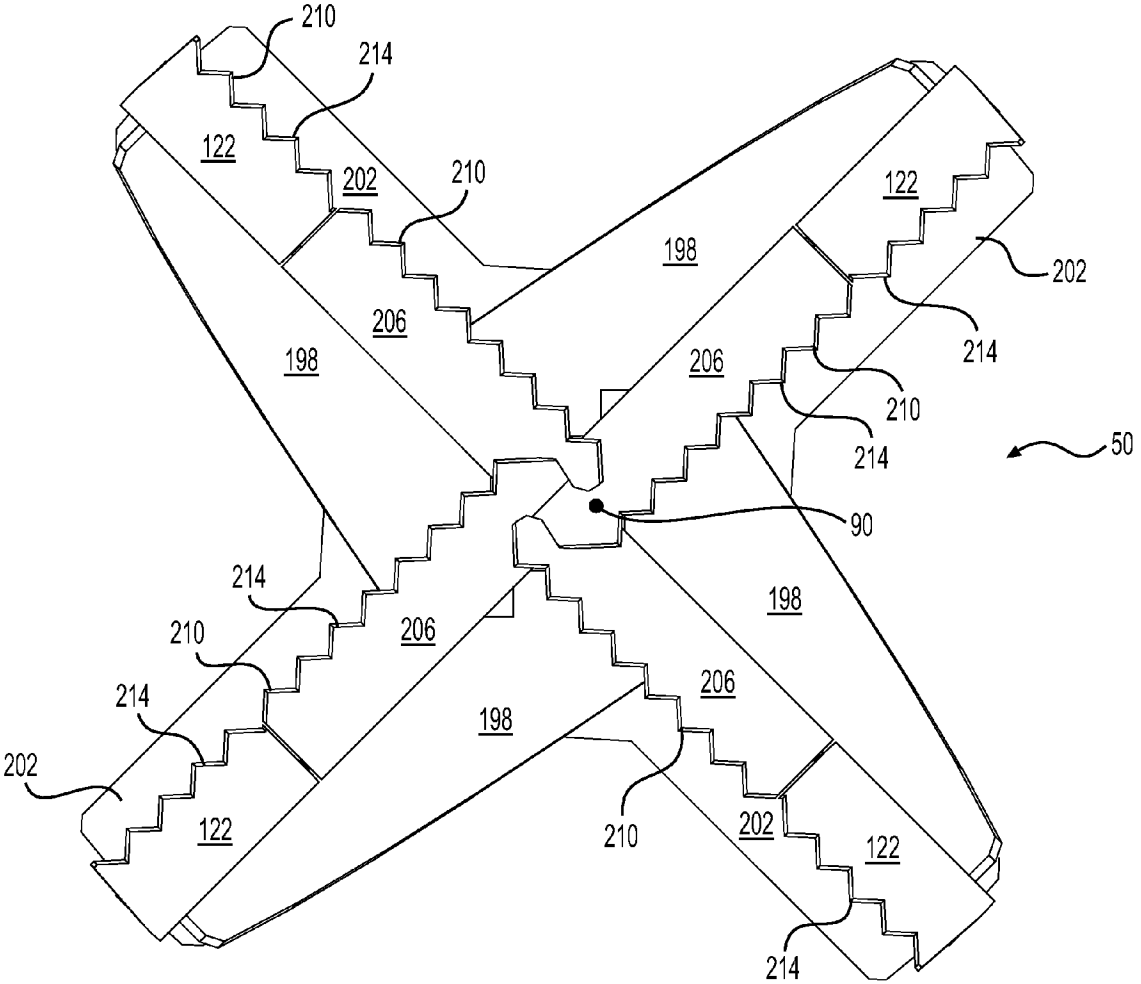
FIG. 44 is an elevational illustration of a possible embodiment of the impeller wherein four extended snow-engaging portions are interconnected in the center of the axis of rotation, in accordance with at least one of the embodiment thereof.
Figure 45:
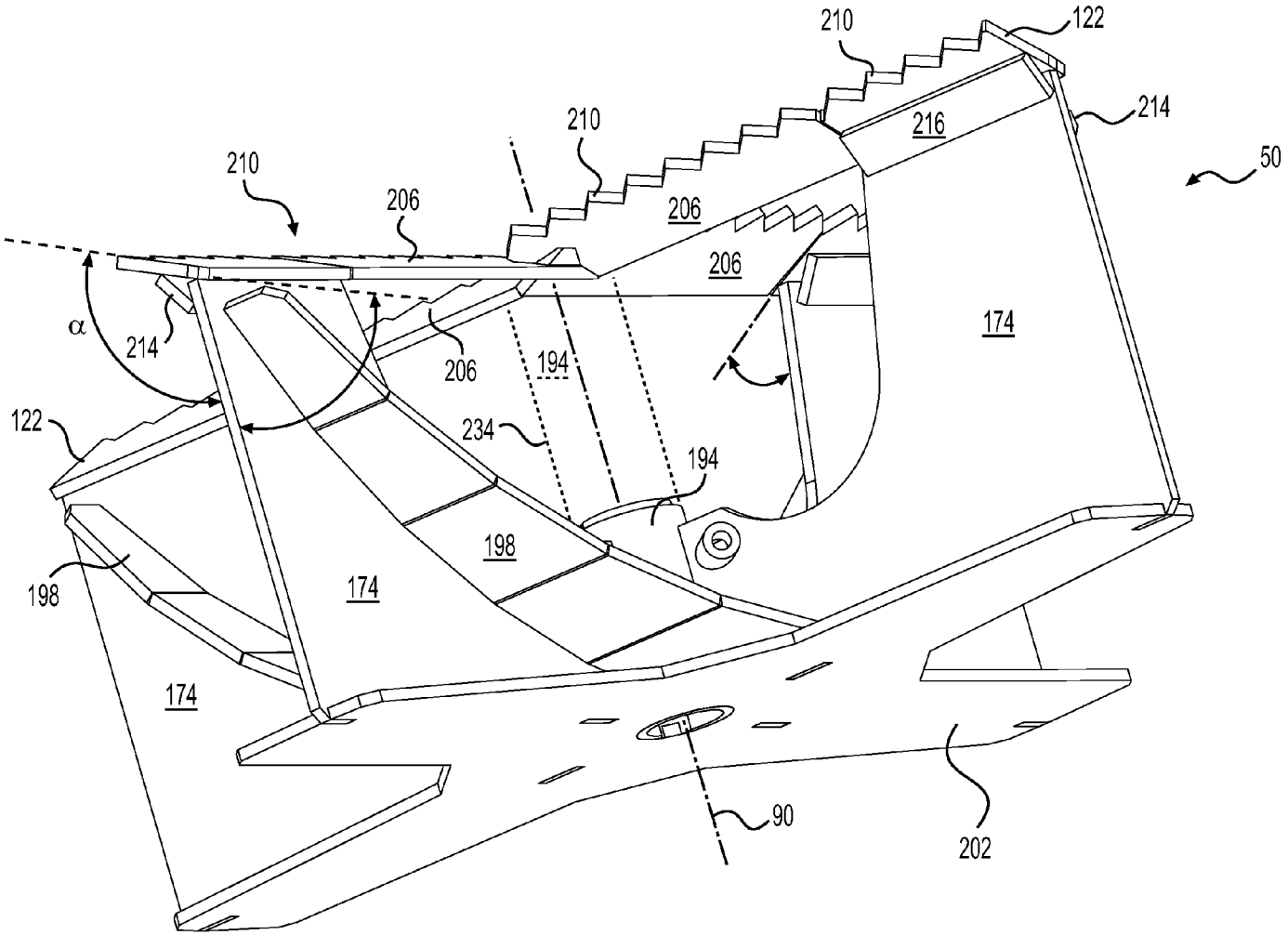
FIG. 45 is a side-bottom perspective illustration of a possible embodiment of the impeller wherein four extended snow-engaging portions are interconnected in the center of the axis of rotation, in accordance with at least one of the embodiment thereof.

FIG. 43 throughout FIG. 45 illustrate another embodiment where all the vanes 162 have a respective extension 206 of their snow-engaging portion 112. In the present embodiment, four extended snow-engaging portion 112 are illustrated and interconnected, preferably welded or secured with fasteners, in the center of the impeller's rotation axis 90. Further, the four snow-engaging portion 112 have toothed 210 and angled snow-engaging portions 112. An angle $\alpha$ is illustrated. The proximal sides of the extensions 206 can optionally be secured to an extension of the center portion of the impeller 50. Thick connection to the center portion of the impeller 50 can be applied to other embodiments described in the specification despite the connection is not illustrated with each embodiment.

Figure 46:
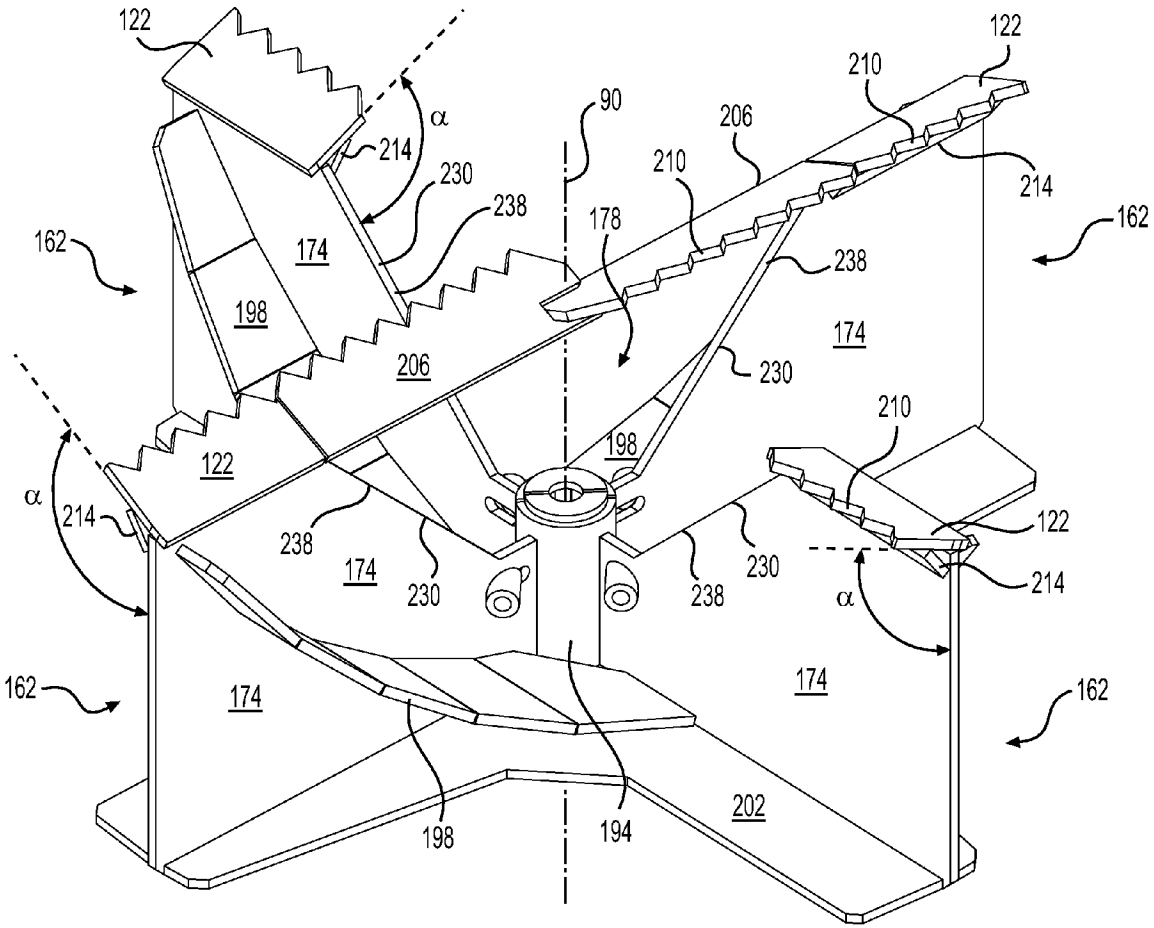
FIG. 46 is a top perspective illustration of a possible embodiment of the impeller wherein the impeller's eye has different volume and front facing area, in accordance with at least one of the embodiment thereof.
Figure 47:
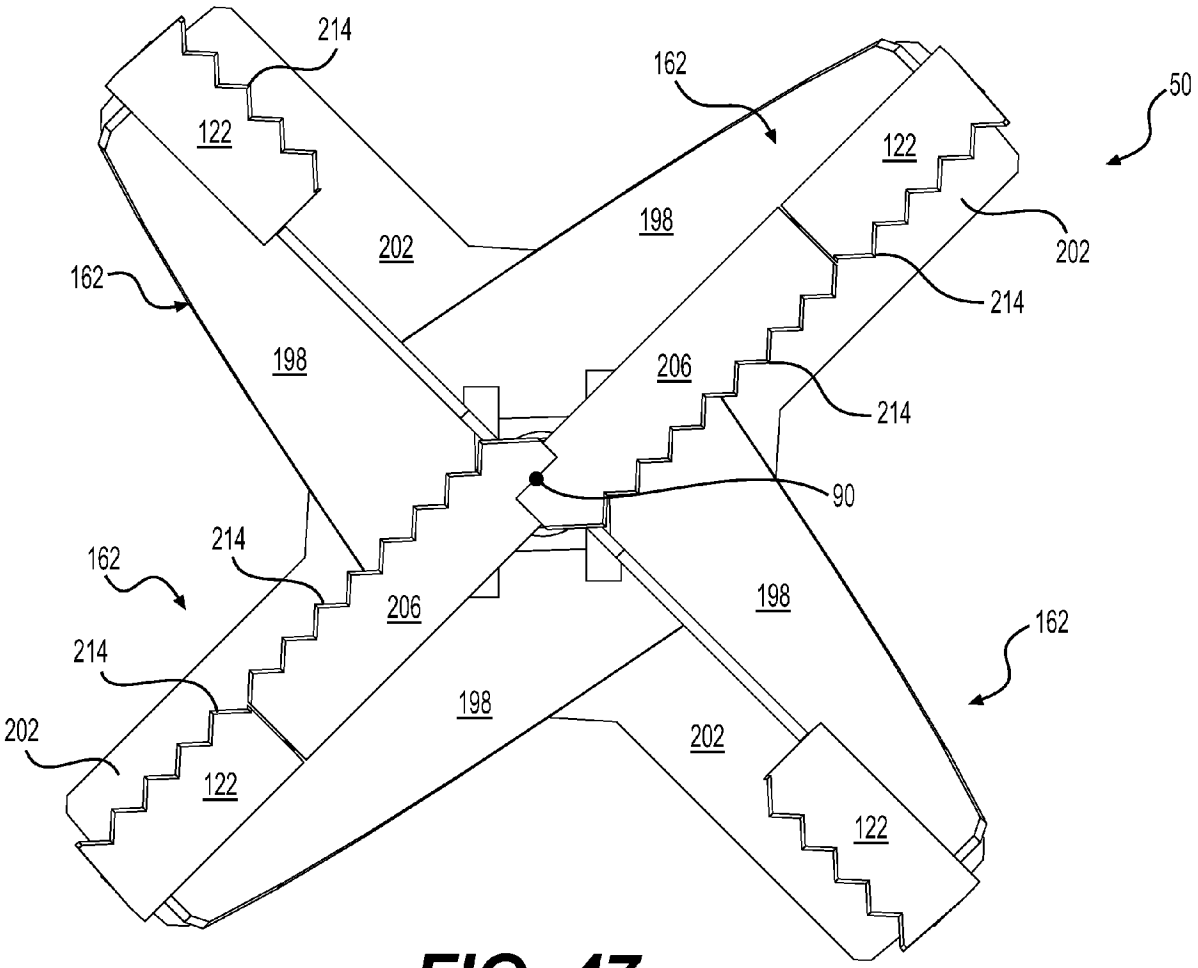
FIG. 47 is an elevational illustration of a possible embodiment of the impeller wherein the impeller's eye has different volume and front facing area, in accordance with at least one of the embodiment thereof.
Figure 48:
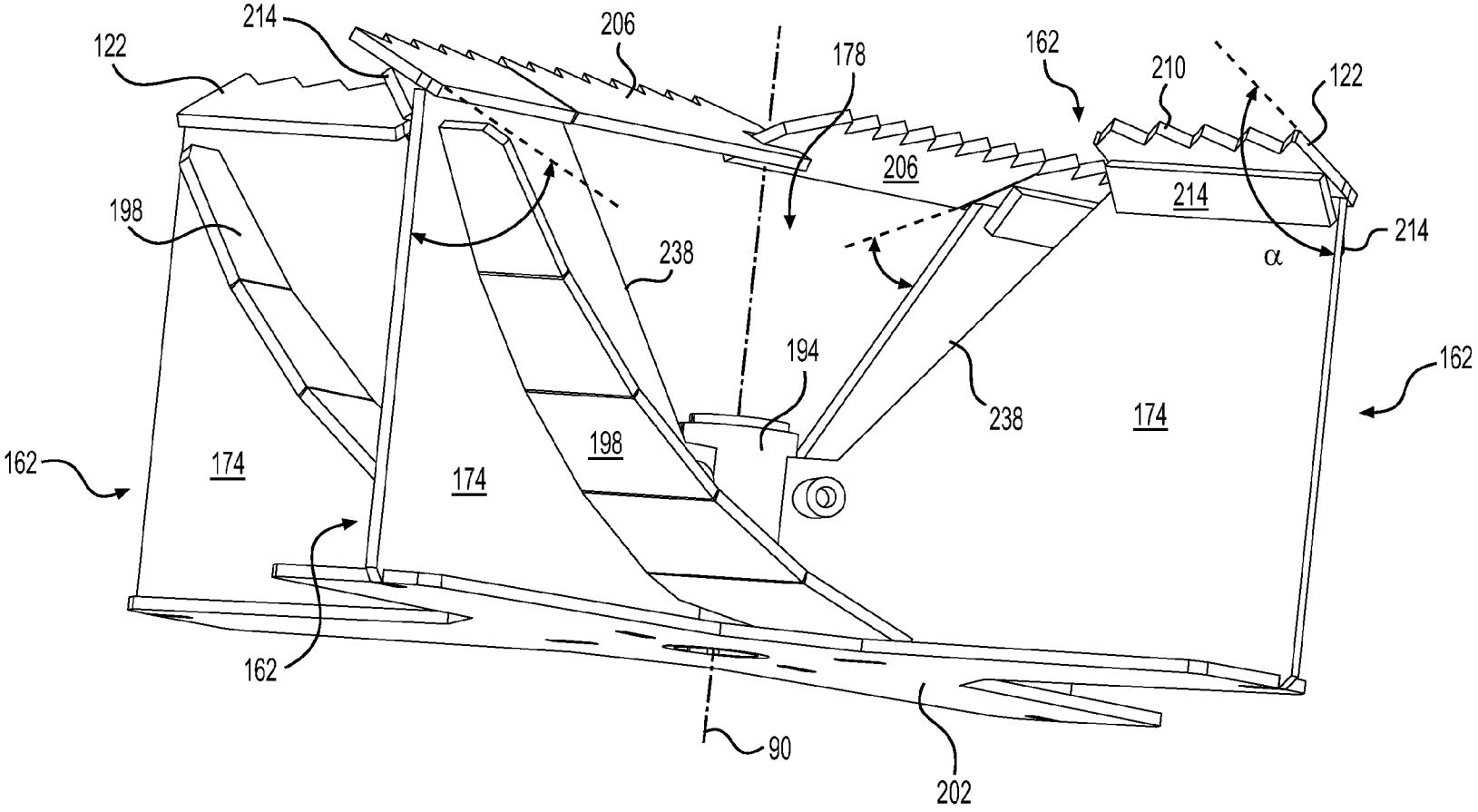
FIG. 48 is a side-bottom perspective illustration of a possible embodiment of the impeller wherein the impeller's eye has different volume and front facing area, in accordance with at least one of the embodiment thereof.

An impeller's eye 178 is the center of the impeller 50 where the vanes 162 are leaving a void to secure the hub 162 to the drive of the impeller 50. FIG. 46 throughout FIG. 48 illustrate another embodiment where all the vanes 162 are designed to define an impeller's eye 178 of a different volume and front facing area. The proximal and axial shape 230 of the portions to propel snow 174 is profiled differently to adjust the vacuum of the impeller 50. The vanes 162 are designed with a straight edge 238.

Figure 49:
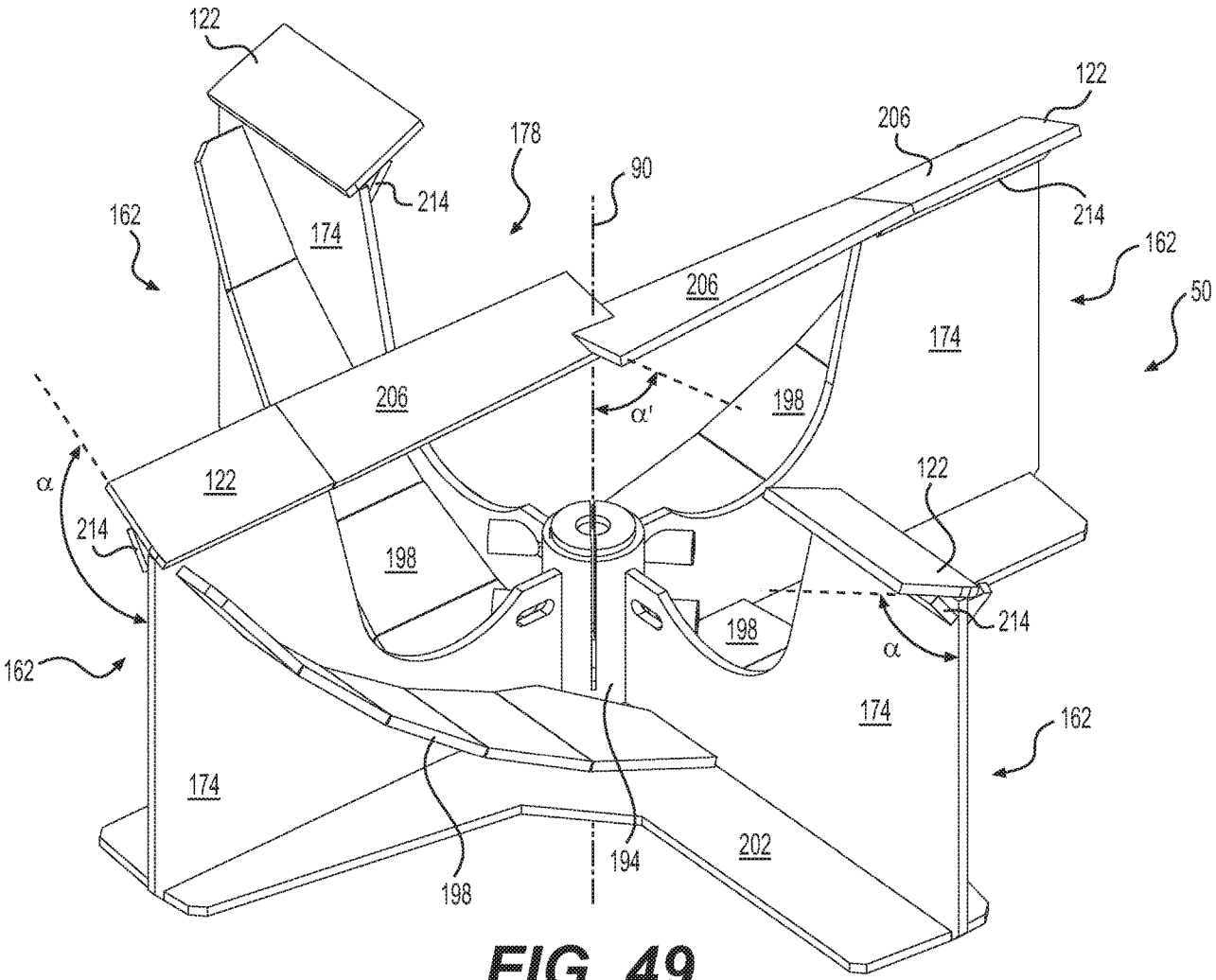
FIG. 49 is a top perspective illustration of a possible embodiment of the impeller wherein the extensions have a progressive radial change in the angle of attack, in accordance with at least one of the embodiment thereof.
Figure 50:
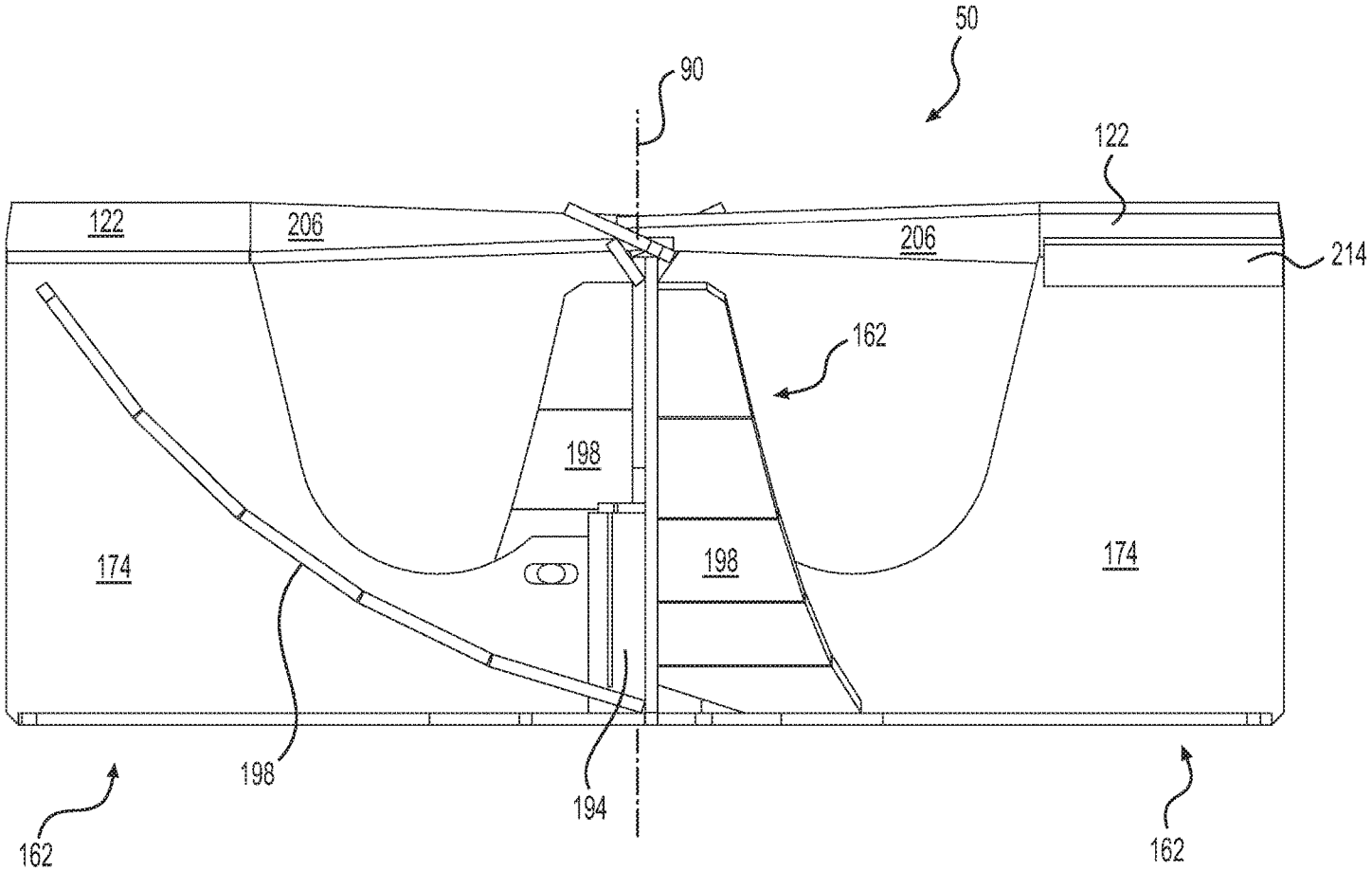
FIG. 50 is a side illustration of a possible embodiment of the impeller wherein the extensions have a progressive radial change in the angle of attack, in accordance with at least one of the embodiment thereof.
Figure 51:
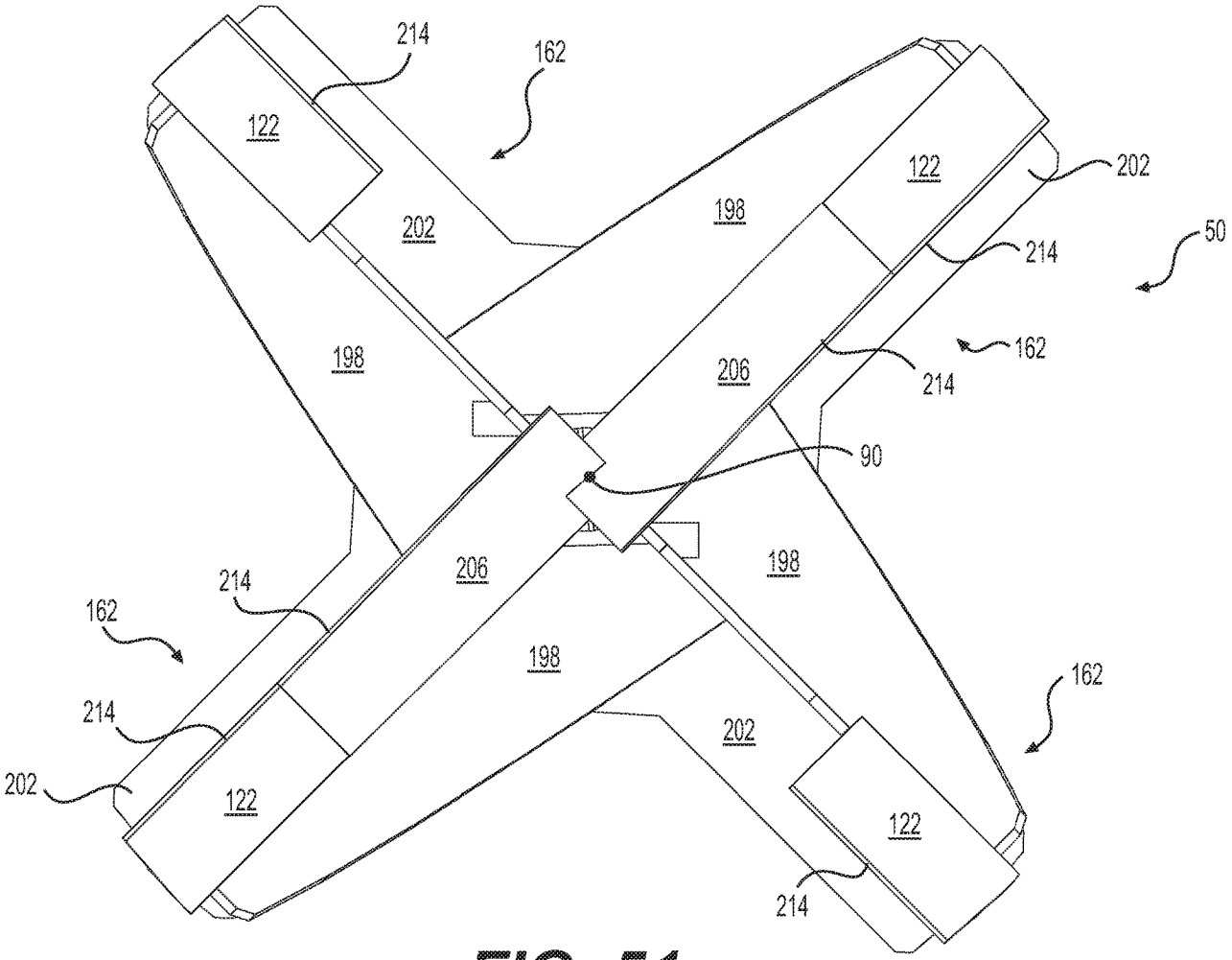
FIG. 51 is an elevational illustration of a possible embodiment of the impeller wherein the extension have a progressive radial change in the angle of attack, in accordance with at least one of the embodiment thereof.
Figure 52:
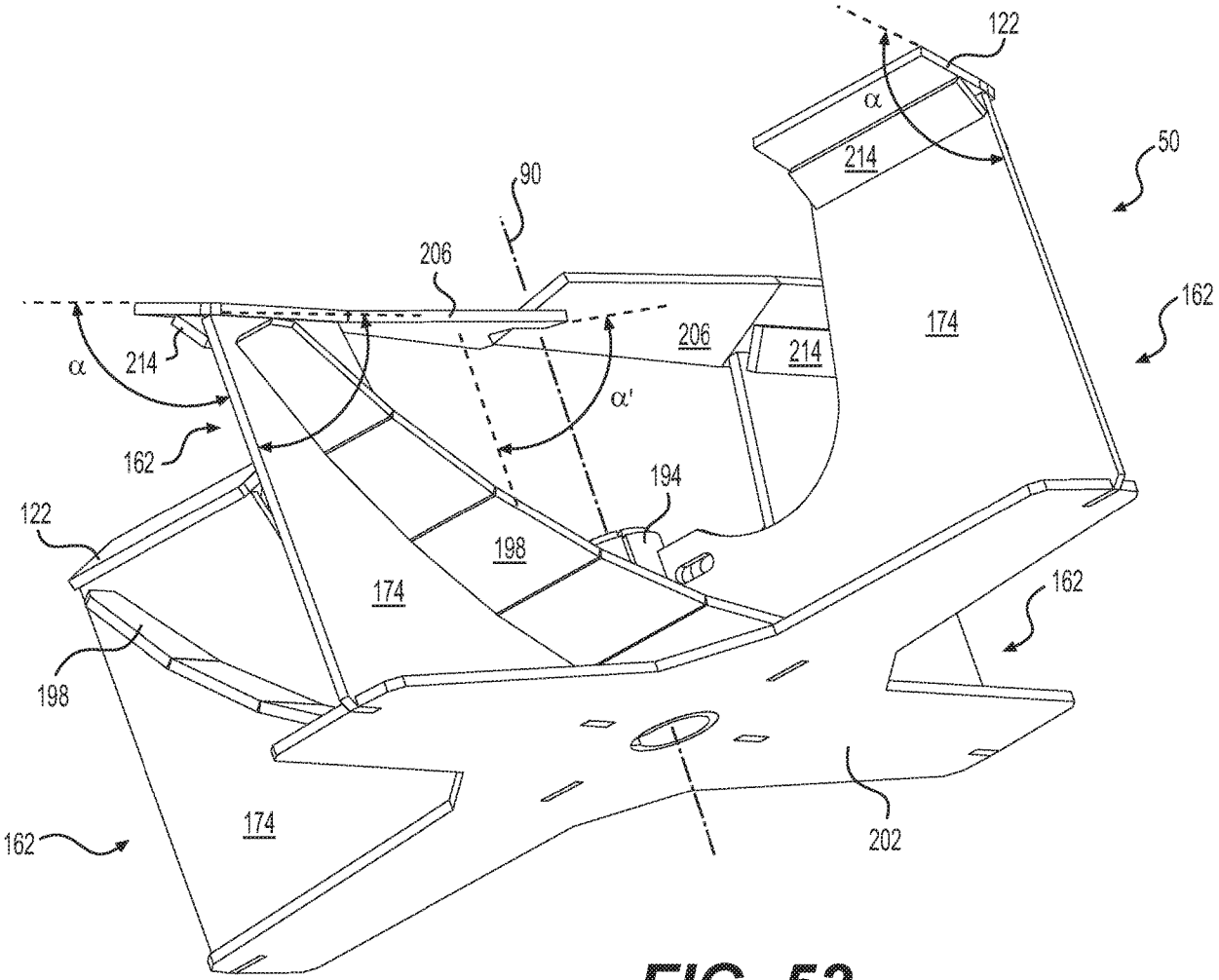
FIG. 52 is a side-bottom perspective illustration of a possible embodiment of the impeller wherein the extensions have a progressive radial change in the angle of attack, in accordance with at least one of the embodiment thereof.

FIG. 49 throughout FIG. 52 illustrate another embodiment where the extensions 206 of the snow-engaging portions 112 have a progressive radial change in the angle of attack α, extending to angle α' toward the axis of rotation of the impeller 50. A digressive angle where α>α') is illustrated. A progressive angle where α<α') is encompassed by the present application despite this embodiment is not illustrated and believed to be obvious in view of the FIG. 49 throughout FIG. 51. The progressive angle of the snow-engaging portions 112 and extensions 206 thereof are, inter alia, adapted to adjust the vacuum of the snow-engaging portions 112 and extensions 206 in respect with the linear speed of the and extensions 206 and extensions 206 and/or the amount of snow to be efficiently engaged by a specific region of the vane 162.

Figure 53:
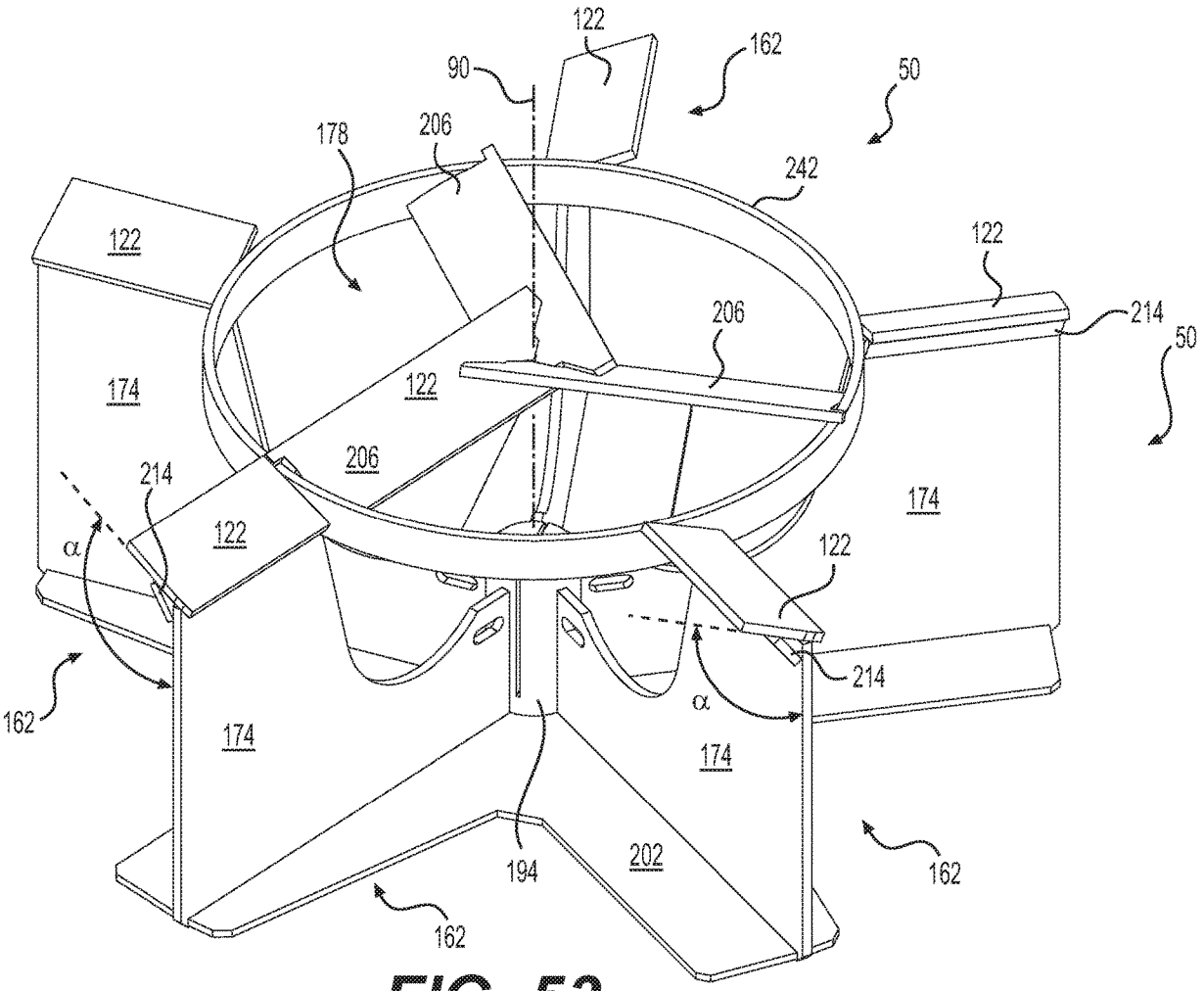
FIG. 53 is a top perspective illustration of a possible embodiment of the impeller wherein the impellers has three extensions and five snow-engaging portions and wherein the extensions are supported by a retaining member, in accordance with at least one of the embodiment thereof.
Figure 54:
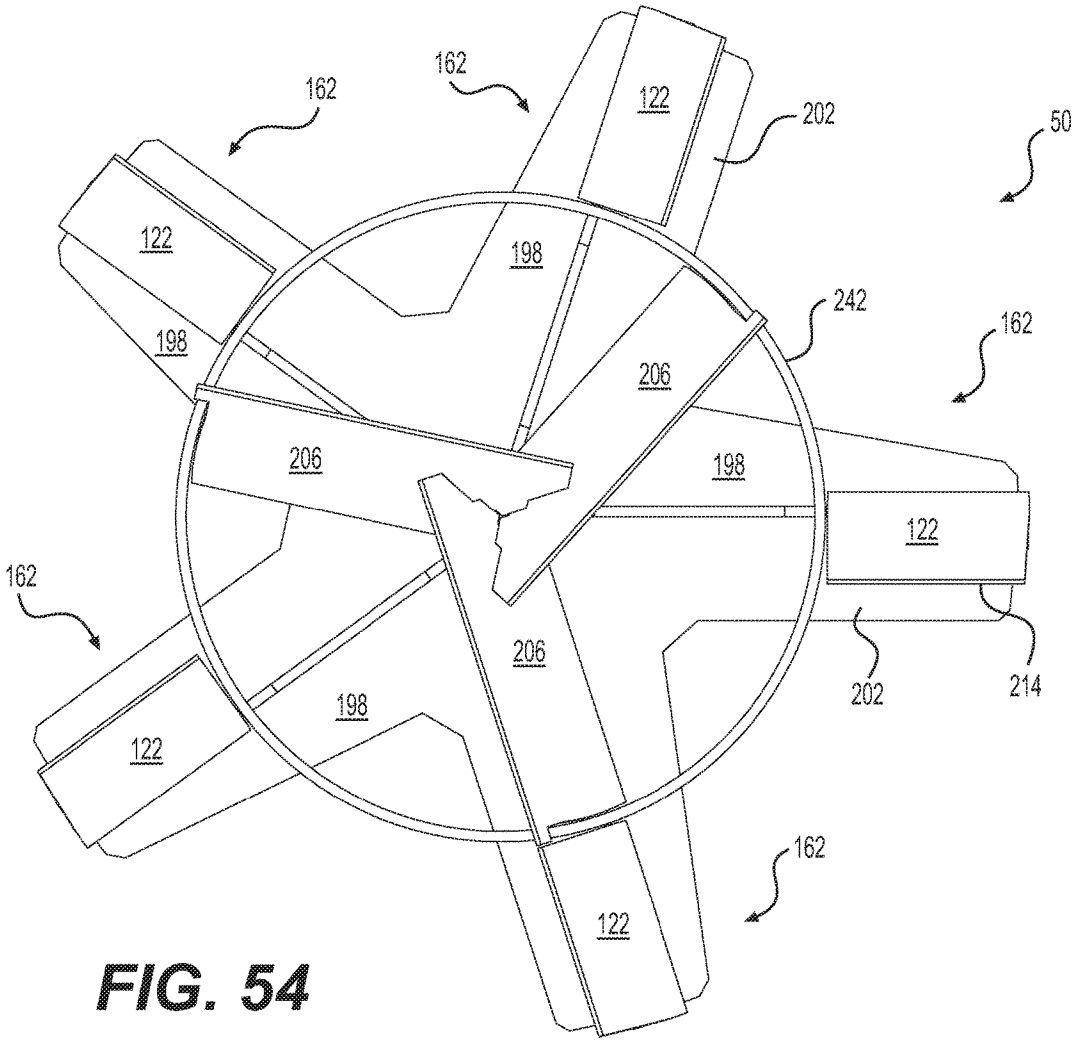
FIG. 54 is an elevational illustration of a possible embodiment of the impeller wherein the impellers has three extensions and five snow-engaging portions and wherein the extension are contained in a retaining member, in accordance with at least one of the embodiment thereof.
Figure 55:
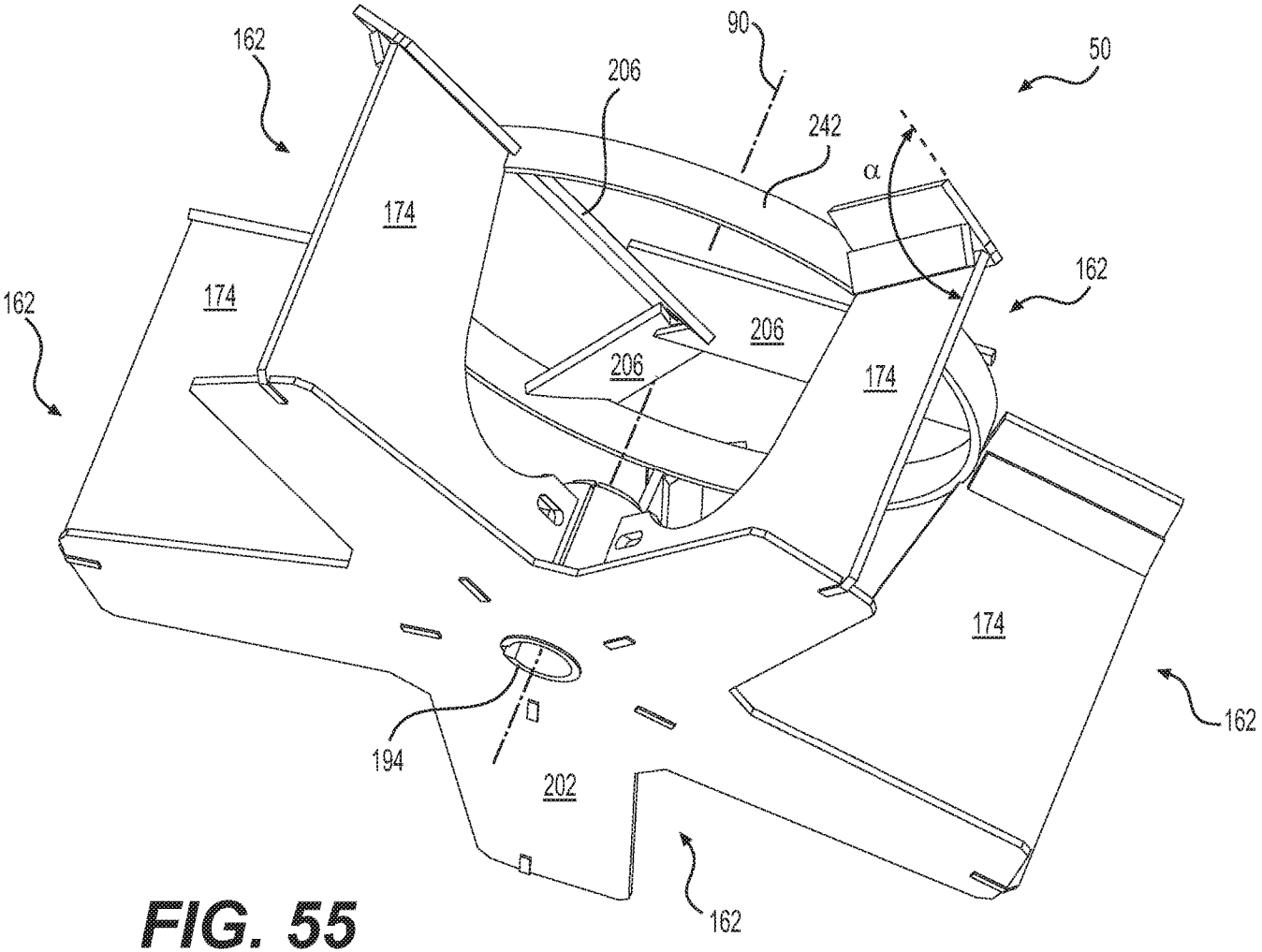
FIG. 55 is a side-bottom perspective illustration of a possible embodiment of the impeller wherein the impellers has three extensions and five snow-engaging portions and wherein the extensions are contained in a retaining member, in accordance with at least one of the embodiment thereof.

Moving now to FIG. 53 throughout FIG. 55 illustrating an impeller 50 with snow-engaging portions 112 and extensions 206 thereof that are not necessarily aligned with a respective vane 162. A retaining member 242 supports the extensions 206. The retaining member 242 is embodied as a ring and is located between the snow-engaging portions 112 and the extensions 206. The retaining member 242 is used to reinforce the impeller 50, to allow using a number of extensions 206 that is different than the number of vanes 162, that are not aligned with a respective vane 162 and also to allow more adjustment of the extensions 206 in respect with the snow-engaging portions 122. The angle α of the extensions 206 can be different than the angle of the snow-engaging portions 122, among other advantages like easy securing and replacement of the extensions 206. The extensions 206 assembled with the retaining member 242 can come as a bundle for easy replacement or as a kit to retrofit existing impeller 50.

Figure 56:
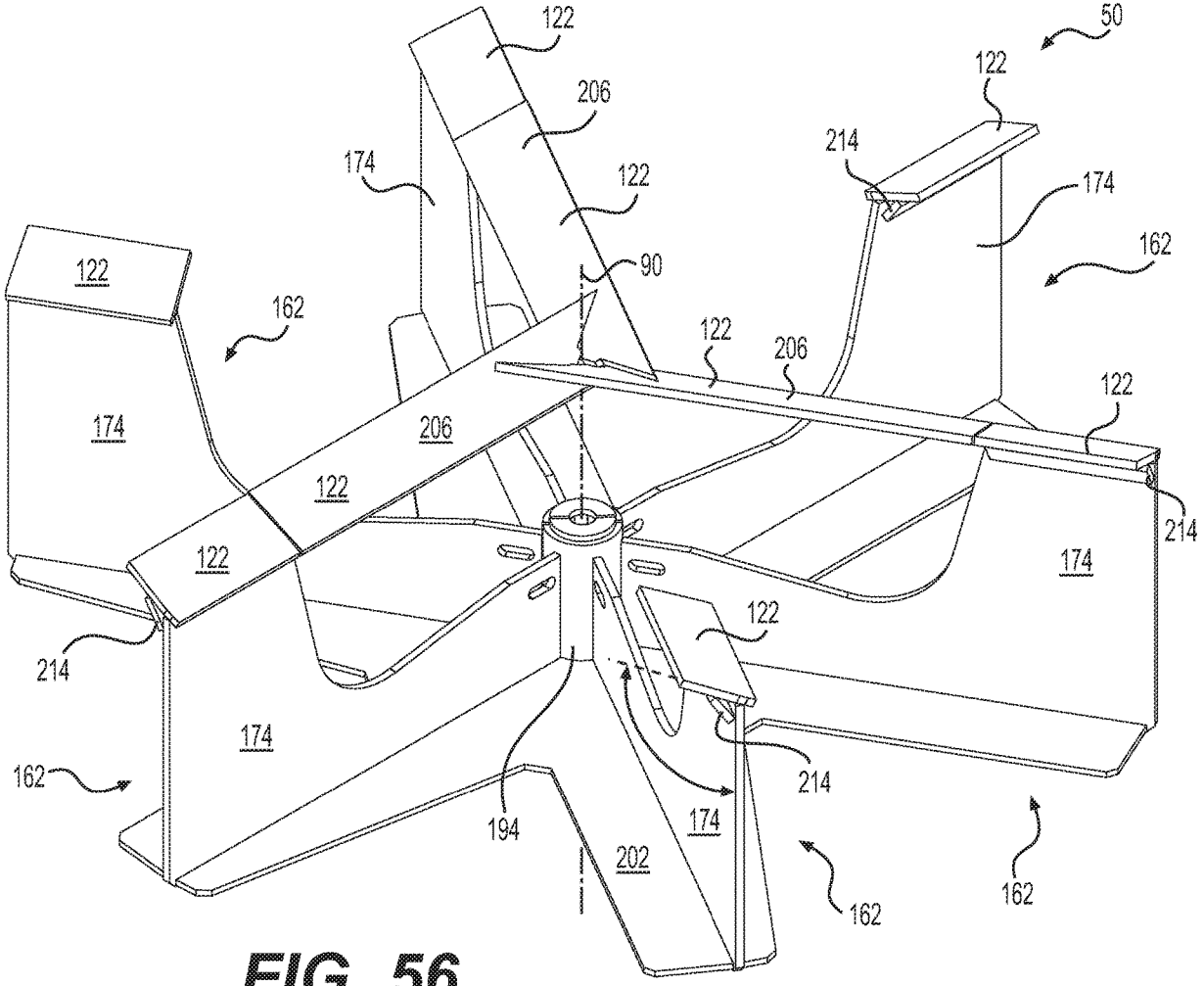
FIG. 56 is a top perspective illustration of a possible embodiment of the impeller wherein the impellers has three extensions and five snow-engaging portions, in accordance with at least one of the embodiment thereof.
Figure 57:
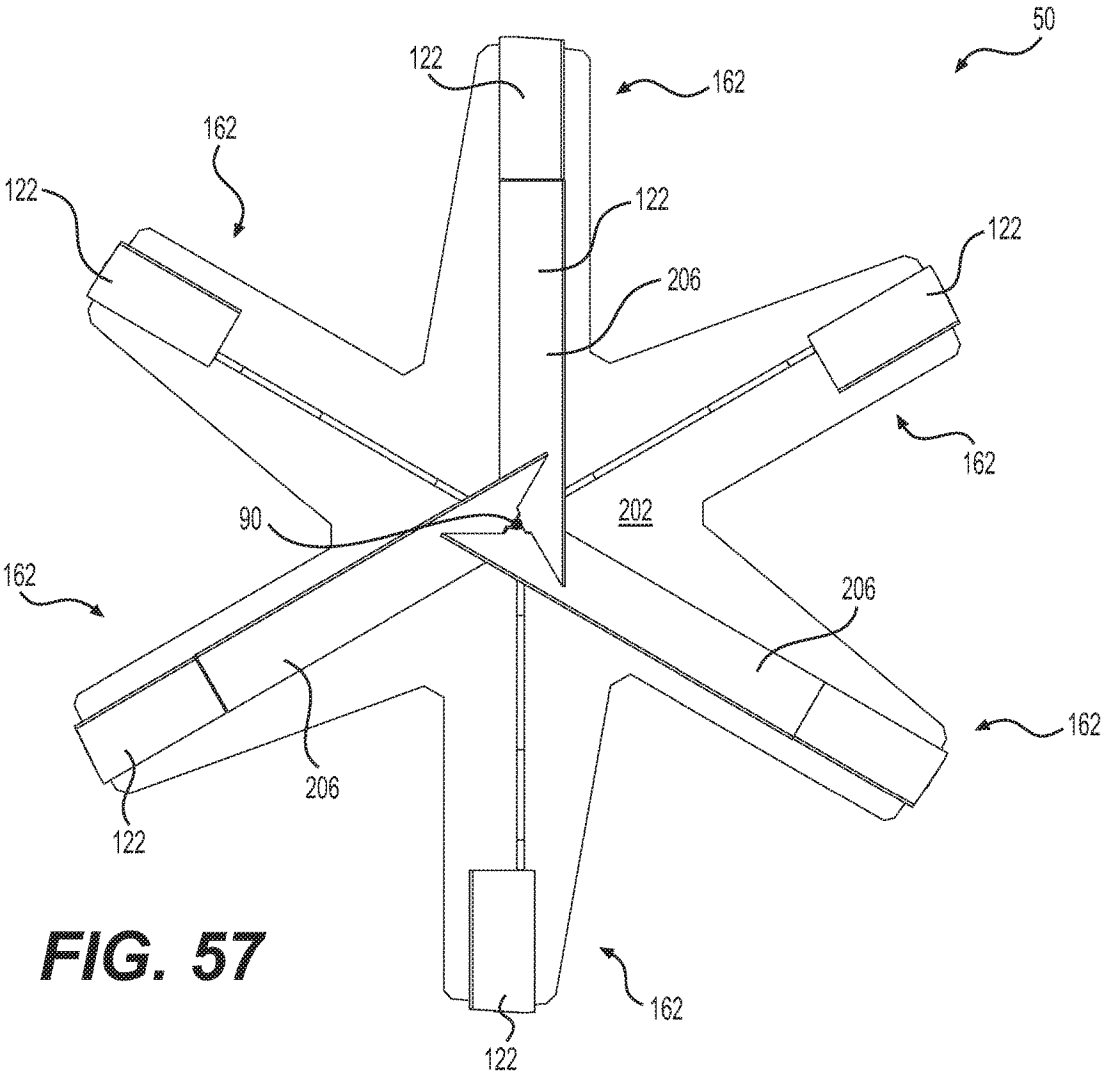
FIG. 57 is an elevational illustration of a possible embodiment of the impeller wherein the impellers has three extensions and five snow-engaging portions, in accordance with at least one of the embodiment thereof.
Figure 58:
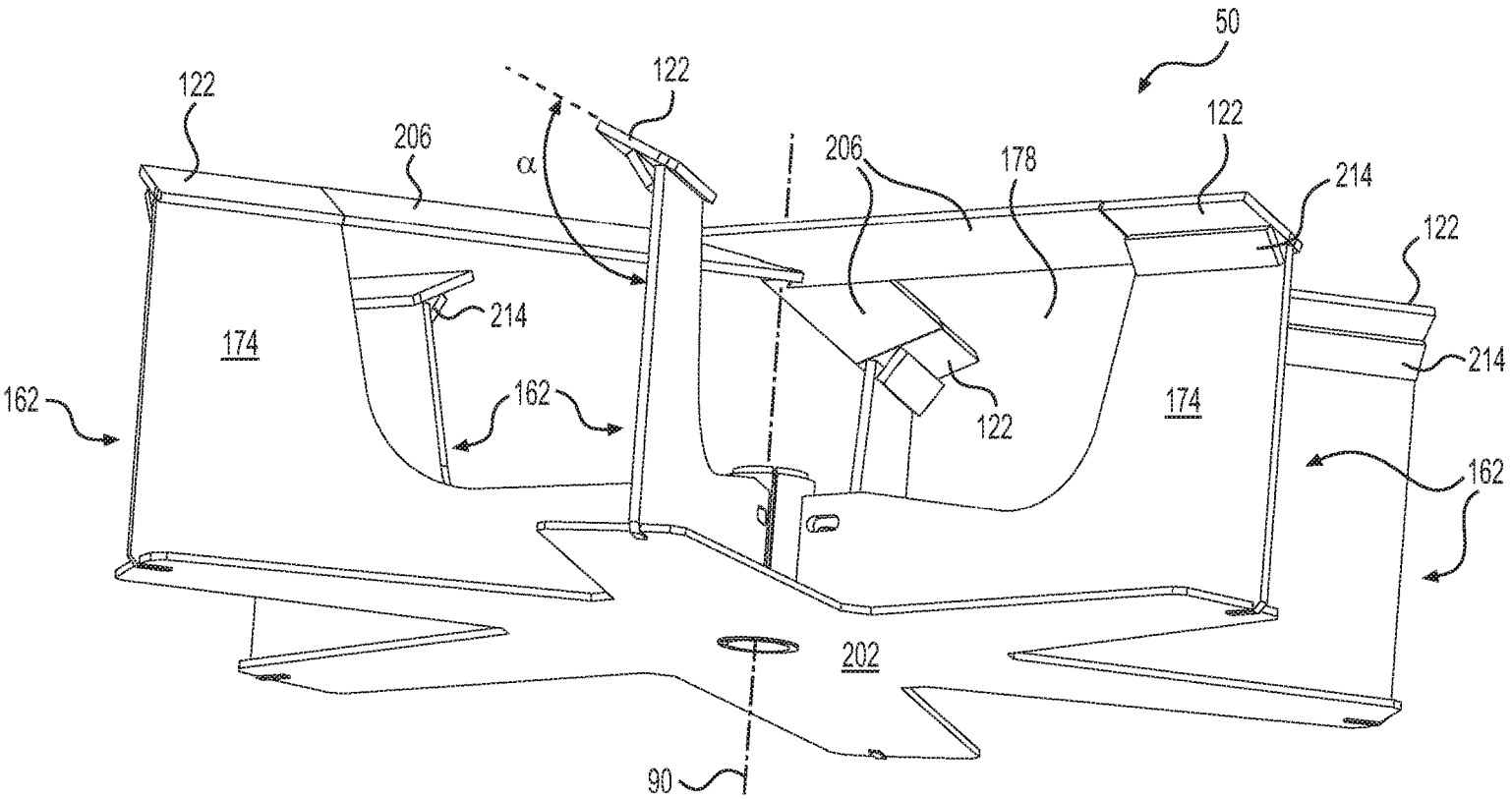
FIG. 58 is a side-bottom perspective illustration of a possible embodiment of the impeller wherein the impellers has three extensions and five snow-engaging portions, in accordance with at least one of the embodiment thereof.

FIG. 56 throughout FIG. 58 are illustrating a six-vanes 162 impellers 50 configurations with alternated vanes 162 with an extension 206 thereof. Each extension 206 is secured to a vane 162 preferably via respective snow-engaging portions 122. This symmetrical layout allows for easy balancing and lightens the impeller 50.

Figure 59:
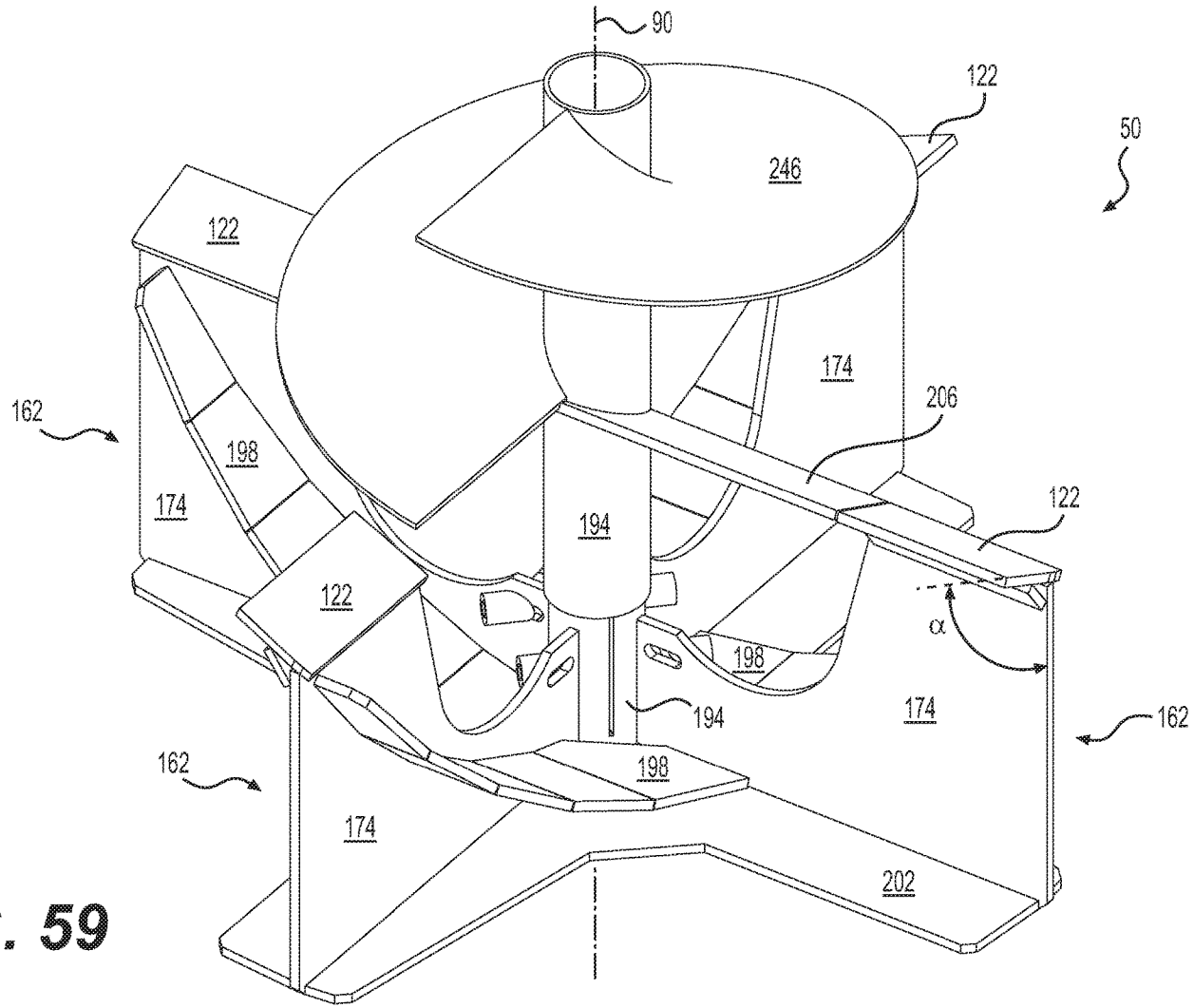
FIG. 59 is a top perspective illustration of a possible embodiment of the impeller wherein the impeller is combined with an endless screw assembled on the axis or rotation, in accordance with at least one embodiment thereof.
Figure 60:
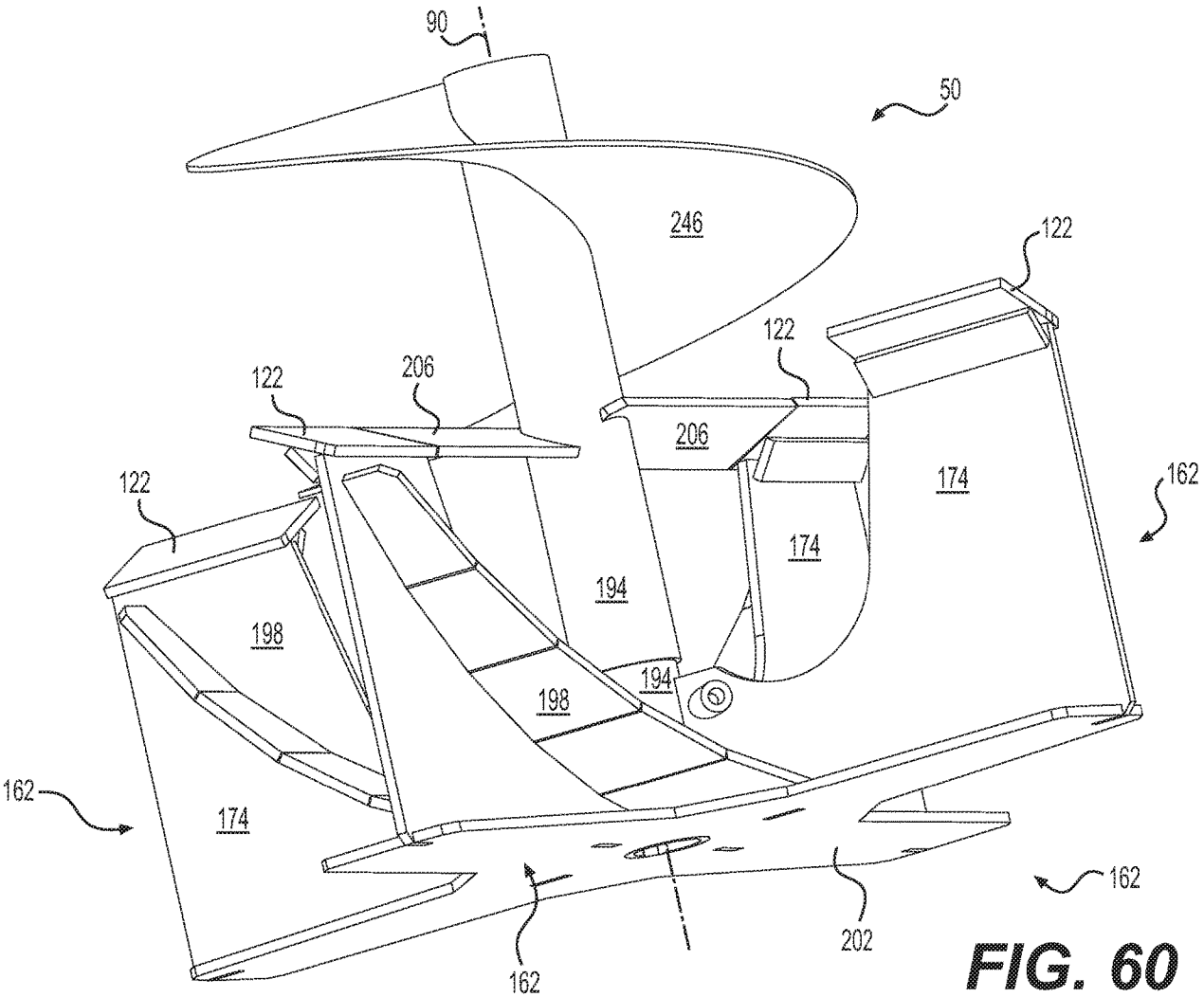
FIG. 60 is a side-bottom perspective illustration of a possible embodiment of the impeller wherein the impeller is combined with an endless screw assembled on the axis or rotation, in accordance with at least one embodiment thereof; an illustration of the perspective view of a possible embodiment of the impeller in the exemplary snowblower wherein the rotation axis of the impeller is an endless screw.

FIG. 59 and FIG. 60 are illustrating an embodiment where an endless screw 246 used with or without extensions 206. The endless screw 246 is adapted to increase the amount of snow the impeller 50 can propel and ensures limited snow blocks sizes with get in touch with the impeller 50. The endless screw 246 is optionally connected to the extensions 206 and is axially connected to the hub 194 or an extension thereof. Alternatively, the endless screw 246 could be secure otherwise or used with a different combination of parts.

Figure 62:
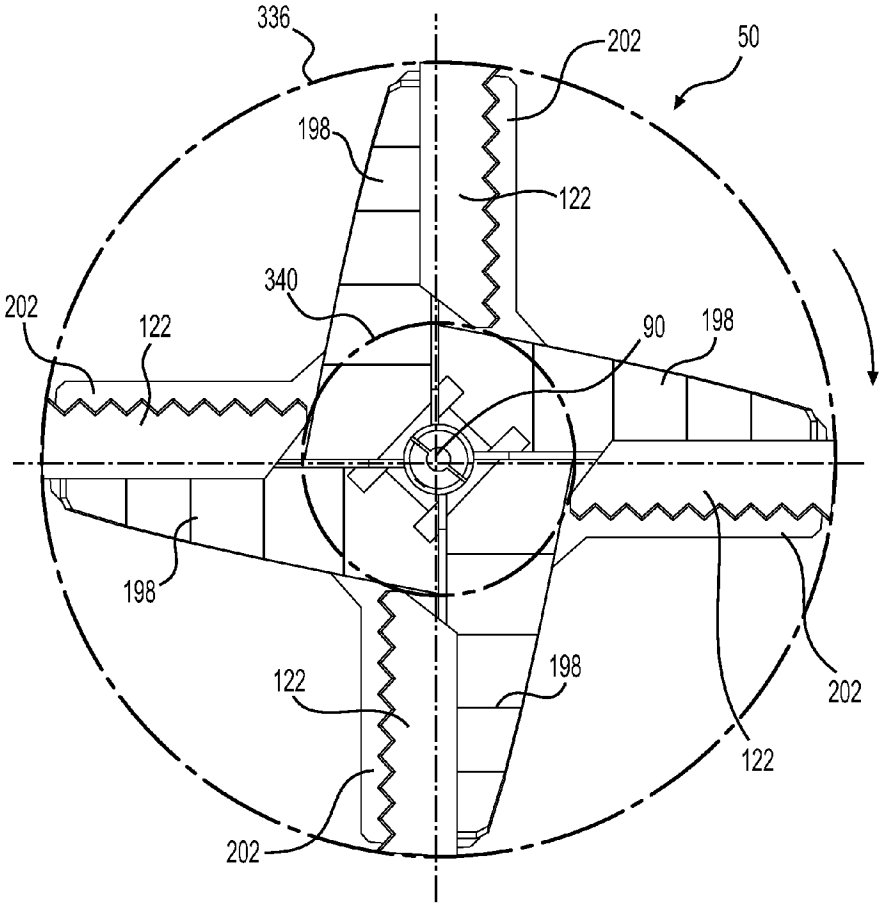
FIG. 62 is a front illustration of an embodiment of the impeller and its components.
Figure 61:
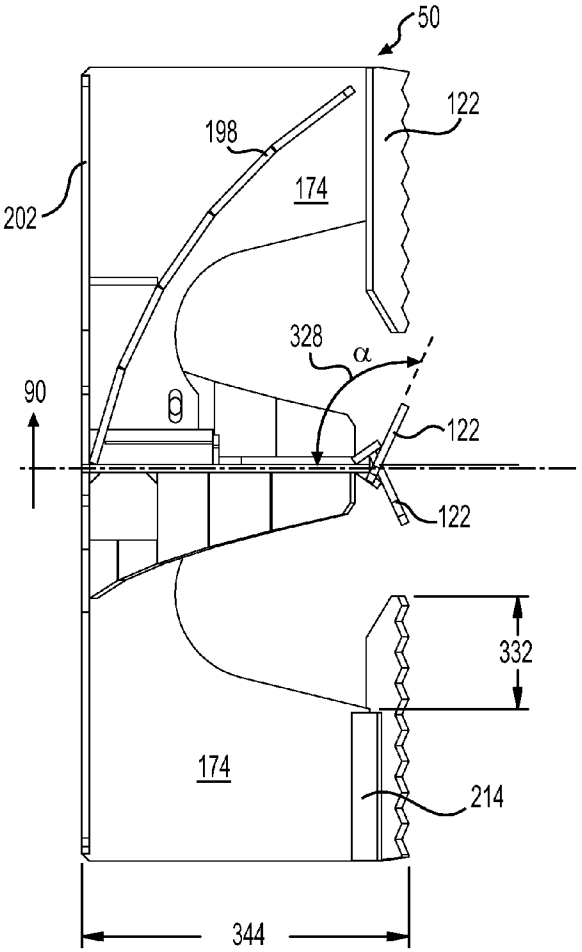
FIG. 61 is a side illustration of an embodiment of the impeller and its components.

FIG. 61 and FIG. 62 are provided to illustrate general angles and dimensions of the impeller 50 and its components. The reader should be aware that the dimensions and angles are for illustrative purposes only and are applicable for tractors 18 of average power. The dimensions are going to be adjusted for tractors 18 that are more or less powerful. The dimensions and angles of the impeller 50 and its components can also be modified in accordance with specific requirements associated with the tractor 18, the conditions of the snow and other mechanical and environmental considerations. Exemplary dimensions and angles are indicated in the following table:

TABLE 1

| Numeral reference | Description | Min. angle | Max. angle | Min. length | Max. length |
|---|---|---|---|---|---|
| 328 | Angle of the snow-engaging portion | 90° | 180° | n/a | n/a |
| 328 | Angle of the snow-engaging portion | 100° | 170° | n/a | n/a |
| 328 | Angle of the snow-engaging portion | 120° | 160° | n/a | n/a |
| 328 | Angle of the snow-engaging portion | 125° | 150° | n/a | n/a |
| 328 | Angle of the snow-engaging portion | 130° | 145° | n/a | n/a |
| 328 | Angle of the snow-engaging portion | 135° | 160° | n/a | n/a |
| 328 | Angle of the snow-engaging portion | 145° | 160° | n/a | n/a |
| 328 | Angle of the snow-engaging portion | 150° | 155° | n/a | n/a |
| 332 | Radial extension of the snow-engaging portion | n/a | n/a | 0 mm | 200 mm |
| 332 | Radial extension of the snow-engaging portion | n/a | n/a | 20 mm | 175 mm |
| 332 | Radial extension of the snow-engaging portion | n/a | n/a | 40 mm | 150 mm |
| 332 | Radial extension of the snow-engaging portion | n/a | n/a | 60 mm | 125 mm |
| 332 | Radial extension of the snow-engaging portion | n/a | n/a | 80 mm | 110 mm |
| 332 | Radial extension of the snow-engaging portion | n/a | n/a | 90 mm | 100 mm |
| 336 | Diameter of impeller | n/a | n/a | 200 mm | 1000 mm |
| 336 | Diameter of impeller | n/a | n/a | 300 mm | 900 mm |
| 336 | Diameter of impeller | n/a | n/a | 400 mm | 800 mm |
| 336 | Diameter of impeller | n/a | n/a | 500 mm | 700 mm |
| 336 | Diameter of impeller | n/a | n/a | 600 mm | 650 mm |
| 340 | Free diameter in impeller | n/a | n/a | 0 mm | 600 mm |
| 340 | Free diameter in impeller | n/a | n/a | 100 mm | 500 mm |
| 340 | Free diameter in impeller | n/a | n/a | 150 mm | 400 mm |
| 340 | Free diameter in impeller | n/a | n/a | 200 mm | 300 mm |
| 340 | Free diameter in impeller | n/a | n/a | 200 mm | 250 mm |
| 344 | Depth of impeller | n/a | n/a | 100 mm | 600 mm |
| 344 | Free diameter in impeller | n/a | n/a | 150 mm | 500 mm |
| 344 | Free diameter in impeller | n/a | n/a | 200 mm | 400 mm |
| 344 | Free diameter in impeller | n/a | n/a | 225 mm | 300 mm |
| 344 | Free diameter in impeller | n/a | n/a | 250 mm | 275 mm |

Figure 63:
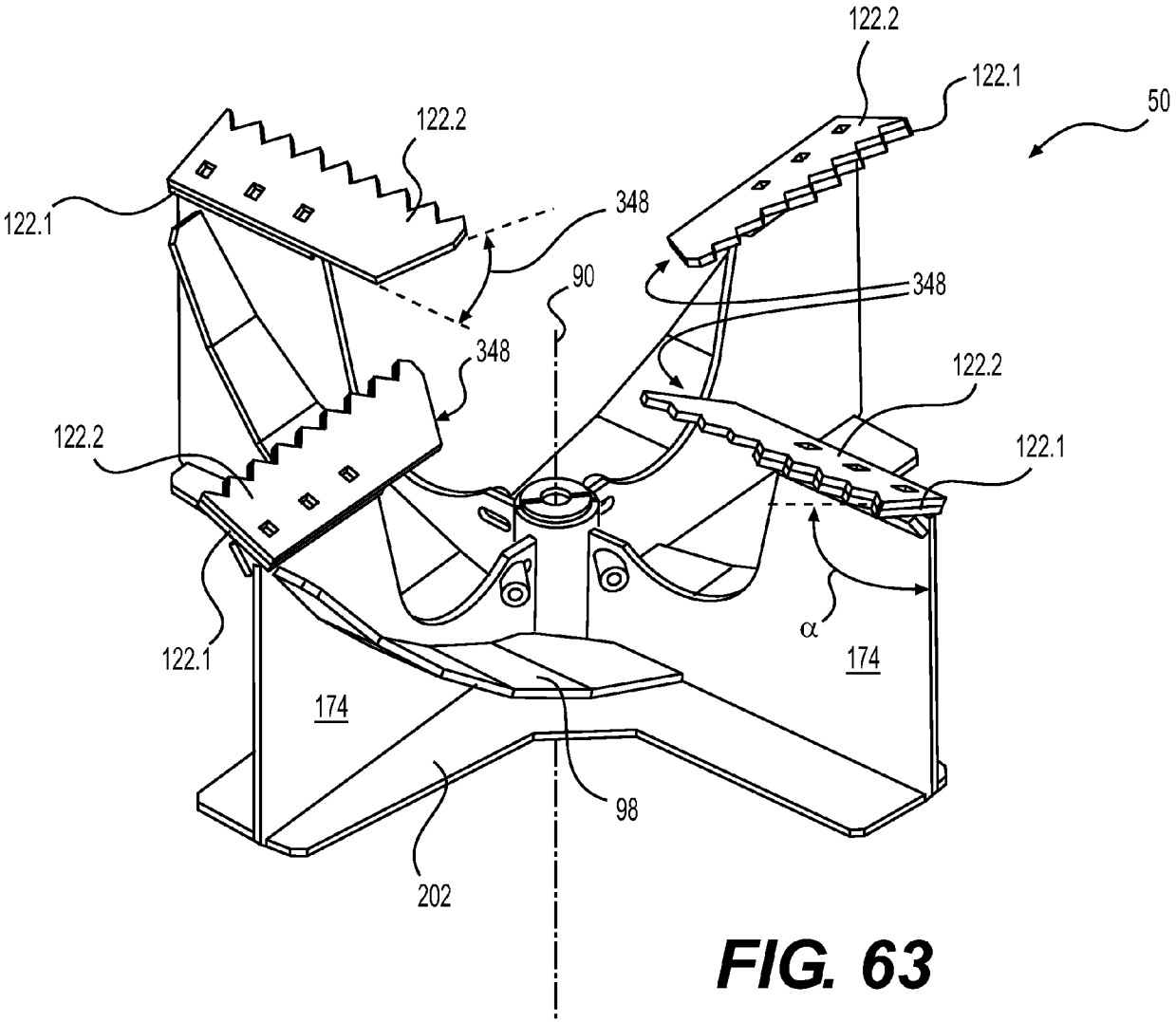
FIG. 63 is a perspective view of illustration of an embodiment of the impeller and its components.

Turning now to FIG. 63 that illustrates an impeller 50 with two sets of snow-engaging portions 122.1, 122.2. The second set of snow-engaging portions 122.2 is fixedly or removably secured to the first set of snow-engaging portions 122.1. In the illustrated embodiment, the second set of snow-engaging portions 122.2 is radially and proximally extending toward the axis of rotation 90 beyond the radially and proximally extension of the first set of snow-engaging portions 122.1. The superposed sets of snow-engaging portions 122.1, 122.2 provide added strength to the impeller 50 and offer the option to remove the second set of snow-engaging portions 122.2 if it is not desired or, for instance, if they are damaged allowing the snowblower 10 to remain usable. One can appreciate angle 348 on the proximal side of the snow-engaging portions 122.2 to increase the size of the central opening of the impeller while providing maximum radial extension toward the axis of rotation 90.

Figure 64:
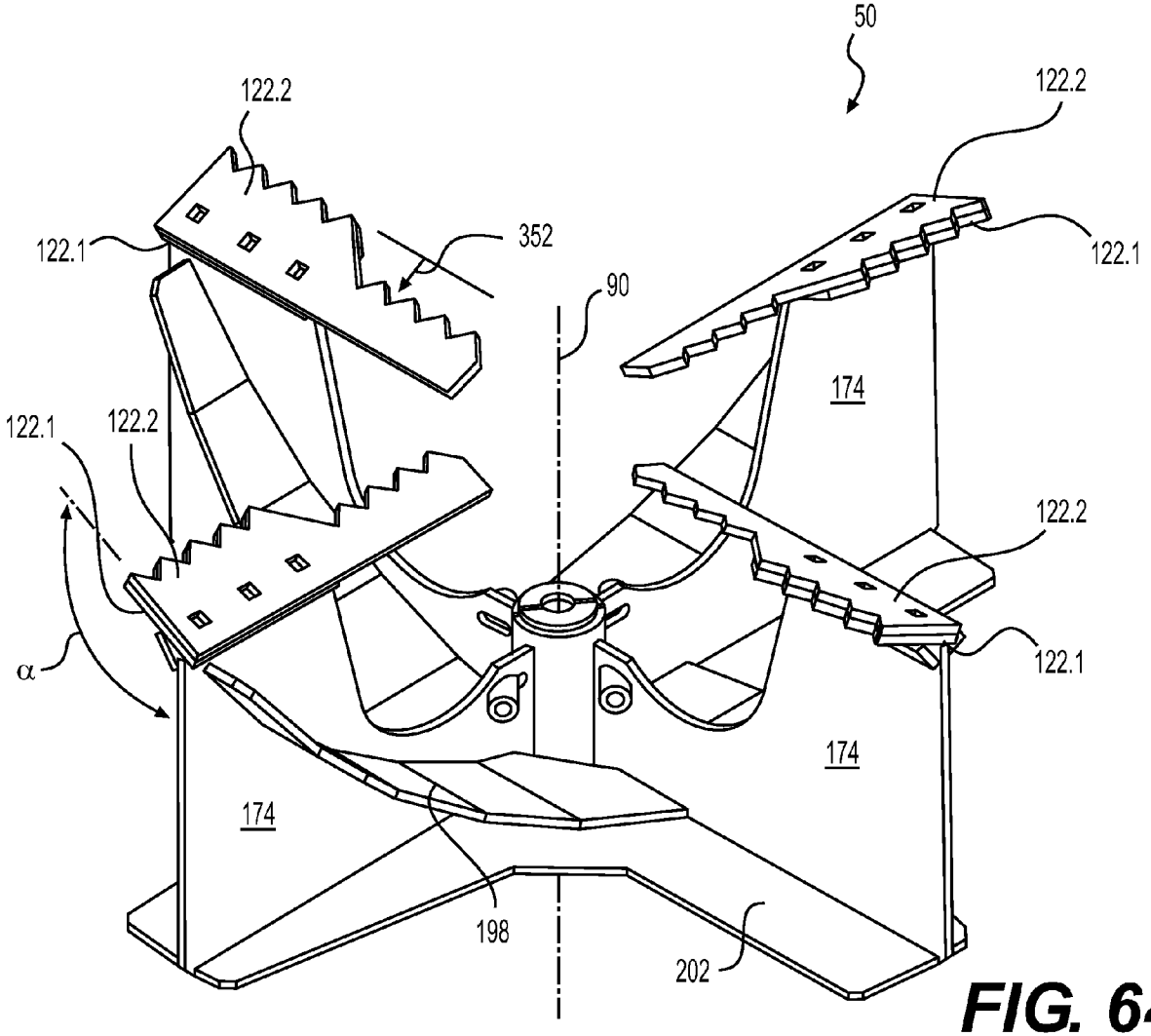
FIG. 64 is a perspective view of illustration of an embodiment of the impeller and its components.

FIG. 64 illustrate another embodiment of the invention depicting a second set of snow-engaging portions 122.2 that have a reduced width 352 compared to the first set of snow-engaging portions 122.1. The reduced width 352 is performed on the portion of the second set of snow-engaging portions 122.2 that is radially and proximally extending beyond the first set of snow-engaging portions 122.1. The reduced width allows, inter alia, for minimizing the weight of the rotative assembly and maximum central opening of the impeller 50.

Figure 65:
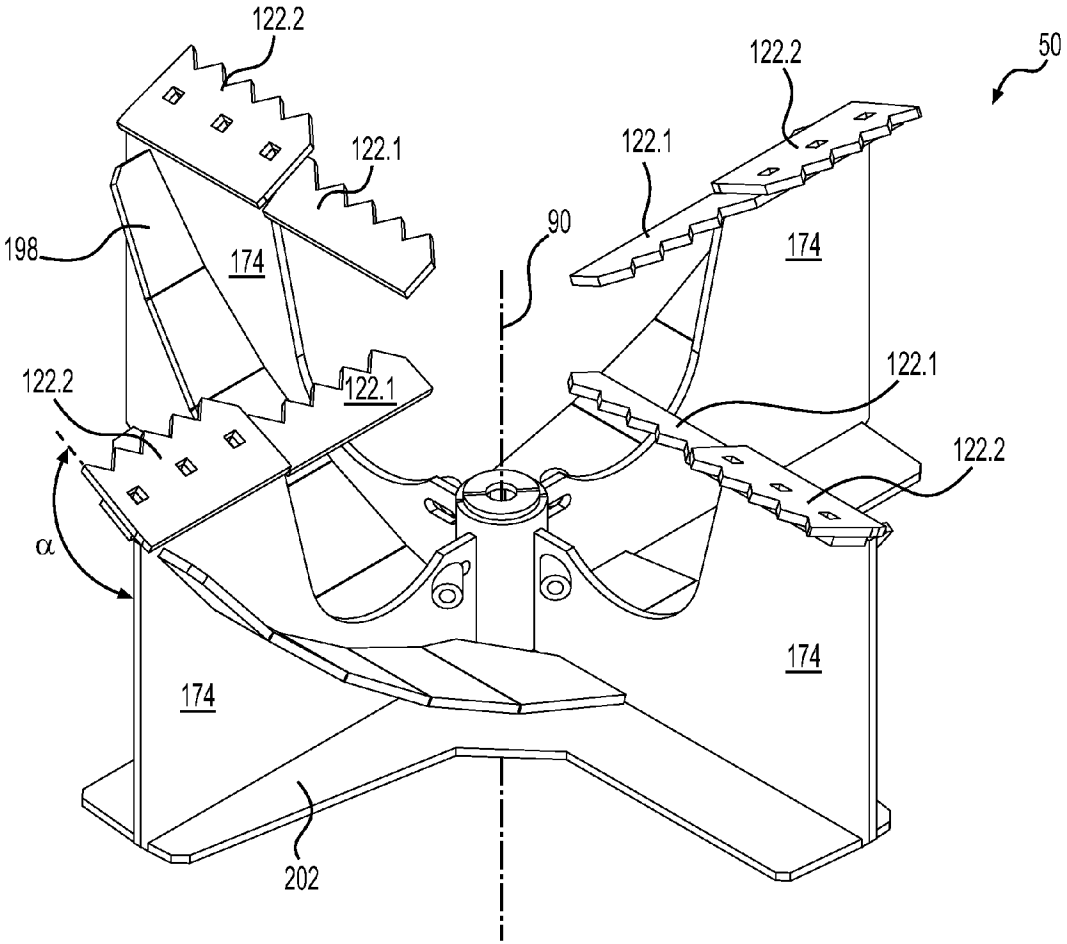
FIG. 65 is a perspective view of illustration of an embodiment of the impeller and its components.

FIG. 65 illustrate an embodiment that is the opposite of the embodiment of FIG. 64. The first set of snow-engaging portions 122.1 is radially longer than the length of the second set of snow-engaging portions 122.2. The width of the first set of snow-engaging portions 122.1 is also reduced compared to the width of the second set of snow-engaging portions 122.2. The teeth of the snow-engaging portions 122.1 are recessed back in respect with the teeth of the snow-engaging portions 122.2.

Figure 66:
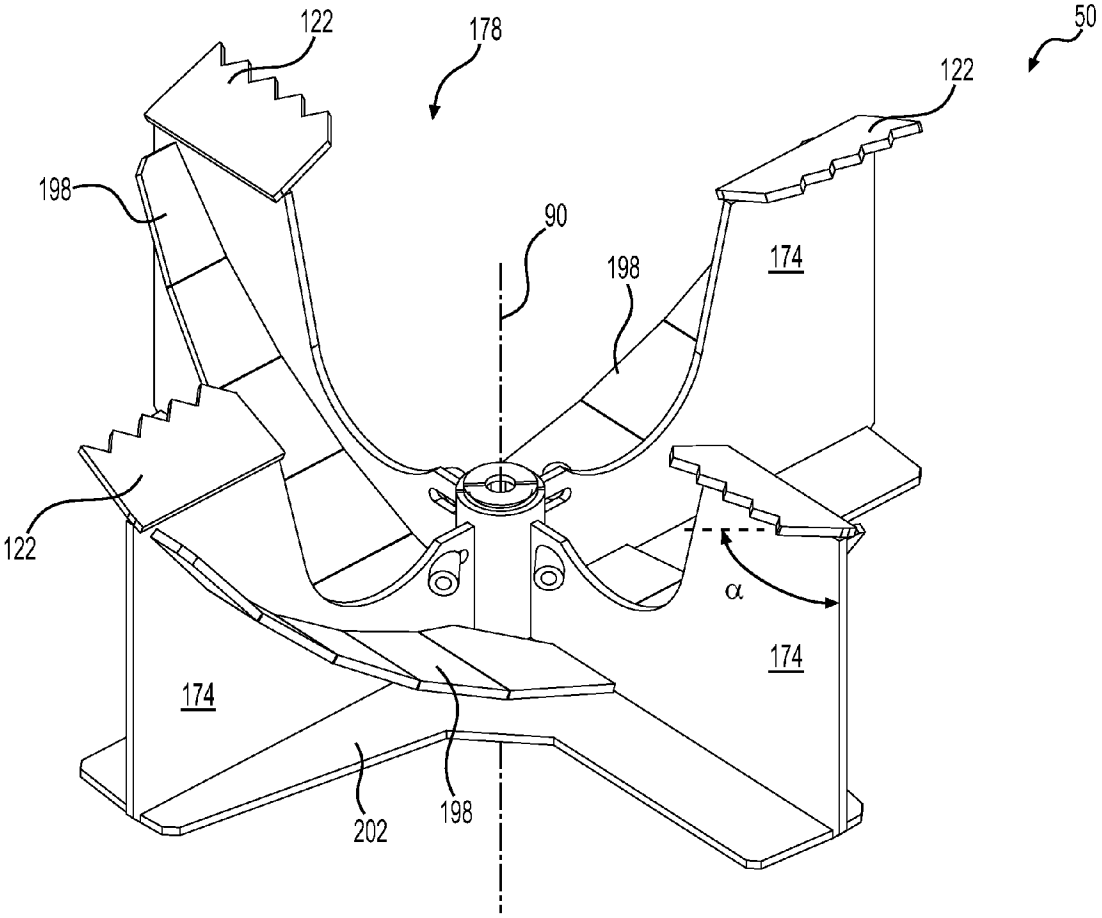
FIG. 66 is a perspective view of illustration of an embodiment of the impeller and its components.

FIG. 66 depicts another embodiment with a single set of snow-engaging portions 122 that have a radial length of substantially similar radial length with their respectively supporting portions to propel snow 174 of the impeller 50. The portions to propel snow 174 define an impeller's eye 178 of significant size.

Figure 67:
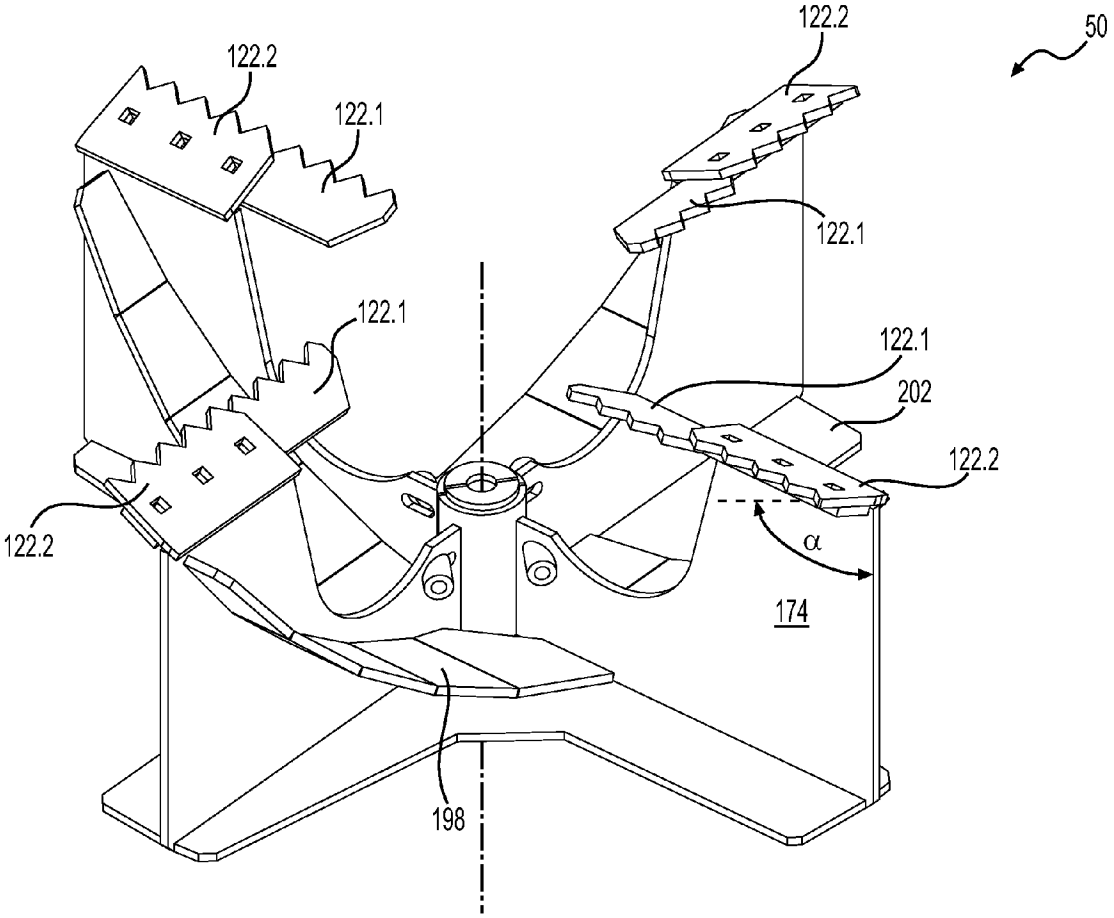
FIG. 67 is a perspective view of illustration of an embodiment of the impeller and its components.

FIG. 67 illustrate an embodiment that is the opposite of the embodiment of FIG. 64. The first set of snow-engaging portions 122.1 is radially longer than the length of the second set of snow-engaging portions 122.2. The width of the first set of snow-engaging portions 122.1 is also reduced compared to the width of the second set of snow-engaging portions 122.2. The teeth of the snow-engaging portions 122.1 are at the same height with the teeth of the snow-engaging portions 122.2.

Figure 68:
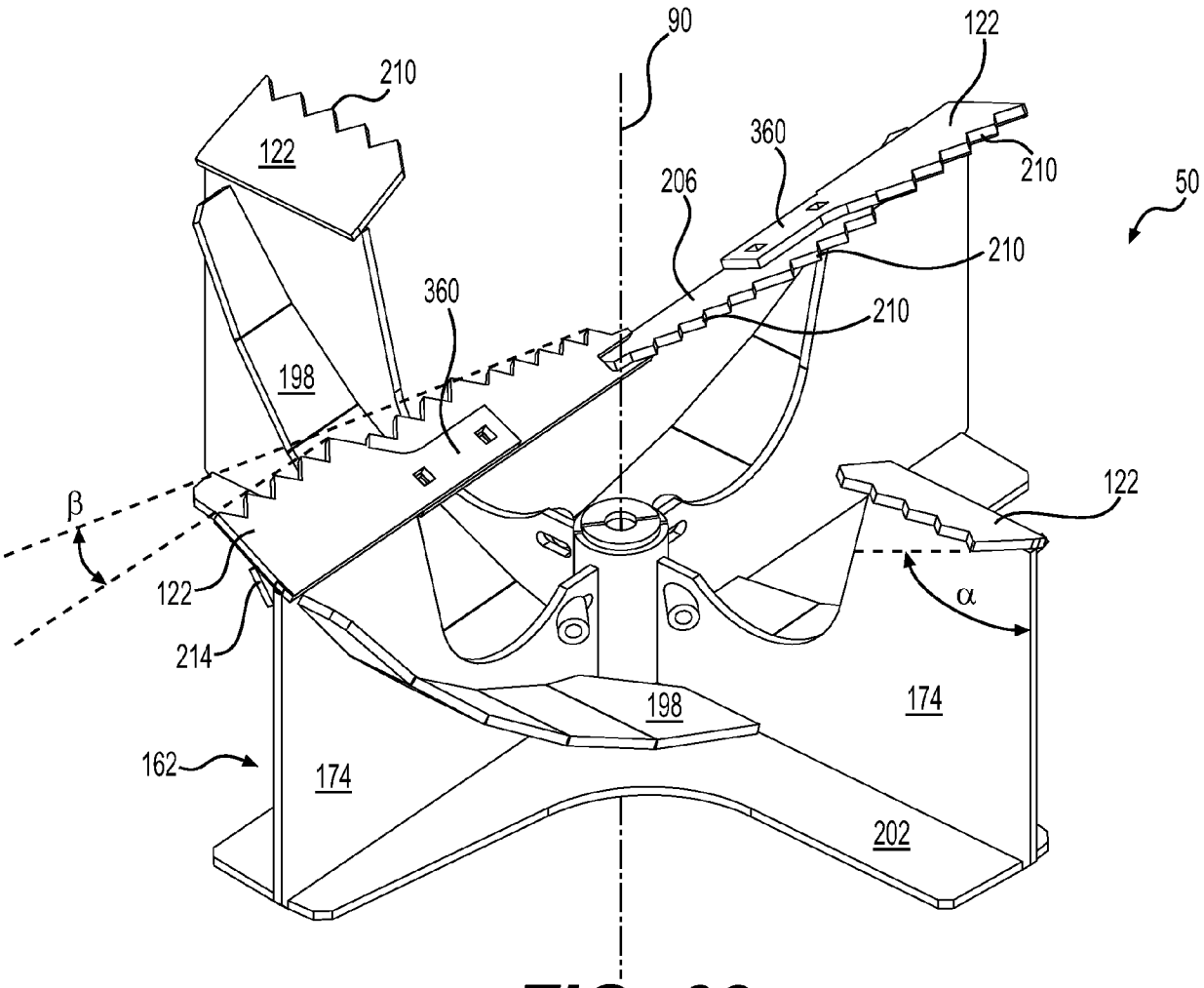
FIG. 68 is a perspective view of illustration of an embodiment of the impeller and its components.
Figure 69:
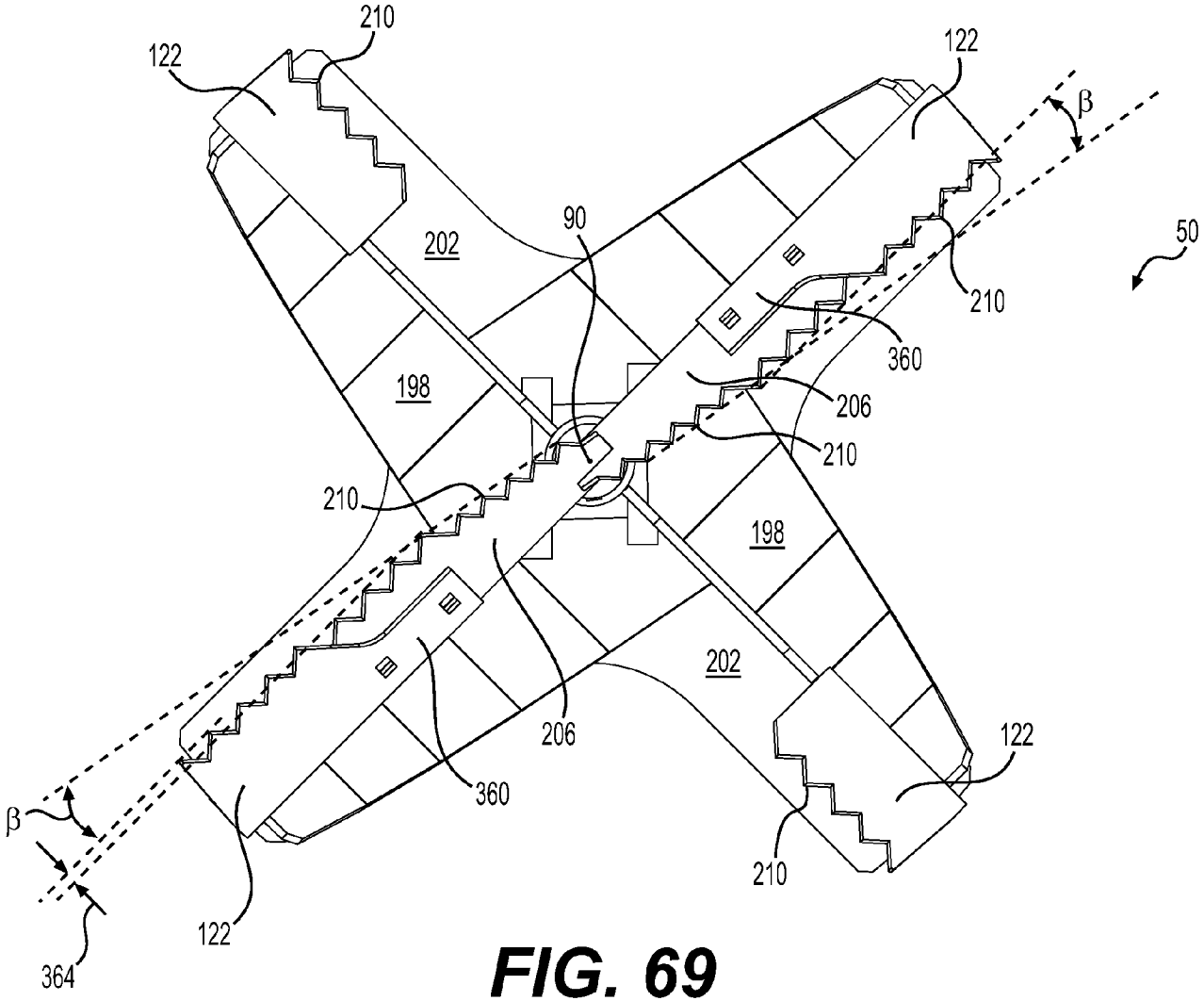
FIG. 69 is an elevational view of illustration of an embodiment of the impeller and its components.

FIG. 68 and FIG. 69 are illustrating an embodiment where the impeller 50 has two snow-engaging portions 122 each comprising an extended connector 360 adapted to secure thereon a snow-engaging portion extension 206 and extend, in combination, across the impeller 50. The snow-engaging portion extension 206 is secured to the snow-engaging portion 122 to be removed for maintenance, repair or replacement. The snow-engaging portion extensions 206 of the present embodiment can be secured, welded or jointed together about the axis of rotation 90. One can appreciate that the teeth of the snow-engaging portion extensions 206 are not aligned 364 with the teeth of the snow-engaging portion 122. The teeth 210 of the snow-engaging portion extensions 206 are also designed with an angle β thereof on the proximal portion of the snow-engaging portion extensions 206. The snow-engaging portion extensions 206 are thinner at their proximal side.

Figure 70:
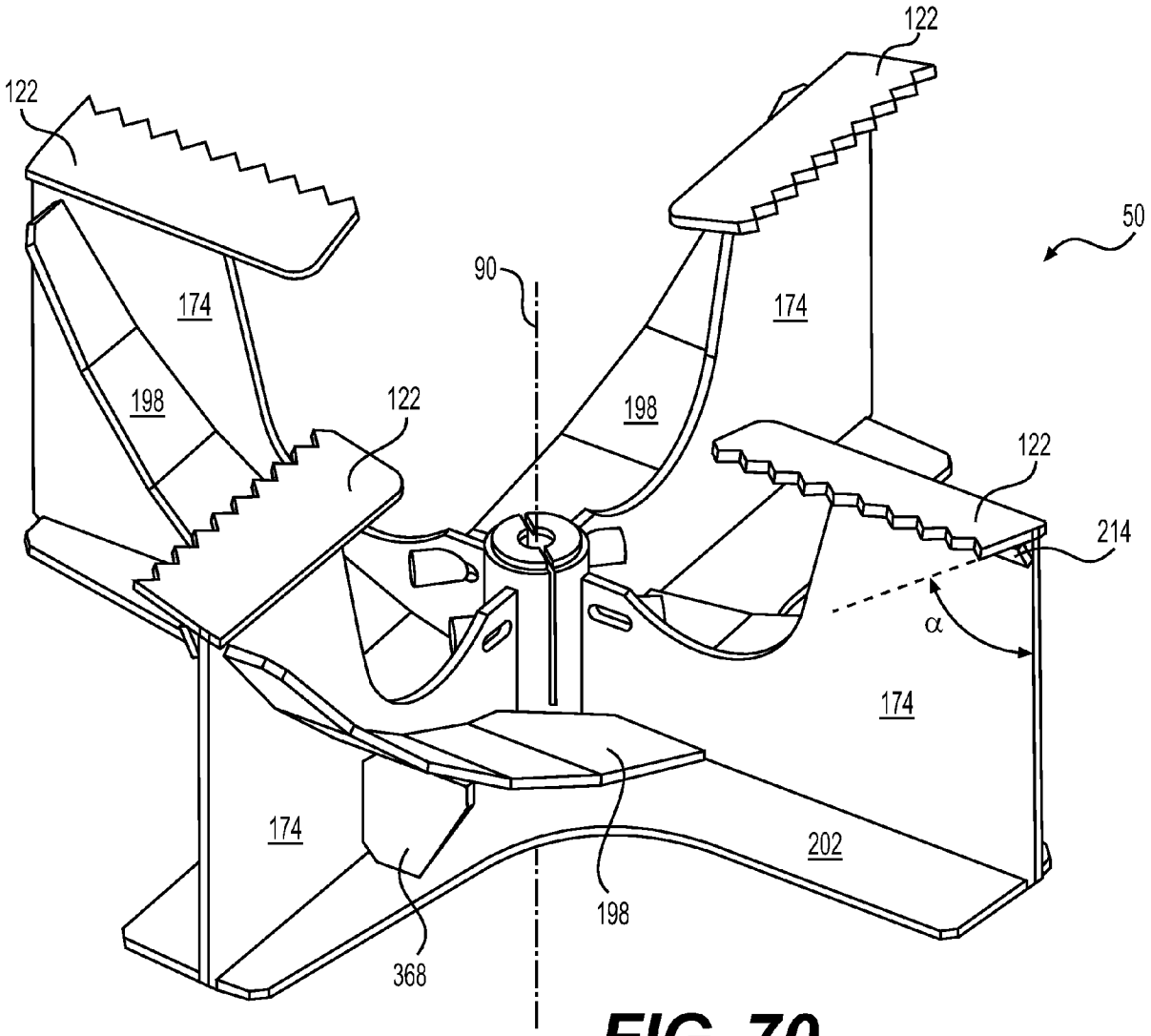
FIG. 70 is a perspective view of illustration of an embodiment of the impeller and its components.

Another embodiment is depicted in FIG. 70 with an impeller 50 equipped with extended snow-engaging portions 122. The extended snow-engaging portions 122 are extending toward the axis of rotation 90 of the impeller 50 without covering the center of the impeller 50. The extended snow-engaging portions 122 are angled with angle α to collect snow. The impeller 50 is also equipped with a reinforcement 368 adapted to rigidify the assembly.

Figure 71:
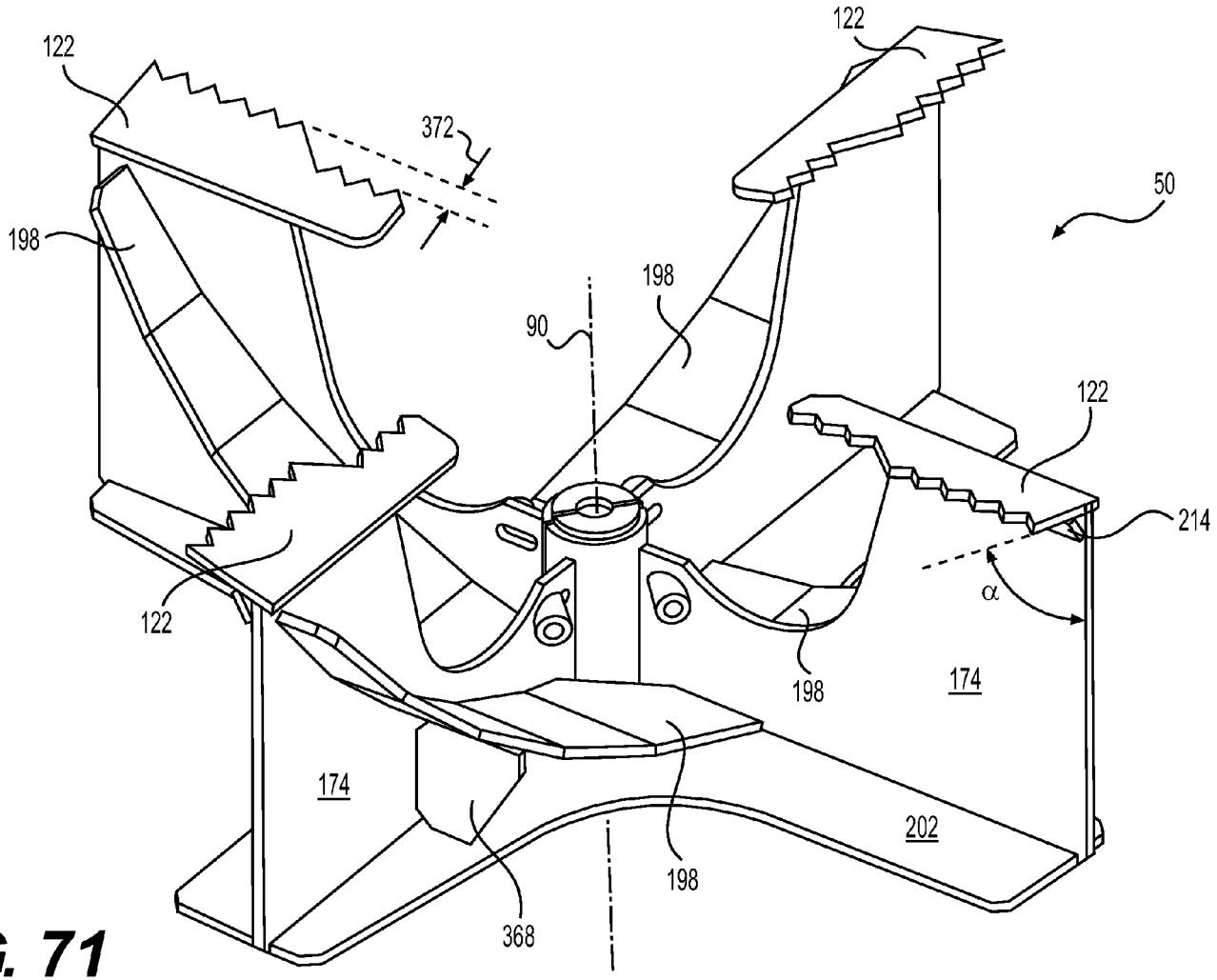
FIG. 71 is a perspective view of illustration of an embodiment of the impeller and its components.

An embodiment illustrating an impeller 50 equipped with extended snow-engaging portions 122 with a snow-engaging portions 122 thickness variation 372 on the front edge of the snow-engaging portions 122 is depicted in FIG. 71. The extended snow-engaging portions 122 are extending toward the axis of rotation 90 of the impeller 50 without covering the center of the impeller 50. The extended snow-engaging portions 122 are angled with angle α to collect snow. The impeller 50 is also equipped with a reinforcement 368 adapted to rigidify the assembly. The thickness reduction 372 is adapted to extend toward the rotation axis 90 of the impeller 50 without covering too much surface area of the impeller 50.

Figure 72:
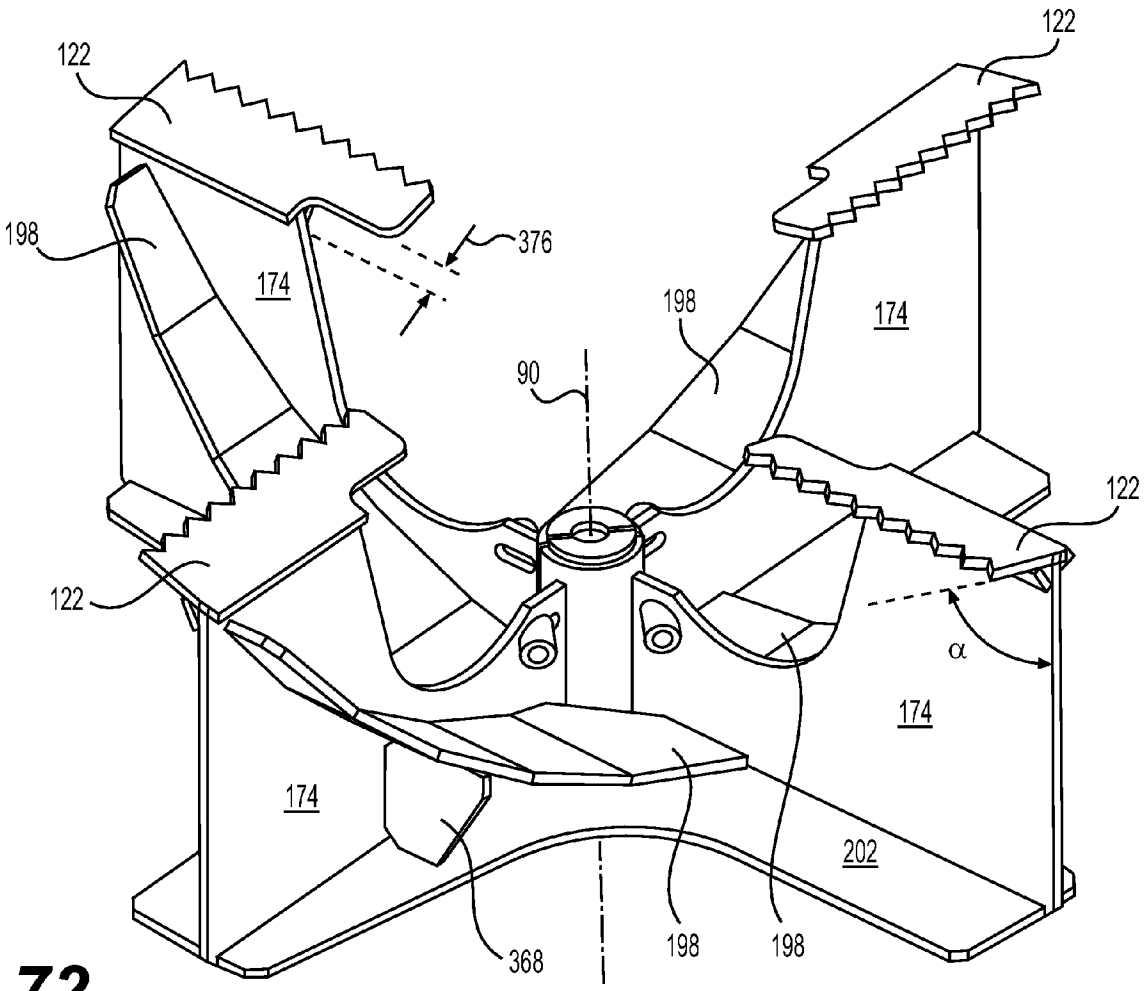
FIG. 72 is a perspective view of illustration of an embodiment of the impeller and its components.

Another embodiment illustrating an impeller 50 equipped with extended snow-engaging portions 122 with a snow-engaging portions 122 thickness reduction 376 is depicted in FIG. 72. The thickness reduction 376 is located on the trailing edge of the snow-engaging portions 122. The extended snow-engaging portions 122 are extending toward the axis of rotation 90 of the impeller 50 without covering the center of the impeller 50. The extended snow-engaging portions 122 are angled with angle α to collect snow. The impeller 50 is also equipped with a reinforcement 368 adapted to rigidify the assembly. The thickness reduction 372 is adapted to extend toward the rotation axis 90 of the impeller 50 without covering too much surface area of the impeller 50.

Figure 73:
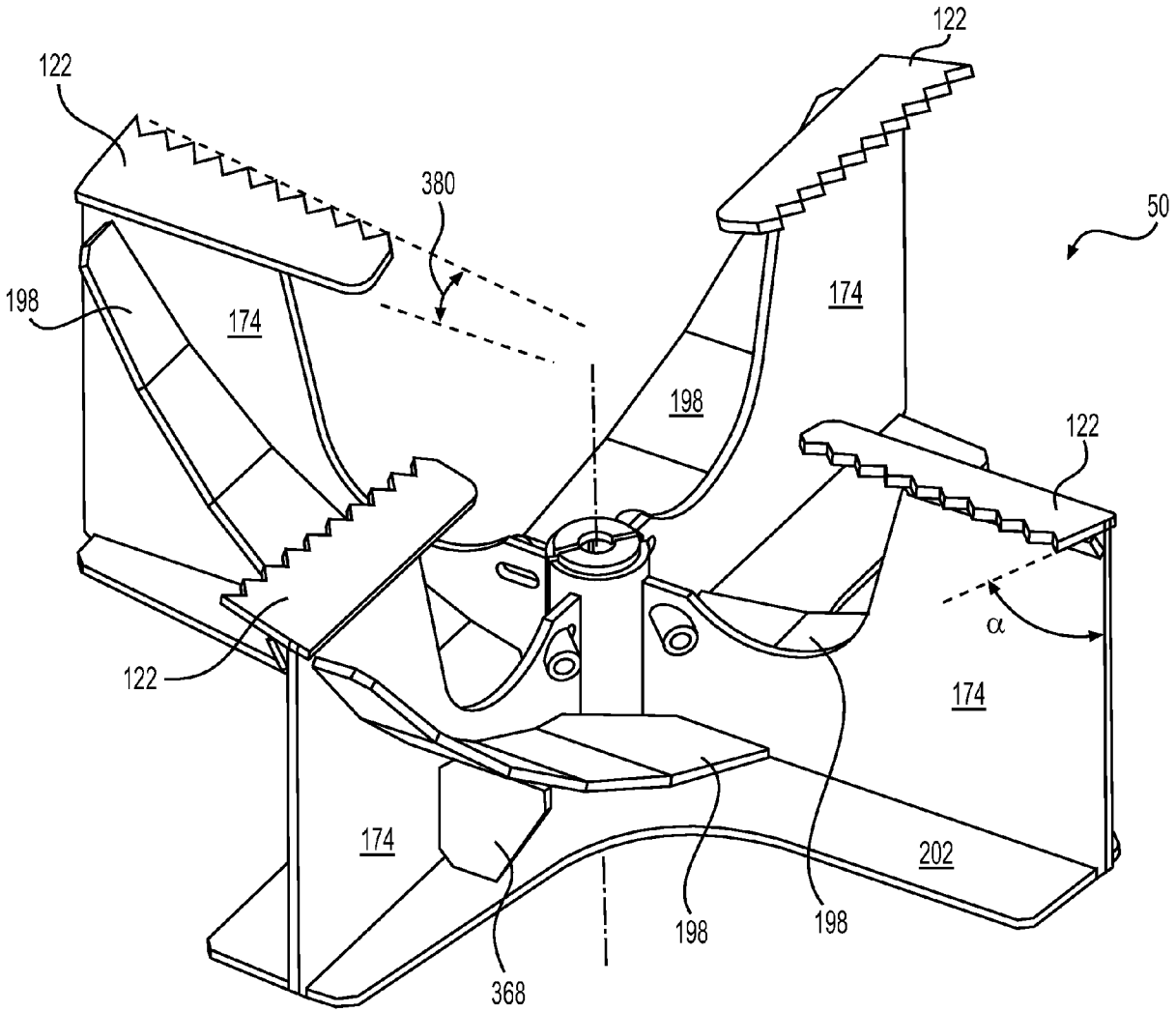
FIG. 73 is a perspective view of illustration of an embodiment of the impeller and its components.

Another embodiment illustrating an impeller 50 equipped with extended snow-engaging portions 122 with a taper 380 snow-engaging portions 122 is depicted in FIG. 73. The tapering of the snow-engaging portions 122 is getting smaller toward the center of the impeller 50. The extended snow-engaging portions 122 are extending toward the axis of rotation 90 of the impeller 50 without covering the center of the impeller 50. The extended snow-engaging portions 122 are angled with angle α to collect snow. The impeller 50 is also equipped with a reinforcement 368 adapted to rigidify the assembly. The thickness reduction 372 provided by the tapering of the snow-engaging portions 122 is adapted to extend toward the rotation axis 90 of the impeller 50 without covering too much surface area of the impeller 50.

Figure 74:
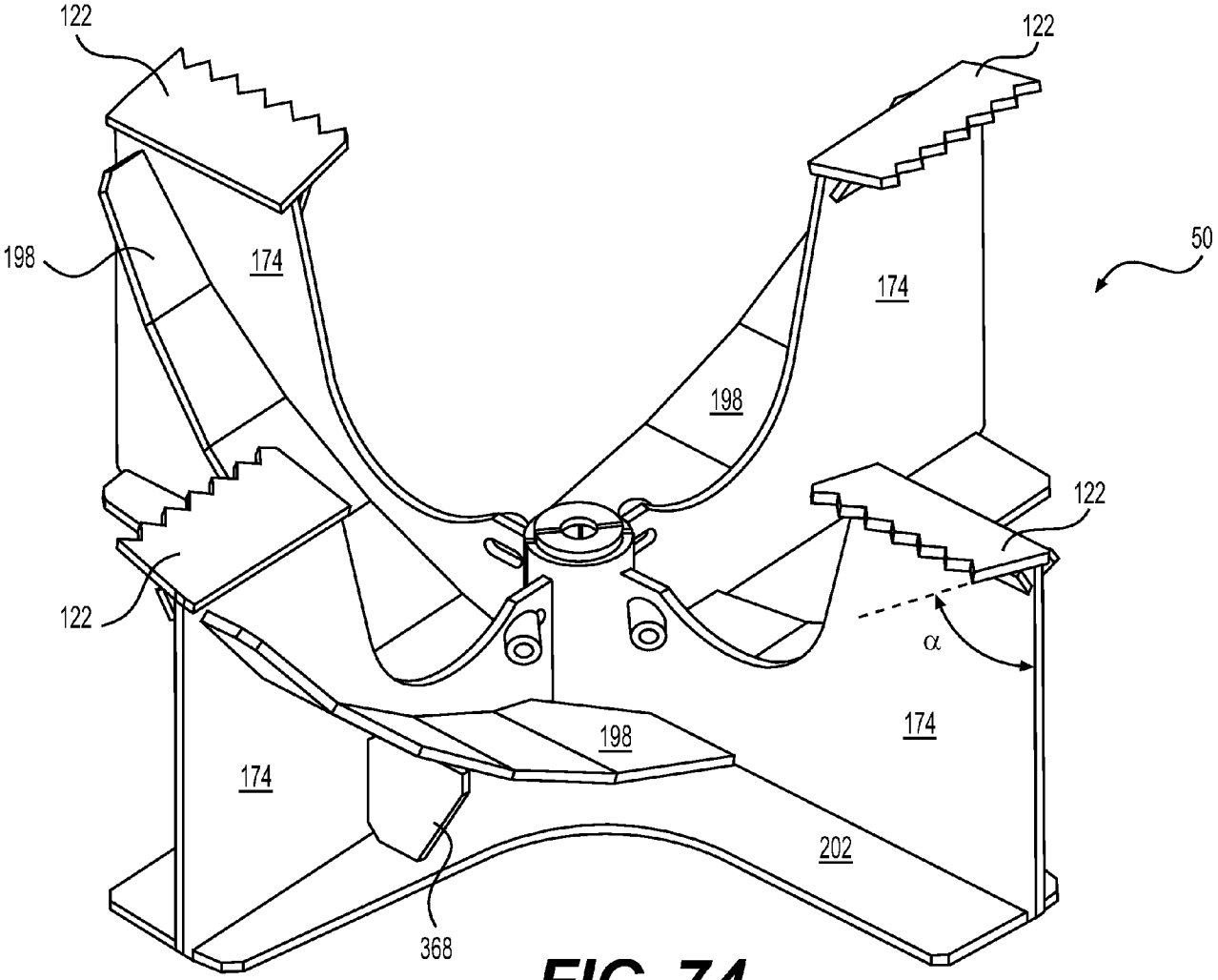
FIG. 74 is a perspective view of illustration of an embodiment of the impeller and its components.

One other embodiment illustrating an impeller 50 equipped with angled snow-engaging portions 122 is depicted in FIG. 74. The snow-engaging portions 122 are angled with angle α to collect snow. The impeller 50 is also equipped with a reinforcement 368 adapted to rigidify the assembly.

The description and the drawings that are presented above are meant to be illustrative of the present invention. They are not meant to be limiting of the scope of the present invention. Modifications to the embodiments described may be made without departing from the present invention, the scope of which is defined by the following claims:

The invention claimed is:

1. An impeller for a snowblowing apparatus, the impeller being designed to rotate about a rotation axis thereof, the impeller comprising:

a front axial region thereof, the front axial region being configured to receive snow therein in an impeller's eye;

a rear axial region thereof;

a periphery thereof;

a hub, generally located between the front axial region and the rear axial region, adapted to rotate about the rotation axis of the impeller;

a plurality of axial vanes generally radially extending from the periphery of the impeller toward the rotation axis, the plurality of vanes including a portion configured to propel snow disposed between the front axial region and the rear axial region, the plurality of vanes including a void area around the rotation axis toward the front axial region for receiving snow in the impeller's eye, the plurality of vanes including a respective snow-engaging portion secured thereon, the snow-engaging portions being generally located toward the front axial region of the vanes and respectively angularly aligned and secured adjacent to the plurality of vanes, wherein the snow engaging portions are orthogonally positioned in respect to the rotation axis and are extending from the periphery further toward the rotation axis over the impeller's eye, the snow engaging portions including an angle of attack toward the front axial region for engaging snow when the impeller is rotating about the rotation axis.

2. The impeller of claim 1, wherein the further extended snow-engaging portion are radially extending in cantilever toward the rotation axis.

3. The impeller of claim 1, wherein the snow-engaging portion includes an angled portion thereof of about between 95 degree to about 110 degree.

4. The impeller of claim 1, wherein the snow-engaging portion includes an angled portion thereof of about 105 degree.

5. The impeller of claim 1, wherein the snow-engaging portion includes a plurality of teeth thereof.

6. The impeller of claim 1, wherein the impeller includes five axial vanes.

7. The impeller of claim 1, wherein the snow-engaging portions have a substantially similar radial length thereof.

8. The impeller of claim 1, wherein the snow-engaging portion includes a variable width thereof.

9. A snowblowing apparatus comprising an impeller adapted to rotate about a rotation axis thereof, the impeller comprising:

a front axial region thereof, the front axial region being configured to receive snow therein in an impeller's eye;

a rear axial region thereof;

a periphery thereof;

a hub, generally located between the front axial region and the rear axial region, adapted to rotate about the rotation axis of the impeller;

a plurality of axial vanes generally radially extending from the periphery of the impeller toward the rotation axis, the plurality of vanes including a portion configured to propel snow disposed between the front axial region and the rear axial region, the plurality of vanes including a void area around the rotation axis toward the front axial region for receiving snow in the impeller's eye, the plurality of vanes including a respective snow-engaging portion secured thereon, the snow-engaging portions being generally located toward the front axial region of the vanes and respectively angularly aligned and secured adjacent to the plurality of vanes, wherein the snow engaging portions are orthogonally positioned in respect to the rotation axis and are extending from the periphery further toward the rotation axis over the impeller's eye, the snow engaging portions including an angle of attack toward the front axial region for engaging snow when the impeller is rotating about the rotation axis.

10. The snowblowing apparatus of claim 9, wherein the further extended snow-engaging portion are radially extending in cantilever toward the rotation axis.

11. The snowblowing apparatus of claim 9, wherein the snow-engaging portion includes an angled portion thereof of about between 95 degree to about 110 degree.

12. The snowblowing apparatus of claim 9, wherein the snow-engaging portion includes an angled portion thereof of about 105 degree.

13. The snowblowing apparatus of claim 9, wherein the snow-engaging portion includes a plurality of teeth thereof.

14. The snowblowing apparatus of claim 9, wherein the impeller includes five axial vanes snow-engaging portion is four further extended snow-engaging portions.

15. The snowblowing apparatus of claim 9, wherein the four snow-engaging portions have a substantially similar radial length thereof.

16. The snowblowing apparatus of claim 9, wherein the snow-engaging portion includes a variable width thereof.

17. A vehicle with a snowblowing apparatus, the snowblowing apparatus comprising:

an impeller adapted to rotate about a rotation axis thereof, the impeller comprising:

a front axial region thereof, the front axial region being configured to receive snow therein in an impeller's eye;

a rear axial region thereof;

a periphery thereof;

a hub, generally located between the front axial region and the rear axial region, adapted to rotate about the rotation axis of the impeller;

a plurality of axial vanes generally radially extending from the periphery of the impeller toward the rotation axis, the plurality of vanes including a portion configured to propel snow disposed between the front axial region and the rear axial region, the plurality of vanes including a void area around the rotation axis toward the front axial region for receiving snow in the impeller's eye, the plurality of vanes including a respective snow-engaging portion secured thereon, the snow-engaging portions being generally located toward the front axial region of the vanes and respectively angularly aligned and secured adjacent to the plurality of vanes, wherein the snow engaging portions are orthogonally positioned in respect to the rotation axis and are extending from the periphery further toward the rotation axis over the impeller's eye, the snow engaging portions including an angle of attack toward the front axial region for engating snow when the impeller is rotating about the rotation axis.

18. The vehicle of claim 17, wherein the snow-engaging portions are radially extending in cantilever toward the rotation axis.

19. The vehicle of claim 17, wherein the snow-engaging portion includes an angled portion thereof of about 105 degree.

20. The vehicle of claim 17, wherein the snow-engaging portion includes a plurality of teeth thereof.

* * * * *